US006150062A

United States Patent [19]

Sugizaki et al.

[11] Patent Number: 6,150,062

[45] Date of Patent: Nov. 21, 2000

[54] TONERS FOR DEVELOPING ELECTROSTATIC LATENT IMAGES, DEVELOPERS FOR ELECTROSTATIC LATENT IMAGES AND METHODS FOR FORMING IMAGES

[75] Inventors: Yutaka Sugizaki; Hirokazu Hamano, both of Minamiashigara, Japan

[73] Assignee: Fuji Xerox Co., Ltd., Tokyo, Japan

[21] Appl. No.: 09/203,596

[22] Filed: Dec. 2, 1998

[30] Foreign Application Priority Data

| | | | |
|---|---|---|---|
| Dec. 19, 1997 | [JP] | Japan | 9-351763 |
| May 27, 1998 | [JP] | Japan | 10-145773 |
| Jul. 8, 1998 | [JP] | Japan | 10-192982 |
| Aug. 3, 1998 | [JP] | Japan | 10-219376 |

[51] Int. Cl.[7] ..... G03G 9/09; G03G 13/01

[52] U.S. Cl. ..... 430/45; 430/110; 430/111; 430/126

[58] Field of Search ..... 430/45, 110, 111, 430/126

[56] References Cited

U.S. PATENT DOCUMENTS

| | | | |
|---|---|---|---|
| 4,737,433 | 4/1988 | Rimai et al. | 430/111 |
| 5,300,383 | 4/1994 | Tsubota et al. | 430/111 |
| 5,437,949 | 8/1995 | Kanbayashi et al. | 430/45 |

FOREIGN PATENT DOCUMENTS

| | | |
|---|---|---|
| 63-123056 | 5/1988 | Japan . |
| 5-127437 | 1/1993 | Japan . |
| 5-107809 | 4/1993 | Japan . |
| 5-6033 | 5/1993 | Japan . |
| 6-75430 | 3/1994 | Japan . |
| 6-180512 | 6/1994 | Japan . |
| 6-295137 | 10/1994 | Japan . |
| 6-332237 | 12/1994 | Japan . |
| 7-77825 | 3/1995 | Japan . |
| 7-146589 | 6/1995 | Japan . |
| 8-227171 | 9/1996 | Japan . |
| 9-222799 | 8/1997 | Japan . |
| 10-48886 | 2/1998 | Japan . |

*Primary Examiner*—Roland Martin
*Attorney, Agent, or Firm*—Oliff & Berridge, PLC

[57] ABSTRACT

A toner for developing an electrostatic latent image includes at least coloring particles containing a colorant and a binder resin. The volume average particle size of the coloring particle is 1.0 to 5.0 $\mu$m. The toner is further characterized in that (1) the relationship between the quantity of the electric charge and the particle size is adjusted appropriately, (2) the particle size distribution is adjusted appropriately and/or (3) an external additive comprising at least an ultra microparticle and a super-ultra microparticle may be added, the rate of coating on the coloring particle being adjusted appropriately. A method for forming an image includes (1) a developing step in which a toner layer is formed on the surface of a developer support arranged opposed to a latent image support and an electrostatic latent image on the latent image support is developed with the toner layer to obtain a toner image and (2) a transfer step in which the toner image formed is transferred to a transfer material. The Rz of at least an image receiving region of the transfer material provided for the transfer step is preferably 10 $\mu$m or less.

37 Claims, 1 Drawing Sheet

TONERS FOR DEVELOPING ELECTROSTATIC LATENT IMAGES, DEVELOPERS FOR ELECTROSTATIC LATENT IMAGES AND METHODS FOR FORMING IMAGES

BACKGROUND OF THE INVENTION

1. Field of Invention

The present invention relates to toners for developing an electrostatic latent image, developers for an electrostatic latent image and methods for forming an image employed in electrophotography, electrostatic recording, electrostatic printing and the like. More particularly, the present invention relates to toners for developing an electrostatic latent image, developers for an electrostatic latent image and methods for forming an image using the same for the purpose of developing a digital electrostatic latent image.

2. Description of Related Art

In electrophotography, a toner contained in a developer is deposited onto a latent image formed on a photoconductor and then transferred onto a transfer material such as paper or a plastic film. The toner is then fixed by, for example, heating to form an image. The developer used in this process includes a two-component developer comprising a toner and a carrier and a one-component developer such as a magnetic toner. A two-component developer is widely employed because of its preferable controllability due to the fact that the functions of the developer, such as agitation, transportation and electric charging, are shared with a carrier.

On the other hand, increasing numbers of printers and copiers employing electrophotography have, for the past several years, come to involve a color toning technology and achieved finer electrostatic latent images in response to a higher resolution achieved by improved devices. As a result, accurate development of a latent image and a higher quality of an image have been sought to be obtained by reducing the particle size of a toner. Especially in a full color copier by which a digital image is developed, transferred and fixed using color toners, the quality of an image is increased to some extent by using a small-sized toner having a particle size as small as 7 to 8 μm.

Nevertheless, a further smaller particle size and a more accurate particle size distribution will be required to respond to the recent demand for a higher resolution (improved reproducibility of minute lines, improved gradation, etc.). Reduction in the particle size of a toner is accompanied with increased non-static adhesive forces such as van der Waals force, resulting in an increased cohesive force between toner particles which may lead to a markedly poor particulate flowability or resulting in an increased adhesive force of a toner onto a carrier or a photoconductor surface which may lead to poorer developing and transfer performances, thus causing a reduced image density, which is accompanied occasionally with a marked reduction in ability of cleaning the residual toner on the surface of the photoconductor.

In addition, a reduced charge exchange between the toner and the carrier as a result of a reduced particle performance associated with the reduction in the toner particle size may cause a retarded charging, resulting in a broader charge distribution, which may lead to defects of the image such as fogging. Moreover, the reduction in the particle size of a toner causes a reduced charging performance at a high temperature and a high humidity as well as an evidently retarded charging at a low temperature and a low humidity.

A small-sized toner for full color printing gives a thinner toner layer on a transfer material, thereby requiring a higher concentration of the colorant in the toner. In this case, the charging performance of the colorant contained in the toner is affected more evidently, resulting in a disadvantageously greater difference in electric charge quantity, charging speed, temperature and humidity dependence of the charging between full color toners such as cyan, magenta, yellow and black. This constitutes a considerable problem to be solved. Because of this problem, the formation of a high quality image using a toner having a particle size as small as 6 μm or less has not been established practically.

The thickness of an image formed on a transfer material such as transfer paper (hereinafter referred simply to as "image thickness") is several lm or less in offset printing, but is as large as 10 μm to 20 μm in an electrophotographic process. This is so even when the particle sizes of the toners are as small as 7 to 8 μm because of, for example, the need to form at least three toner layers in the case of the process using full color toners. An image having such a large image thickness tends to exhibit an unusual visual impression. Accordingly, in order to achieve an image of a quality as high as that obtained by transfer printing, it is required to eliminate the difference in the image structure from the transfer printing, i.e., to reduce the image thickness. The image thus formed by mounting a large amount of the toners on the transfer material as described above is readily damaged due to its uneven and irregular surface, resulting in a poor durability of the image once formed.

Accordingly, various attempts have been made to improve full color toners. For example, Japanese Patent Application Laid-Open No. 6-75430, No. 6-332237, No. 7-77824, No. 7-77825 and No. 7-146589 propose a use of a toner whose weight average particle size is 3 to 7 μm, and in which a toner having a particle size of 5.04 μm or less is contained in an amount of 40% by number or more, a toner having a particle size of 4 μm or less is contained in an amount of 20 to 70% by number, a toner having a particle size of 8 μm or more is contained in an amount of 2 to 20% by number and a toner having a particle size of 10.8 μm or more is contained in an amount of 6% by number or less, for the purpose of obtaining an image having a high image density as well as excellent highlight reproducibility and minute line reproducibility.

Japanese Patent Application Laid-Open No. 7-146589 proposes the use of a toner whose weight average particle size is 3.5 to 7.5 μm, and in which a toner having a particle size of 5.04 μm or less is contained in an amount of 35% by number or more, a toner having a particle size of 4 μm or less is contained in an amount of 15% by number or more, a toner having a particle size of 8 μm or more is contained in an amount of 2 to 20% by number and a toner having a particle size of 10.8 μm or more is contained in an amount of 6% by number or less, for the purpose of obtaining an image having a high image density as well as excellent highlight reproducibility and minute line reproducibility.

A small-sized toner discussed in the references listed above has a weight average particle size of the toner particles ranging from 3 to 7 μm, but does not contain toner particles having a size of 5 μm or less in sufficiently large amounts. This allows only a limited improvement in the image quality to be achieved with such a toner. Thus, if such toners are used, there are limits to the improvement in the image quality regarding minute line reproducibility and gradation. Moreover, no discussion is made with regard to the relationship between the amount of the toner having a particle size of 1 μm or less and the characteristics of the toner.

Japanese Patent Application Laid-Open No. 8-227171 proposes a method for imparting excellent transferability and cleanability and for ameliorating the deterioration of toner characteristics due to deterioration of an additive, by means of adding to a toner having a certain form coefficient and a weight average particle size of 1 to 9 μm, a 10 to 90 nm sized inorganic powder and a 30 to 120 nm sized silicon compound microparticle imparted with hydrophobicity.

However, since this toner is combined with an additive having a broad particle size distribution and is not discussed with regard to the rate of the coating onto the toner particle, it cannot be imparted with appropriate particle flowability, particle adhesion ability and electric charging ability when formulated into a toner having a volume average particle size of 5 μm or less, and thus cannot achieve an improved image quality attributable to a small-sized toner. In fact, the weight average particle size of the toner particle described in the examples of this reference is at least 6 μm.

It has also been known to produce toners comprised of polymeric particles impregnated with a dye produced by dispersion polymerization. In this method, the polymeric particle size is perfectly controlled so that all of the particles are of the same size, i.e., there is no particle size distribution. However, this method is used with dyes as colorants and not pigments.

Reduction in the toner size may also lead to difficulty in preserving the electric charge quantity of the toner required for development and in some cases may result in a counter-polarly charged toner. An insufficiently charged toner or a counter-polarly charged toner may cause a blank area in the image or may allow fogging in a non-image region to occur easily. When the electric charge quantity is excessive, the electrostatic adhesion ability becomes too high, resulting in a reduced density or an uneven image structure. Thus, since a smaller-sized toner allows the charging state of an individual toner particle to have a higher effect on the resulting image, it is very important to ensure an appropriate frequency distribution of the electric charge quantity. However, the toners proposed in the references listed above do not discuss the frequency distribution of the electric charge quantity, and practically tend to result in a toner having an insufficient charge, a counter-polarly charged toner and an excessively charged toner, and also still involve the problems of image deterioration such as fogging in a non-image region, a reduced density and an uneven image.

On the other hand, a wet electrophotographic method has been used to avoid the poor qualitative impression of an image by a dry electrophotographic method as described above. The wet electrophotographic method is a procedure in which an image is obtained by developing the image with a liquid developer formed by dispersing a microparticulate toner having an average size of 1 to 2 μm in a carrier fluid such as a petroleum-based solvent having a high boiling point. The method is useful to improve the minute line reproducibility, to reduce the disturbance of the image on a transfer material and to reduce the thickness of an image, thus providing a higher image quality.

Nevertheless, the wet electrophotographic method also involves disadvantages such as reduction in the image quality due to the smeared image, i.e., a toner image on the photoconductor can be distorted by the carrier fluid upon formation of the image forming on the photoconductor. In addition, the method requires a large-sized device which is not suitable for an ordinary office or domestic use, since it must be fitted with a solvent recovery system to avoid the release of the solvents such as the petroleum-based organic solvent having a high boiling point to escape from the instrument. It is undesirable also in view of environmental pollution.

Accordingly, a toner for developing an electrostatic latent image which is applicable to a dry electrophotographic method and which is excellent in terms of minute line reproducibility and stability against environment is sought.

While the problems associated with a conventional small-sized toner are discussed above in connection with the formation of a full color image, a smaller-sized toner is desirable also in the case where an image is obtained in a monochrome system, especially when using only a black toner, since the improved minute line reproducibility and the improved gradation are required similarly and the smaller size of the toner is attributable to improve the image quality also in view of the image thickness.

Also, as a factor for determining the image quality of an image obtained, the surface state of a transfer material appears to be extremely important.

When an ordinary non-coat paper, a high quality paper or copy paper for monochrome printing, etc., is used as a transfer material, there may be a problem that the surface smoothness is insufficient. Moreover, the coloring ability may be decreased as adversely affected by fibers of the adjacent paper when toner particles locate in concave parts of the surface of the paper. Also, the color mixing ability may be deteriorated in the case of secondary colors or tertiary colors. As to the minute line reproducibility, scattering of the thickness may more readily occur and may not be sufficient. In addition, when the toner is not located in the concave parts but instead covers the concave parts but leaves a space in the concave parts, there is an inadequate foundation and thus the toner is not fixed during fixing, and the problem of offset to the fixing roll may occur. In particular, when a small-sized toner is used, the above problems caused by the roughness of the surface state may more easily occur.

When a material having a high surface smoothness such as coat paper is used as a transfer material, since uniform heat and pressure are provided to the toner at fixing, a uniform image having a high glossiness can be obtained. However, if a toner weight per unit area of the toner image on a transfer material is too high, a problem such as spread out of an image at fixing, and a problem such that a glaring image having an excessively high glossiness is obtained and the visual uniformity is decreased, may occur.

In addition, when a material having a paper uniformity and minute unevenness such as mat coat paper, etc. is used as a transfer material, since a toner is fixed to follow the minute unevenness on the surface, the increase of glossiness may be restrained and a uniform image having a low glossiness may be obtained. However, if the toner weight of toner image on a transfer material is too high, the toner existing on the convex is largely molten and glossiness may be increased so that the difference with the glossiness of the transfer material may be increased and the uniformity of image glossiness may be decreased.

As described, there is a problem such that a satisfactory image may not be obtained when a smoothness of the surface of a transfer material is not sufficient. Also, if a toner weight of the toner image on a transfer material is too high, an image having a high uniformity may not be obtained even when the smoothness is high to some extent or sufficiently high.

As a proposal to obtain a high image quality of an image in relation to the surface state of a transfer material and a toner, there is an image forming method by electrostatic copying described in Japanese Patent Application Laid-Open No. 63-123056. In this reference, an image forming method is described in which a toner image developed from an electrostatic latent image using a toner particle which has average radius (ravg) of about 5 μm or less, 90% of the entire of which is in the range from about (0.8× ravg) μm to about (1.2× ravg) μm and 99% of the entire of which is in the range from about (0.5× X ravg) μm to about (2× ravg) μm, is transferred electrostatically to the surface of a receiver layer, the surface of which has a peak highness of about (0.3× ravg) gm or less. Although it is described that the toner particle may have a size within the range of 1 to 10 μm, it is not indicated whether or not this is on a number average basis or volume average basis. Moreover, in an example in the reference, a dye is used as the colorant instead of a pigment.

With the method, it is described that a low graininess and a high resolution can be attained by corresponding the surface of a transfer material and a profile of the particle size distribution of a toner particle in order to make the adhesive force between the latent image support and toner particles and the adhesive force between the transfer material and toner particles the same, and then applying an electrostatic force in this state to fix.

However, this prior art method cannot be applied to a full-color image formation process requiring a plurality of transfers of toners having different color phases to a transfer material. In addition, in relation with the toner particles to be transferred, the image obtained is largely affected by the surface state of the transfer material, and thus the transfer material to be selected is extremely limited.

Japanese Patent Applications Laid-Open Nos. 5-6033 and Nos. 5-127437 propose a process in which contrarotate developing is made on a non-image region, a transparent toner layer is subsequently formed thereon, a uniform toner layer is formed over the entire of an image region and a non-image region, and the whole of the transfer material surface is smoothed to produce a high gloss image.

However, with the method, the transparent toner amount on the non-image region is 1 to 8 mg/cm$^2$, compared with the color toner amount on the image region of 0.5 to 5 mg/cm$^2$. Also, the whole of the transfer material surface is covered by the thick toner layer and thus the transfer material is largely curled. In addition, when the large amount of toner layer is formed on the entire of the non-image region, there is a problem that the consumption amounts of both the color toner and the transparent toner are increased largely, and the cost is thus increased. Further, in these image forming methods, no discussion on the particle size and particle size distribution of toner is made, and thus with the method, the minute line reproducibility and gradation cannot be improved and the image quality obtained is not satisfactory.

SUMMARY OF THE INVENTION

An objective of the present invention is to provide a toner for developing an electrostatic latent image, which allows excellent minute line reproducibility and excellent gradation and is capable of forming an image without fogging and which has a high transfer efficiency and an excellent durability, a developer incorporating such toner for developing an electrostatic latent image, as well as a method for forming an image employing the same. More particularly, it is an objective to provide a toner for developing an electrostatic latent image, a developer for an electrostatic latent image and a method for forming an image, especially for developing a digital electrostatic latent image.

A further objective of the present invention is to provide a toner for developing an electrostatic latent image, a developer for an electrostatic latent image and a method for forming an image, which is capable of providing an image of a quality which is equal to or higher than an image obtained by offset printing.

A still further objective of the present invention is to provide a toner for developing an electrostatic latent image whose charging characteristics are not subjected to the effects of temperature and humidity, which is readily charged (i.e., which is "stable satisfactorily to environment", on the contrary to "dependent on environment" referred to in case of dependency on the environmental factors) and which maintains a sharp charge distribution even when the toner is newly added into the developing unit.

A still further objective of the present invention is to provide a method for forming an image, which allows an excellent minute line reproducibility and excellent gradation, which is capable of providing a uniform image glossiness corresponding to the surface glossiness of a transfer material itself, and which is capable of providing an image quality which is equal to or higher than an image obtained by an offset printing, with a small-sized toner for developing an electrostatic latent image which is capable of forming an image without fogging and which has a high transfer efficiency and an excellent durability.

A further objective of the present invention is to provide a method for forming an image, which allows an excellent minute line reproducibility and gradation, and which is capable of providing an image quality which is equal to or higher than an image obtained by an offset printing, even if a transfer material having a rough surface condition is used.

We have made much effort to study the particle size of coloring particles (the part of a toner exclusive of additives, i.e., the constituent referred to generally as a toner particle) required to achieve the objectives described above. As a result, we have now discovered that a volume average particle size of the coloring particle of 5.0 μm or less is essential for achieving improvement both in the minute line reproducibility and in the gradation of the image.

We also have now discovered that, when using this small-sized coloring particle, the disadvantages associated with the prior art mentioned above can be avoided as a result of the reduction of the size of the coloring particle. In this regard, the aspects of the present invention described below are useful, independently or in combination.

A first aspect of the present invention is thus a coloring particle for use in developing an electrostatic latent image, wherein the coloring particle has a volume average particle size of 1.0 to 5.0 μm. Such coloring particle is very effective for achieving improvement in minute line reproducibility, gradation and graininess on highlighted pieces of the obtained image. The coloring particle of the invention is a mixture of coloring particles having different particle sizes. The coloring particles of the invention comprise particles having a particle size of 1 μm or less that are present in an amount of 20% by number or less, and particles having a particle size of more than 5 μm that are present in an amount of 10% by number or less. These particles are mixed with other toner components to achieve a coloring particle (mixture) having a volume average particle size of 1.0 to 5.0 μm.

By reducing the volume average particle size of the coloring particle to 5.0 μm or less, the minute line reproducibility, gradation, and graininess on highlight areas will be satisfactory, and deterioration of the minute line reproducibility, gradation, and graininess on highlight area will be reduced or eliminated. Further, increasing the concentration of pigment in the coloring particle can decrease the toner weight per unit area of an image formed on a transfer material. Further, since the thickness of the toner image formed on a transfer material can be reduced, an image which is visually appealing and has an equal or higher image quality as that of an image obtained by offset printing can be achieved.

However, it has also been found that only regulating the volume average particle size of the coloring particle is insufficient to achieve a high quality image. For example, the presence of coloring particles having too small of a particle size in a predetermined amount may lead to poor cleanability. On the contrary, the presence of coloring particles having too large of a particle size in a predetermined amount may lead to poor minute line reproducibility. In the present invention, in order to solve the problems of image quality such as fogging and minute line reproducibility, and the problem of poor cleanability, the lower limit of the volume average particle size is about 1.0 μm, coloring particles having a particle size of about 1.0 μm or less are reduced to about 20% by number or less, and coloring particles having a particle size exceeding about 5.0 μm are reduced to about 10% by number or less.

Therefore, with the present invention, an image which has extremely satisfactory minute line reproducibility and gradation and is visually appealing and has an equal or higher image quality to an image obtained by offset printing, and also has satisfactory cleanability, can be obtained.

Furthermore, when an image is formed using the toner for developing an electrostatic latent image of the present invention, the toner weight per unit area of an image formed on a transfer material can be decreased in order to obtain an image having a qualitative impression equal to one obtained by offset printing. In order to achieve a sufficient image density and to keep a good water resistance, light resistance, or solvent resistance of an image even if the toner weight per unit area of an image is decreased, a pigment particle having a high coloring ability and an excellent water resistance, light resistance, or solvent resistance is used as the colorant contained in the coloring particle. A further aspect of the present invention is a toner for developing an electrostatic latent image comprising at least coloring particles containing a colorant and a binder resin, wherein (a) the volume average particle size of the coloring particles is 1.0 to 5.0 μm, preferably wherein coloring particles having a particle size of 1.0 μm or less are present in an amount of 20% by number or less of the entire coloring particles and coloring particles having a particle size exceeding 5.0 μm are present in an amount of 10% by number or less, and (b) the electric charge quantity of said toner for developing electrostatic latent image, q (fC), and the volume average particle size of the toner for developing electrostatic latent image, d (μm), are in such a relationship at the temperature of 20° C., and the humidity of 50% that the peak value and the bottom value qid in its frequency distribution are 1.0 or less and 0.005 or more, respectively.

In this further aspect, the disadvantages associated with reduction in the size of the coloring particle as described above can be overcome by controlling the state in which individual coloring particles are charged electrostatically. Thus, a toner for developing an electrostatic latent image according to this aspect of the present invention provides an image exhibiting satisfactory minute line reproducibility and gradation while avoiding the disadvantages associated with the prior art mentioned above as a result of the reduction of the size of the coloring particle, such as fogging in a non-image region, reduction in transfer efficiency and retarded charging.

A still further aspect of the present invention is a toner for developing an electrostatic latent image comprising at least coloring particles containing a colorant and a binder resin, and an external additive, wherein (a) the volume average particle size of the coloring particles is 1.0 to 5.0 μm, wherein coloring particles having a particle size of 1.0 μm or less are present in an amount of 20% by number or less of the entire coloring particles, and coloring particles having a particle size exceeding 5.0 μm are present in an amount of 10% by number or less, (b) the external additive comprises at least one type of ultra microparticles having an average primary particle size of 30 nm to 200 nm and at least one type of super-ultra microparticles having an average primary particle size of 5 nm or more and less than 30 nm, and (c) the coating rates, Fa and Fb, of the external additive based on the surface of the coloring particle obtained according to Formula (I) for the ultra microparticles and the super-ultra microparticles, respectively, are both 20% or more, and the total of the coating rate of the entire additive is 100% or less, $$F=\sqrt{3}\cdot D\cdot\rho_{\tau}\cdot(2\pi\cdot z\cdot\rho_{\sigma})^{-1}\cdot C\times 100 \quad (1)$$

wherein F denotes a coating rate (%), D denotes the volume average particle size of the coloring particles (μm), $\rho_{96}$ denotes the true specific gravity of the coloring particles, z denotes the average primary particle size of an additive, $\rho_{\sigma}$ denotes the true specific gravity of an additive, and C denotes the ratio (x/y) of the weight of the additive, x (g), to the weight of the coloring particles, y (g).

The disadvantages associated with the prior art mentioned above as a result of the reduction of the size of the coloring particle can be prevented by this further aspect of the present invention, i.e., by controlling the particle size distribution of the coloring particles appropriately and additionally by coating the coloring particles with a certain amount of large and small microparticles which are the constituents of the external additive. By this procedure, an image exhibiting satisfactory minute line reproducibility and gradation can be obtained while maintaining the satisfactory powder characteristics such as powder flowability and adhesion ability and avoiding reduction in the transfer efficiency and in the charging ability and also while suppressing the dependency on environment.

While the objectives of the present invention described above can be achieved by using a toner having any of the foregoing aspects of the present invention, a toner for developing an electrostatic latent image which has all of the aspects of the present invention is more preferable for the purpose of achieving a further higher quality of the image and a further higher stability to the environment.

The method for forming an image comprises at least a latent image forming step in which an electrostatic latent image is formed on a latent image support, a toner layer forming step in which a toner layer is formed on the surface of a developer support which faces the electrostatic latent image support, a developing step in which the electrostatic latent image on the electrostatic latent image support is developed with said toner layer, and a transfer step in which a toner image developed is transferred onto a transfer material. A very high quality of an image formed on a transfer material and a high stability to atmosphere throughout the entire image forming process can be achieved with such process by employing a toner for developing an electrostatic latent image according to the present invention in the process.

Especially in a method for forming a full color image by overlaying sequentially in any order the toner images of at least three colors including cyan, magenta and yellow onto the transfer material, or of four colors further including black, improved minute line reproducibility, reduced distortion of the image on the transfer material and reduced image thickness are achieved by employing as each of the three or four color toners a toner for developing an electrostatic latent image according to the present invention, thereby forming an image of a very high quality.

In a still further aspect of the present invention, the method comprises forming a toner layer comprised of toner on a surface of a developer support that is arranged opposed to a latent image support, developing an electrostatic latent image on the latent image support with the toner layer to obtain a toner image, and transferring the toner image formed to a transfer material, wherein the ten-point average surface roughness Rz of at least an image forming region of the transfer material is 10 μm or less and wherein the toner is as described above. To insure the proper surface roughness, the method may include a step of smoothing at least an image-receiving region of a surface of a transfer material before transferring the toner image to the surface of the transfer material. Such smoothing may comprise forming a layer comprising a non-color transparent toner on at least the image-receiving region of the transfer material or forming a layer comprising a white toner on at least the image-receiving region of the transfer material.

DETAILED DESCRIPTION OF PREFERRED EMBODIMENTS

Figure 1:
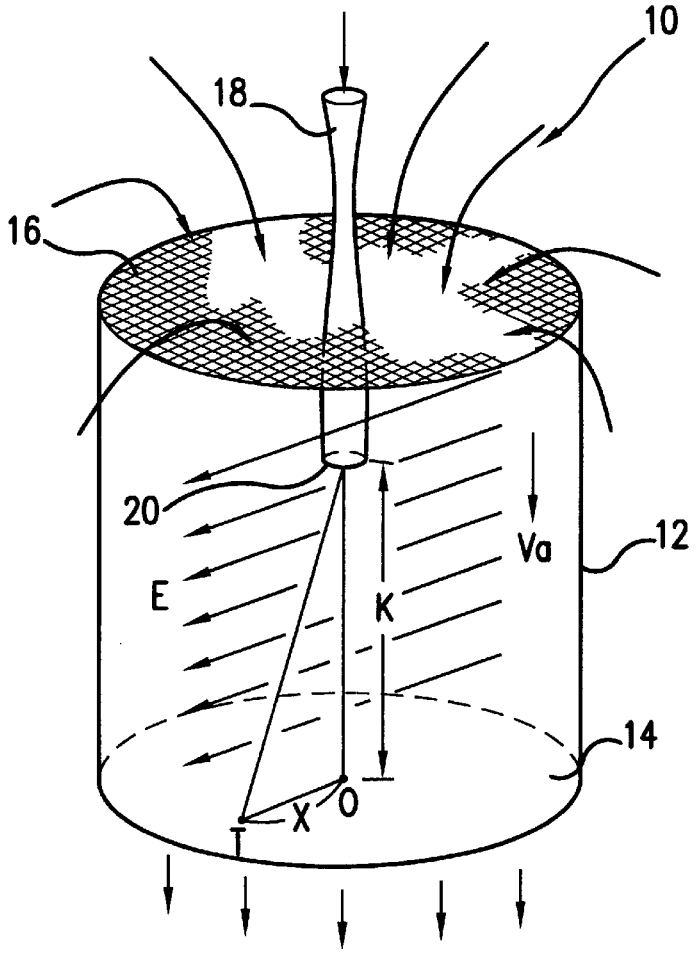
FIG. 1 shows a schematic perspective view of a device for determining the frequency distribution of the q/d value by the CSG method.

The present invention is further detailed below by describing the various aspects of the present invention.

A first aspect of the present invention comprises a toner for developing an electrostatic latent image comprising at least coloring particles containing a colorant and binder resin, wherein the coloring particles are a mixture of coloring particles having different average particle sizes, and wherein the volume average particle size of the coloring particles are about 1.0 to about 5.0 μm. The coloring particles comprise particles having a particle size of 1.0 μm or less that are present in an amount of 20% by number or less based on the total number of coloring particles, and particles having a particle size exceeding 5.0 μm that are present in an amount of 10% by number or less. The colorant is most preferably a pigment.

Volume average particle size of coloring particles

As described above, it is essential for the improvement in minute line reproducibility and in gradation that the volume average particle size of the coloring particles is 5.0 μm or less. A size exceeding 5.0 μm results in a larger proportion of coarse large particles, which may lead to reduced minute line reproducibility and reduced gradation.

"Minute line reproducibility" referred to herein is intended to mean the ability to reproduce accurately lines formed at an interval of usually 30 to 60 μm, preferably 30 to 40 μm. The evaluation of the minute line reproducibility also considers the ability to reproduce a dot having a diameter within the above size range, i.e., a dot having the same width as the minute line. The evaluation is further described below in the examples.

It is also essential that the lower limit of the volume average particle size of the coloring particles is 1.0 μm or more. A size less than 1.0 μm results in deterioration of the flowability of the powder as a toner, developability or transfer ability, which may lead to various problems associated with poor powder characteristics, such as reduced cleanability of the toner remaining on the surface of a photoconductor.

Based on the discussion made above, the volume average particle size of the coloring particles is preferable within the range from 1.0 to 4.5 μm, more preferably 1.0 to 4.0 μm or 2.0 to 3.5 μm, most preferably 3.0 to 3.5 μm.

The particle size of the coloring particles is further specified in this aspect of the present invention. Typically, it is essential that coloring particles having a particle size of 1.0 μm or less are present in an amount of 20% by number or less of the entire coloring particles, and coloring particles having a particle size exceeding 5.0 μm are present in an amount of 10% by number or less.

When reducing the size of the coloring particle, if small-sized coloring particles, for example having a size of 1.0 μm or less, are present in a predetermined amount or more, for example, more than 20% by number, fogging may occur on a non-image area, and cleanability may be deteriorated. On the other hand, if a large-sized coloring particle, for example having a size of 5.0 μm or more, is present in a predetermined amount or more, for example more than 10% by number, the minute line reproducibility may be rendered insufficient. These disadvantages are prevented by controlling the particle size distribution of the coloring particle appropriately with respect to the above-described toner.

When coloring particles having a particle size of 1.0 μm or less are present in an amount exceeding 20% by number of the entire coloring particle, fogging in a non-image region and poor cleaning may occur since the non-electrostatic adhesive force of the coloring particles is increased.

More preferably, coloring particles having a particle size of 1.0 μm or less are present in an amount of 10% by number or less of the entire coloring particle. When the number of coloring particles having a particle size of 1.0 μm or less of the entire coloring particle is in the above range, fogging is reduced.

Furthermore, when coloring particles having a particle size exceeding 5.0 μm are present in an amount exceeding 10% by number, improvement in minute line reproducibility as an object of the present invention may not be achieved.

More preferably, coloring particles having a particle size exceeding 5.0 μm are present in an amount of 5% by number or less.

While the percentage by number of coloring particles having the size exceeding 5.0 μm is employed as a parameter for specifying the larger limit of the particle size distribution of the coloring particle in the present invention, the particle size employed as a basis can also be specified by other values. For example, when the basis of the particle size is 4.0 μm, it is preferable that coloring particles having a particle size of 4.0 μm or less are present in an amount of 75% by number or more. In view of the volume average particle size and the particle size distribution of a coloring particle according to the present invention, when coloring particles having a particle size of 4.0 μm or less are present in an amount of 75% by number or more, then coloring particles having a particle size exceeding 5.0 μm is generally present in an amount of 10% by number or less.

It is also preferable that coloring particles having particle sizes of 1.0 μm to 2.5 μm are present in an amount of 5% to 50% by number, more preferably 10% to 45% by number. When coloring particles having a particle size of 1.0 μm to 2.5 μm are present in an amount exceeding 50% by number, small size particles remain in the developer and fogging may occur.

On the other hand, when coloring particles having a particle size of 1.0 μm to 2.5 μm are present in an amount less than 5% by number, minute dot reproducibility may deteriorate.

For obtaining a coloring particle having the particle size distribution described above, the conditions of pulverizing and classification (in the case of pulverization) and the conditions of polymerization (in the case of polymerization) may be any appropriate conditions. To achieve the particle distribution of the invention, pulverization is preferable. Pulverization allows the production of very small particles that are easy to classify, and simple and inexpensive to produce. Such pulverization method involves premixing of a binder resin and a colorant as well as other additives if necessary, followed by melting in a kneader, followed by cooling, grinding and classification to adjust to the particle distribution. Suitable methods are also illustrated in the Examples below.

While the particle size distribution of coloring particles may be determined by various methods, a Coulter counter model TA II (manufactured by Coulter Co., Ltd.) with the aperture size of 50 μm, except for 30 μm which is employed only when determining the number distribution of toner particles of 1 μm or less, is employed in the present invention. The device outputs the particle size and size distribution directly.

Typically, 2 to 3 drops of a dispersing agent (surfactant: Triton X 100) and a sample are placed in an aqueous solution of sodium chloride (10 g/liter) and dispersed ultrasonically for 1 minute and then subjected to the determination using the device described above.

A further aspect of the present invention is a toner for developing an electrostatic latent image comprising coloring particles containing a colorant and a binder resin (hereinafter sometimes simply referred to as "toner"), wherein (a) the volume average particle size of the coloring particles is 1.0 to 5.0 μm, and (b) the electric charge quantity of said toner for developing an electrostatic latent image, q (fC), and the volume average particle size of the toner/coloring particles for developing an electrostatic latent image, d (μm), are in such a relationship at the temperature of 20° C. and the humidity of 50% that the peak value and the bottom value of q/d in its frequency distribution are 1.0 or less and 0.005 or more, respectively.

In this aspect of the present invention, the volume average particle size of the coloring particles is the same as discussed above with respect to the first aspect of the invention. Also, while the particle size distribution in this further aspect of the invention is preferably the same as that discussed above in the first aspect, it is not essential to this aspect. In other words, in this further aspect of the invention, it is sufficient that the volume average particle size of the coloring particles be 1.0 to 5.0 μm, regardless of the particle size distribution.

Relationship between electric charge quantity, q, and particle size d (q/d value)

Controlling the state of the charging of individual coloring particles appropriately can prevent the disadvantages associated with the prior art mentioned above as a result of the reduction of the size of the coloring particle. Thus, the image obtained depends greatly on the state of the charging of an individual toner particle rather than on the quantity of the entire electric charge quantity. On the other hand, the image quality depends also on the size of an individual toner particle, and thus the relationship with the image quality cannot sufficiently be explained based only on the specified frequency distribution of the electric charge quantity of an individual toner particle. Accordingly, in this aspect of the present invention, the relationship between the electric charge quantity and the volume average particle size of an individual toner particle is specified appropriately.

Thus, in this aspect of the present invention, the electric charge quantity of said toner for developing electrostatic latent image, q (fC), and the volume average particle size of the coloring particles for developing electrostatic latent image, d (μm), are in such a relationship at the temperature of 20° C. and the humidity of 50% that the peak value and the bottom value of q/d in its frequency distribution are 1.0 or less and 0.005 or more, respectively. The disadvantages due to the reduction in the size of the coloring particle as described above, e.g., fogging in a non-image region, reduction in transfer efficiency and retarded charging, can be overcome by controlling the charging condition of the individual coloring particles suitably in such a way.

While the q/d value of a positively charged toner can directly be applied to the specified value of this aspect of the present invention, that of a negatively charged toner can be applied to the specified value of this aspect of the present invention after positive-negative inversion of the value of the electric charge quantity of a toner for developing an electrostatic latent image, q (fC).

In this aspect of the present invention, the peak value of q/d in its frequency distribution is preferably 0.8 or less, and the bottom value is preferably 0.01 or more.

The reason why the temperature 20° C. and the humidity 50% are specified as the condition under which the electric charge quantity is determined is that the electric charge quantity is specified most appropriately at room temperature which is regarded as a normal environment for the purpose of achieving various performances as the objectives of the present invention. Thus, a toner for developing an electrostatic latent image according to the present invention which fulfills the requirements described above in the normal environment does not undergo a substantial deviation from the appropriate electric charge distribution for obtaining an intended high image quality even when the environmental condition becomes somewhat different, thus exhibiting an extremely stable and high performance. It is a matter of course that a toner for developing an electrostatic latent image which maintains the electric charge distribution described above even at a higher temperature and a higher humidity or at a low temperature and a low humidity is preferable.

When the q/d value of an individual toner for developing an electrostatic latent image is determined and then its frequency distribution is represented as a graph, an approximately normal distribution having an upper limit and a lower limit can be obtained. In this aspect of the present invention, the q/d value at the maximum point of this graph is designated as the peak value, while the q/d value at the lower limit (in the case of a negatively charged toner, the lower limit after positive-negative inversion) is designated as the bottom value.

In this aspect of the present invention, it is essential for the peak value of the q/d in the frequency distribution to be 1.0 or less, preferably 0.80 or less, more preferably 0.70. A peak value exceeding 1.0 results in an increased adhesive force of the toner onto the surface of a carrier or a photoconductor even at a narrow frequency distribution, and thus causes deterioration of developability and transferability, reduced image density, as well as significantly reduced cleanability of the toner remaining on the photoconductor. A peak value exceeding 1.0 at a broad electric charge distribution results in the problems described above in combination with uneven development and transfer performances due to the increased deviation in the charge of the toner.

When the q/d value is too close to zero or is a positive-negative inverted value (i.e., a counter-polarly charged toner), a blank area in the image region or a fogging in a non-image region may occur. Accordingly, the bottom value in the frequency distribution of the q/d value should be maintained at a certain value or higher, and thus should typically be 0.005 or higher, preferably 0.01 or higher, more preferably 0.02 or higher, particularly 0.025 or higher.

In this aspect of the present invention, the upper limit of the q/d value in the frequency distribution (the upper limit as the absolute value in the case of a negatively charged toner) is not particularly specified. The frequency distribution of the q/d value is an approximately normal distribution as described above, and the upper limit becomes apparent spontaneously when specifying the peak value and the bottom value.

The frequency distribution of the q/d value can be determined by the Charge Spectrograph method (hereinafter referred to as CSG method) shown, for example, in Japanese Patent Application Laid-Open No. 57-79958, incorporated herein by reference. The method for determination is detailed below.

FIG. 1 shows a schematic perspective view of device 10 for determining the frequency distribution of the q/d value by the CSG method. Device 10 consists of cylindrical body 12 with its lower opening closed with filter 14 and its upper opening closed with mesh 16, sample supply cylinder 18 protruding through the middle of mesh 16 into the inside of body 12, a suction pump (not indicated) for sucking air via the lower opening of body 12, and a electric field generating device (not indicated) providing electric field E from the side wall of body 12.

The suction pump is provided to suck air contained in body 12 through the entire surface of filter 14 which is engaged in the lower opening of body 12. At the same time, air is introduced through mesh 16 fitted to the upper opening, whereby a laminar flow of air downward vertically in body 12 at a constant flow rate Va is established. The electric field generating device provides a uniform and constant field E in the direction of a right angle with regard to the air flow.

To the inside of body 12 in the state described above, a toner particle to be determined is dropped (allowed to fall down) via sample supply cylinder 18. The toner particle exiting from sample exit 20 at the terminal of the sample supply cylinder 18 flies when not being subjected to electric field E vertically downward while being influenced by the laminar air flow, and arrives at center O of filter 14 (in this case the distance K between sample exit 20 and filter 14 is the straight flight distance of the toner). Filter 14 is made from a course mesh polymer filter, through which air can readily pass but the toner particle cannot, resulting in the toner left on filter 14. When the toner is electrically charged, it is subjected to the effect of electric field E, and arrives on filter 14 at a point deviated from center O in the direction of electric field E (point T in FIG. 1). By determining the distance x (shift) between point T and point O and obtaining frequency distribution, the frequency distribution of the q/d value can be obtained. In the present invention, the image analysis is employed to obtain the peak value and the bottom value.

Typically, the shift obtained using device 10, x (mm), the electric charge quantity of the toner, q (fC) and the particle size of the toner, d ($\mu$m), are in the relationship represented by formula (3).

$$q/d=(3\pi\eta Va/kE)X_x \tag{3}$$

wherein $\eta$ represents the viscosity of air (kg/m·sec), Va represents air flow rate (m/sec), k represents the straight flight distance of a toner (m), and E represents the electric field (V/m).

In the present invention, device 10 shown in FIG. 1 is adjusted to such a condition that the parameters in formula (3) are as shown below.

Viscosity of air $\eta=1.8\times10^{-5}$ (kg/m·sec)

Air flow rate Va=1 (m/sec)

Straight flight distance of toner k=10 (cm)

Electric field E=190 V/cm

When the values indicated above are applied to formula (3), the following value is obtained.

$$q(fC)/d(\mu m)\approx0.09\cdot x$$

Before the particle of a toner for developing an electrostatic latent image to be subjected to the determination is allowed to fall down through sample supply cylinder 18, it should be charged electrically. The q/d value of a toner for developing an electrostatic latent image should be in the frequency distribution described above when the electrostatic latent image is developed actually, and thus for the purpose of the present invention the toner for developing an electrostatic latent image to be subjected to determination is first mixed with a carrier to form a two-component developer, which is then treated in the condition analogous to that of the device, for example, by agitation prior to being subjected to the determination of the frequency distribution of the q/d value.

Accordingly in the present invention, the charging condition of a toner particle for developing an electrostatic latent image to be subjected to the determination is specified as described below. It is more preferable as a matter of course that the toner for developing an electrostatic latent image which is sampled directly from the device upon developing the electrostatic latent image fulfills the requirement with regard to the frequency distribution of the q/d described above.

In the present invention, a practically employed developer for an electrostatic latent image which comprises a toner for developing an electrostatic latent image and a carrier is placed in a glass container and stirred for 2 minutes using a turbuler shaker to effect the charging, and then evaluating for the frequency distribution of the q/d.

As described above, the frequency distribution of the q/d value can be obtained. While the frequency distribution of the q/d value may be determined in the present invention by any other method instead of the CSG method described above, less error is associated with the CSG method.

For producing a toner for developing an electrostatic latent image according to this aspect of the present invention, an external additive may be admixed with the coloring particle for the purpose of controlling the charging. The q/d value may thus be suitably adjusted to be within the required parameters through addition of an external additive.

An inorganic fine powder material employed as such external additive may be, for example, metal oxides such as titanium oxide, tin oxide, zirconium oxide, tungsten oxide, iron oxide and the like, nitrides such as titanium nitride and the like, as well as silicon oxide and titanium compounds. The amount of an external additive to be added is preferably 0.05 to 10 parts by weight, more preferably 0.1 to 8 parts by weight, based on 100 parts by weight of a coloring particle.

For adding an inorganic fine powder mentioned above to a toner, a known method may be employed such as placing the inorganic fine powder and a coloring particle in a Henschel mixer and mixing them.

A preferred method of producing a toner for developing an electrostatic latent image according to this aspect of the present invention constitutes a still further aspect of the present invention. This further aspect of the present invention allows the frequency distribution of the q/d value to be controlled appropriately.

This further aspect of the present invention is a toner for developing an electrostatic latent image comprising a coloring particle containing a colorant and a binder resin, and an external additive, wherein (a) the volume average particle size of the coloring particles is 1.0 to 5.0 μm, wherein coloring particles having a particle size of 1.0 μm or less are present in an amount of 20% by number or less of the entire coloring particle, and coloring particles having a particle size exceeding 5.0 μm are present in an amount of 10% by number or less, (b) the external additive comprises at least one type of ultra microparticles having an average primary particle size of 30 nm to 200 nm and at least one type of super-ultra microparticles having an average primary particle size of 5 nm or more and less than 30 nm, and (c) the coating rates, Fa and Fb, of the external additive based on the surface of the coloring particle obtained according to Formula (1) for the ultra microparticles and the super-ultra microparticles, respectively, are both 20% or more, and the total of the coating rate of the entire additive is 100% or less, $$F=\sqrt{3}\cdot D\cdot\rho_{\tau}\cdot(2\pi\cdot z\cdot\rho_{\sigma})^{-1}\cdot C\times 100 \quad (1)$$

wherein F denotes a coating rate (%), D denotes the volume average particle size of the coloring particles (μm), $\rho_{\tau}$ denotes the true specific gravity of the coloring particles, z denotes the average primary particle size of an additive, $\rho_{\sigma}$ denotes the true specific gravity of an additive, and C denotes the ratio (x/y) of the weight of the additive, x (g), to the weight of the coloring particles, y (g).

By "type of" ultra microparticles is meant that the ultra microparticles may be of the same or different composition. Suitable example types of ultra microparticles are set forth below. Similarly, by "type of" super-ultra microparticles is meant that the super-ultra microparticles may be of the same or different composition. Suitable example types of super-ultra microparticles are set forth below.

The external additive also makes the small-sized toner more stable and maintains the high handling ability of the toner.

The volume average particle size and particle size distribution of the coloring particles in this further aspect of the present invention is identical to the first aspect discussed above.

Thus, the volume average particle size of the coloring particles is 1.0 to 5.0 μm, wherein coloring particles having a particle size of 1.0 μm or less are present in an amount of 20% by number or less of the entire coloring particle, and coloring particles having a particle size exceeding 5.0 μm are present in an amount of 10% by number or less. The significance and advantages associated with coloring particles having such a volume average particle size and particle size distribution are identical to those discussed in conjunction with the first aspect above.

Particle size of two external additive particles

In this further aspect of the present invention, at least one type of ultra microparticles having an average primary particle size of 30 nm to 200 nm and at least one type of super-ultra microparticles having an average primary particle size of 5 nm or more and less than 30 nm are employed as an external additive.

The ultra microparticles serve to reduce the adhesion between coloring particles or between a coloring particle and a photoconductor or a carrier, and to prevent the reduction in developability, transferability or cleanability. The average primary particle size of an ultra microparticle according to the second aspect of the present invention is 30 nm to 200 nm, preferably 35 nm to 150 nm, and more preferably 35 nm to 100 nm. When exceeding 200 nm, release from a toner may readily occur, resulting in absence of adhesive force-reducing effect. On the other hand, a particle having a size less than 30 nm serves rather as a super-ultra microparticle which is detailed below.

The super-ultra microparticles impart a toner (coloring particle) with an improved flowability and a reduced aggregation degree while serving to improve the environmental stability as a result of the effects such as suppression of heat aggregation. The average primary particle size of a super-ultra microparticle according to the second aspect of the present invention is 5 nm or more and less than 30 nm, preferably 5 nm or more and less than 29 nm, and more preferably 10 nm to 29 nm. A size less than 5 nm may result in embedding in the surface of a coloring particle due to the stress given to a toner. On the other hand, a particle having a size of 30 nm or more serves rather as an ultra microparticle described above.

In the present invention, the term "primary particle" means the primary particle size of a particle as a spherical particle. In other words, a non-spherical particle having a volume is converted via known calculations to a corresponding perfectly spherical particle of the same volume. Then, the size (i.e., diameter) of this perfectly spherical particle is determined. The average primary particle size of the additives are typically determined with the use of a scanning electronic microscope in a manner known in the art. The average primary particle size of the additives are thus reported on a number basis.

The types of ultra microparticles may include, for example, metal oxides such as hydrophobicity-imparted silicon oxide, titanium oxide, tin oxide, zirconium oxide, tungsten oxide, iron oxide, nitrides such as titanium nitride, and microparticles containing titanium compounds, with a microparticle comprising hydrophobicity-imparted silicon oxide being preferred. The hydrophobicity may be imparted by treatment with a hydrophobicity-imparting agent, such as for example, chlorosilane, alkoxysilane, silazane, silylated isocyanate and the like. For example, methyltrichlorosilane, dimethyldichlorosilane, trimethylchlorosilane, methyltrimethoxysilane, dimethyldimethoxysilane, methyltriethoxysilane, dimethyldiethoxysilane, i-butyltrimethoxysilane, decyltrimethoxysilane, hexamethyldisilazane, t-butyldimethylchlorosilane, vinyltrichlorosilane, vinyltrimethoxysilane, vinyltriethoxysilane and the like may be employed.

The types of super-ultra microparticles may include, for example, microparticles comprising metal oxides such as hydrophobic titanium compound, silicon oxide, titanium oxide, tin oxide, zirconium oxide, tungsten oxide, iron oxide and nitrides such as titanium nitride, with a titanium compound microparticle being preferred.

As a titanium compound microparticle, a reaction product between metatitanic acid and a silane compound is preferable since it is highly hydrophobic, less of it tends to form aggregations due to no sintering process being required, and it exhibits satisfactory dispersibility when added as an external additive. As the silane compound, an alkylalkoxysilane compound and/or a fluoroalkylalkoxysilane compound is preferably employed since it satisfactorily controls the charging of a toner, and reduces the adhesion to a carrier and a photoconductor.

The metatitanic acid compound thus preferably is a reaction product between metatitanic acid and an alkylalkoxysilane compound and/or a fluoroalkylalkoxysilane compound. The compound is preferably obtained by peptizing metatitanic acid synthesized by sulfuric acid hydrolysis followed by reacting the peptized metatitanic acid as a base with the alkylalkoxysilane compound and/or the fluoroalkylalkoxysilane compound.

The alkylalkoxysilane compound to be reacted with metatitanic acid includes, for example, methyltrimethoxysilane, ethyltrimethoxysilane, propyltrimethoxysilane, i-butyltrimethoxysilane, n-butyltrimethoxysilane, n-hexyltrimethoxysilane, n-octyltrimethoxysilane, n-decyltrimethoxysilane and the like, and the fluoroalkylalkoxysilane compound includes, for example, trifluoropropyltrimethoxysilane, tridecafluorooctyltrimethoxysilane, heptadecafluorodecyltrimethoxysilane, heptadecafluorodexylmethyldimethoxysilane, (tridecafluoro-1,1,2,2-tetrahydrooctyl)triethoxysilane, (3,3,3-trifluoropropyl)trimethoxysilane, (heptadecafluoro-1,1,2,2-tetrahydrodecyl)triethoxysilane, 3-(heptafluoroisopropoxy)propyltriethoxysilane and the like.

Coating rate of two external additive components on coloring particle surface

As described above, by using at least two external additive components, i.e., ultra microparticles and super-ultra microparticles, a toner for developing an electrostatic latent image according to this further aspect of the present invention should be imparted with the combined effects as a result of combination of the both components.

Nevertheless, when an excessive amount in total of an external additive is added, a part of the external additive is present as liberated from (i.e., as not adhering to) a coloring particle and the surface of a photoconductor or a carrier becomes stained readily with the external additive. On the other hand, ultra microparticles and super-ultra microparticles should be present both in at least certain amounts for obtaining the effects as a result of the combination of both. An excessive amount of ultra microparticles results in the absence of powder flowability-improving effect, while an excessive amount of super-ultra microparticles results in a poor powder flowability as well as the absence of powder flowability-improving effect. Accordingly, the amount of an external additive to be added should be appropriately controlled.

However, the effects and the variation in various powder characteristics as a result of addition of an external additive is not dependent on the absolute amount of the external additive added, but is instead dependent on the coating rate on the surface of a coloring particle. The coating rate of an external additive on the surface of a coloring particle is discussed below.

Figure 2:
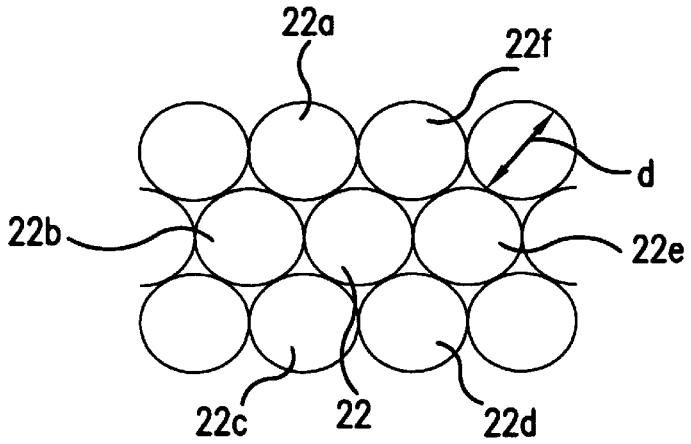
FIG. 2 shows a magnified planar view of a part of the surface of a coloring particle.

If an external additive component is regarded as a true sphere (diameter: z) and a non-aggregated primary particle adheres as a monolayer to the surface of a coloring particle, then the most dense packing of the external additive adhering to the surface of the coloring particle (in the state in which the particle is aligned as closely packed) is represented as a hexagonal close-packed structure in which six external additive units 22*a* to 22*f* are all adjacent to one external additive unit 22 as shown in FIG. 2 (FIG. 2 shows a planar view of a magnified part of the surface of the coloring particle).

Assuming that the state shown in FIG. 2 represents an ideal 100% coating, the actual weight of the external additive based on the actual weight of the coloring particle is represented as present, which is designated herein as the coating rate.

Thus, in an actual state, when designating the volume average particle size of the coloring particles as D ($\mu$m), the true specific gravity of the coloring particles as $\rho_\tau$, the average primary particle size of an additive as z ($\mu$m), the true specific gravity of an additive as $\rho_\sigma$, the ratio (x/y) of the weight of the additive, x (g), to the weight of the coloring particles, y (g) as C, then the coating rate F (%) may be represented as:

$$F=C/\{2\pi\cdot z\cdot\rho_\sigma/(\sqrt{3}D\cdot\rho_\tau)\}\times 100$$

which can be converted to:

$$F=\sqrt{3}D\cdot\rho_\tau\cdot(2\pi\cdot z\cdot\rho_\sigma)^{-1}\cdot C\times 100 \quad (1)$$

wherein F denotes a coating rate (%), D denotes the volume average particle size of the coloring particles ($\mu$m), p, denotes the true specific gravity of the coloring particles, z denotes the average primary particle size of an additive, $\rho_\sigma$ denotes the true specific gravity of an additive, and C denotes the ratio (x/y) of the weight of the additive, x ($\mu$), to the weight of the coloring particles, y (g).

In this further aspect of the present invention, the coating rates of both components of the external additive, i.e., ultra microparticles and super-ultra microparticles, on the surface of a coloring particle obtained according to Formula (1) as discussed above, namely, Fa and Fb, should be 20% or more, with the total coating rate of the entire additive being 100% or less.

The expression "the total coating rate of the entire additive" means the sum of all coating rates of all external additive components, each of which is calculated independently.

When the coating rate of ultra microparticles, Fa, is less than 20%, no effects of the addition of the ultra microparticle is obtained. The coating rate of ultra microparticles, Fa, is preferably 20 to 80%, more preferably 30 to 60%.

When the coating rate of super-ultra microparticles, Fb, is less than 20%, no effects of the addition of the super-ultra microparticle is obtained. The coating rate of super-ultra microparticles, Fb, is preferably 20 to 80%, more preferably 30 to 60%.

When the total coating rate of the entire additive exceeds 100%, an increased external additive may be liberated and the surface of a photoconductor or a carrier becomes stained readily with the external additive. The total coating rate of the entire additive is preferably 40 to 100%, more preferably 50 to 90%.

For the purpose of obtaining more appropriate powder characteristics and eliminating the dependency on environment, the coating rate of ultra microparticles, Fa (%), and the coating rate of super-ultra microparticles, Fb (%), are preferably in the relationship represented by Formula (2).

$$0.5 \leqq Fb/Fa \leqq 4.0 \quad (2)$$

The relationship departing from this range is not preferable since it may become difficult to obtain the effect of the addition of the ultra microparticle or the super-ultra microparticle.

For obtaining an optimum effect of the addition of the ultra microparticle or the super-ultra microparticle, it is preferable that Formula (2') shown below be satisfied.

$$0.5 \leqq Fb/Fa \leqq 2.5 \quad (2')$$

For adding an ultra microparticle and a super-ultra microparticle to a toner, a known method may be employed such as placing the ultra microparticle and the super-ultra microparticle and a coloring particle in a Henschel mixer and mixing them.

In this aspect, it is also preferable that 75% by number of the entire coloring particles preferably have a particle size of 4.0 μm or less.

In addition to the common features among the various aspects of the present invention discussed above, following are further additional features of the invention that may be common among all of the various aspects of the present invention.

Coloring particle

A coloring particle according to the present invention (hereinafter "the present invention" is intended to refer to all of the various aspects of the present invention) contains at least a binder resin and a colorant.

The binder resin contained in a coloring particle preferably has a glass transition point which is, for example, 50 to 80° C., more preferably 55 to 75° C. A glass transition point below 50° C. may cause a disadvantageously reduced high temperature storage stability, while that higher than 80° C. may cause a reduced low temperature fixing ability, which is also disadvantageous.

The softening point of a binder resin is preferably, for example, 80 to 150° C., more preferably 90 to 150° C., and most preferably 100 to 140° C. A softening point below 80° C. may cause a disadvantageously reduced high temperature storage stability, while that higher than 150° C. may cause a reduced low temperature fixing ability, which is also disadvantageous.

The number average molecular weight of a binder is preferably, for example 1,000 to 50,000, while the weight average molecular weight of a binder is preferably, for example, 7,000 to 500,000.

A binder resin may be any one of those employed conventionally as a binder resin 30 for a toner, such as, for example, styrenic polymers and (meth)acrylate polymers. A styrene-(meth)acrylate polymer is preferably obtained by polymerizing one or more of the styrene monomers, (meth) acrylate monomers, other acrylic or methacrylic monomers, vinylether monomer, vinylketone monomer, or N-vinyl compound monomers listed below.

Styrenic monomers include, for example, styrene and styrene derivatives such as o-methylstyrene, ethylstyrene, p-methoxystyrene, p-phenylstyrene, 2,4-dimethylstyrene, p-n-octylstyrene, p-n-decylstyrene, p-n-dodecylstyrene, butylstyrene and the like.

(Meth)acrylate monomers include, for example, (meth) acrylates such as methyl (meth)acrylate, ethyl (meth) acrylate, propyl (meth)acrylate, butyl (meth)acrylate, i-butyl (meth)acrylate, n-octyl (meth)acrylate, dodecyl (meth) acrylate, 2-ethylhexyl (meth)acrylate, stearyl (meth) acrylate, phenyl (meth)acrylate, dimethylaminoethyl (meth) acrylate and the like.

Other acrylic or methacrylic monomers include, for example, acrylonitrile, methacrylamide, glycidyl methacrylate, N-methylol acrylamide, N-methylol methacrylamide, 2-hydroxyethyl acrylate and the like.

Vinylether monomers include, for example, vinylethers such as vinylmethylether, vinylethylether, vinyl i-butylether and the like.

Vinylketone monomers include, for example, vinylketones such as vinylmethylketone, vinylhexylketone, methyl i-propenylketone and the like. N-vinyl compound monomers include, for example, N-vinyl compounds such as N-vinylpyrrolidone, N-vinylcarbazol, N-vinylindole and the like. In the present invention, a polyester may preferably be employed as a binder resin in view of fixing ability. Such polyester may be one synthesized by condensation polymerization of a polycarboxylic acid and a polyhydric alcohol.

Polyhydric alcohol monomers are, for example, aliphatic alcohols such as ethylene glycol, propylene glycol, 1,3-butane diol, 1,4-butane diol, 2,3-butane diol, diethylene glycol, 1,5-pentane diol, 1,6-hexane diol and neopentyl glycol, alicyclic alcohols such as cyclohexane dimethanol and hydrogenated bisphenol, bisphenol derivatives such as bisphenol A ethylene oxide adduct and bisphenol A propylene oxide adduct. Polycarboxylic acids are, for example, aromatic carboxylic acids and anhydrides thereof such as phthalic acid, terephthalic acid, phthalic anhydride, and saturated and unsaturated carboxylic acids and anhydrides thereof such as succinic acid, adipic acid, sebacic acid, azelaic acid and dodecenyl succinic acid.

The colorant contained in a coloring particle may be any known pigment or dye. If the amount of a colorant added is excessive, the charging characteristics of the toner is affected adversely. Because of this, a pigment which develops a color intensely even when added at a low level is preferably employed in the present invention. In particular, as the colorant contained in the coloring particles in order to achieve a sufficient image density even if the toner weight per unit area of an image is lowered and to keep water resistance, light resistance or solvent resistance of an image, a pigment particle which has a high coloring ability and is excellent in water resistance, light resistance, or solvent resistance, is preferably used.

Examples of suitable pigments include carbon black, nigrosine, graphite, C.I. Pigment Red 48:1, 48:2, 48:3, 53:1, 57:1. 112, 122, 123, 5, 139, 144, 149, 168, 177, 178, 222, C.I. Pigment Yellow 12, 14, 17, 97, 180, 188, 93, 94, 138, 174, C.I. Pigment Orange 31, C.I. Pigment Orange 43, C.I. Pigment Blue 15:3, 15, 15:2, 60, C.I. Pigment Green 7 and the like, and among these, carbon black, C.I. Pigment Red 48:1, 48:2, 48:3, 53:1, 57:1, 112, 122, 123, C.I. Pigment Yellow 12, 14, 17, 97, 180, 188, C.I. Pigment Blue 15:3 are especially preferred. These pigments may be employed individually or in combination.

A method for employing a pigment microparticle after reducing the average disperse size of the toner colorant in the binder resin to 0.3 μm or less as a circle diameter by means of a melt flushing method for the purpose of improving the coloring ability and the transparency of a color toner has been proposed (Japanese Patent Application No. 4-242752, incorporated herein by reference), and this method is very useful for the toner for developing an electrostatic latent image according to the present invention in which the colorant density in the coloring particle should be high.

The melt flushing method, which is a means to disperse a pigment particle in a binder resin, involves replacement of the water contained in a hydrated pigment cake during a pigment manufacturing process with a molten binder resin, and by this method it is easy to reduce the average disperse size of the pigment microparticle in the binder resin to 0.3 μm or less as a circle diameter, and the use of such small-sized pigment microparticles allows the transparency of the toner to be ensured advantageously, resulting in satisfactory color reproduction.

In a toner for developing an electrostatic latent image according to the present invention, the coloring particles have a volume average particle size of 5.0 μm or less and the coloring ability of a single particle of the coloring particles should be high. Especially in a full color image in which coloring particles are overlaid and developed on a transfer material, an insufficient transparency of the coloring particles may allow the coloring particles in the upper layer to shield the color of the lower layer upon forming a two colored image such as a red and green image or a three colored image as of a process black, but such problem can be solved by reducing the average disperse size of the colorant pigment in the binder resin to 0.3 μm or less as a circle diameter.

As described above, a toner for developing an electric latent image has a small particle size and cannot provide a sufficient image density at a pigment concentration similar to that for a conventional large sized toner. Although a toner for developing an electric latent image may simply be described to have a small particle size, the size varies widely from 1.0 μm to 5.0 μm, and may result in a substantial difference in the weight of the toner per unit area (TMA) of a solid image. Accordingly, it is desirable that the concentration of a pigment required is selected based on TMA.

Assuming that a toner is deposited as a monolayer on a transfer material, TMA is dependent on the volume average particle size, D (μm), and the specific gravity, a, of the coloring particles, and the concentration of pigment in a coloring particle, C(%). These parameters preferably fulfill the relationship represented by Formula (4) shown below.

$$25 \leqq a \cdot D \cdot C \leqq 90 \quad (4)$$

An a·D·C (hereinafter abbreviated as aDC) less than 25 may result in an insufficient coloring ability which leads to difficulty in obtaining a desired image density, and an attempt to obtain the desired image density by increasing the amount of the toner upon development may result in a glossy and thicker image in spite of a small particle size, and also may cause disadvantageous reduction in minute line reproducibility and in transfer ability.

On the other hand, an a·D·C exceeding 90 gives a satisfactory image density but may cause such a disadvantage that a soiled background may readily be formed due to the splash of a small amount of a toner to a non-image region and that the reinforcing effect of a pigment may increase the melt viscosity of a coloring particle which leads to a poor fixing ability.

The coloring ability also varies color by color, and each color is preferably in accordance with the following formulae (4-1) to (4-4).

| | | |
|---|---|---|
| Cyan: | $25 \leqq a \cdot D \cdot C \leqq 90$ | (4–1) |
| Magenta: | $25 \leqq a \cdot D \cdot C \leqq 60$ | (4–2) |
| Yellow: | $30 \leqq a \cdot D \cdot C \leqq 90$ | (4–3) |
| Black: | $25 \leqq a \cdot D \cdot C \leqq 60$ | (4–4) |

Since the pigments even of an identical color may have different coloring abilities due to the difference in chemical structures or other factors, the concentration of a pigment may vary depending on the types of the pigment, preferably within the range specified above.

Any known method such as pulverization or polymerization such as suspension polymerization or emulsion polymerization may produce a coloring particle, although pulverization is preferable in the present invention as already described. Such pulverization method involves premixing of a binder resin and a colorant as well as other additives if necessary, followed by melting in a kneader, followed by cooling, grinding and classification to adjust to a certain particle distribution.

Other additives to toner for developing electrostatic latent image

As far as color reproducibility or transparency is not affected adversely, additives such as charge controlling agents and release agents may be added if desired to a toner for developing an electric latent image according to the present invention. Examples of the charge controlling agents are chromium-based azo dyes, silver-based azo dyes, aluminum azo dyes, metal salicylate complexes, organic boron compounds and the like. Examples of the release agents are polyolefins such as low molecular weight propylenes and low molecular weight polyethylenes, and naturally-occurring waxes such as paraffin wax, candelilla wax, carnauba wax, montan wax as well as the derivatives thereof.

Aggregation degree of toner for developing electric latent image

The aggregation degree of a toner for developing an electrostatic latent image according to the present invention is preferably 30 or less, more preferably 25 or less, particularly 20 or less. The aggregation degree is an index for the aggregating force between toners and a larger value indicates a larger aggregation force between toners.

In the present invention, by specifying the aggregation degree to be 30 or less, reduction in flowability due to the reduced size of a toner and reduction of dispersibility in a carrier can be minimized, and a soiled background and a reduced image density as a result of insufficient toner supply, retarded charging, poor charge distribution and reduced charge as well as the stability during storage can also be improved. An aggregation degree of a toner exceeding 30 may result in a soiled background due to reduced flowability and reduced dispersibility in a carrier and an uneven image due to reduced density as well as a poor stability during storage. According to the aspect of the present invention in which the coating rate of external additive particles is controlled as discussed above, the balance between the particle size and the coating rate of an external additive allows the aggregation degree to be extremely low.

The aggregation degree may be determined using a powder tester (manufactured by HOSOKAWA MICRON). Typically, the following procedure may be employed.

Sieves of 45 μnm mesh size, 38 μm mesh size and 26 μm mesh size are placed in a low and in this order and 2 g of a toner, accurately weighed, is loaded onto the top 45 μm sieve, to which then 1 mm oscillation is given for 90 seconds, after which the toner of each sieve is weighed and each weight is multiplied by 0.5, 0.3 and 0.1 in the order of the heaviness, and the values obtained are then multiplied by 100. In the present invention, a sample is allowed to stand for about 24 hours at 22° C. and 50% RH, and determined at 22° C. and 50% RH.

Developer for electrostatic latent image

A toner for developing an electrostatic latent image according to the present invention is preferably mixed with a carrier and used as a two component developer for an electrostatic latent image.

The carrier which is suitable to be combined with a toner for developing an electrostatic latent image according to the present invention is not particularly limited and may be, for example, magnetic particles such as iron powder, ferrite, iron oxide powder, nickel and the like, resin-coated carrier particles formed by coating the surface of a magnetic particles as a core material with a known resin such as styrenic resins, vinylic resins, ethyl-based resins, rosin-based resins, polyester-based resins, methyl-based resins and the like or with waxes such as stearic acid to form a resin coating layer, as well as carrier particles containing magnetic substance dispersed therein.

Resin-coated carrier particles having resin coating layers are particularly preferable since the resin coating layers serve to control the charging performance of a toner and the resistance of the entire carrier.

Materials for the resin coating layer may be selected widely from the resins usually employed as materials for the resin coating layer for the carriers. Such resins may be employed independently or in combination. Examples include polyethylene, polypropylene, polystyrene, polyacrylonitrile, polyvinyl acetate, polyvinyl alcohol, polyvinyl butyral, polyvinyl chloride, polyvinyl carbazol, polyvinyl ether, polyvinyl ketone, vinyl chloridevinyl acetate copolymer, styrene-acrylic acid copolymer, straight silicone resins having organosiloxane bonds or modified resins thereof, fluoride resins, polyester, polyurethane, polycarbonate, phenol resins, amino resins, melamine resins, benzoguanamine resins, urea resins, amide resins, epoxy resins and the like.

The volume average particle size of a carrier is preferably 45 $\mu$m or less, more preferably 10 to 40 $\mu$m or less. A volume average particle size of a carrier of 45 $\mu$m or less serves to prevent the soiled background and the uneven density as a result of retarded charging, poor charge distribution and reduced charge which are due to reduction in the particle size of the toner.

The weight ratio of a toner for developing an electrostatic latent image and a carrier to be mixed is, for example, preferably 1:100 to 20:100, more preferably 2:100 to 15:100, particularly 3:100 to 10:100.

Image forming method

A toner for developing an electrostatic latent image according to the present invention is used preferably in a method for forming an image comprising at least a latent image forming step in which an electrostatic latent image is formed on a latent image support, a toner layer forming step in which a toner layer is formed on the surface of a developer support which is located opposite, i.e., which faces, the electrostatic latent image support, a developing step in which the electrostatic latent image on the electrostatic latent image support is developed with the toner layer, and a transfer step in which a toner image developed is transferred onto a transfer material. The developing and transfer steps may be conducted using any conventional, well known methods.

By using a toner for developing an electrostatic latent image according to the present invention, an image exhibiting satisfactory minute line reproducibility and gradation without fogging can be obtained. Such satisfactory minute line reproducibility is extremely advantageous especially when developing a digital latent image.

Also in a method for forming a full color image by overlaying sequentially in any order the toner images of at least three colors including cyan, magenta and yellow onto the transfer material, or of four colors further including black, the use as each of these three or four color toners as toners for developing an electrostatic latent image according to the present invention enables the formation of an image which exhibits satisfactory minute line reproducibility and gradation and undergoes no fogging and which is visually natural and equivalent in its quality to an image obtained by an offset printing as a result of the reduced toner image thickness on a transfer material attributable to the small particle size of the toner. Because of such reduced toner image thickness on the transfer material, the image is less uneven and less irregular, and thus less damaged externally, thereby achieving a higher durability of the image once formed.

If a decrease of image thickness on a transfer material is attained by the above-mentioned decrease of toner size, a satisfactory image may not be easily obtained if a surface state of a transfer material is not appropriate as described above. Thus in the present invention, the method for forming images comprises a developing step in which a toner layer is formed on the surface of a developer support arranged opposed to a latent image support and an electrostatic latent image is developed on the latent image support by the toner layer, and a transfer step in which the toner image formed is transferred onto the transfer material. The above problems are avoided by making the ten point average surface roughness Rz on at least an image forming region of a transfer material 10 $\mu$m or less by using the above-mentioned small-sized toner. By using a transfer material having equal to or higher than a predetermined surface smoothness or more, a sufficient coloring property and image uniformity can thus be obtained, and a toner weight per unit area of a toner image on a transfer material can be decreased by using a small-sized toner. Also, an image glossiness is made uniform, namely, a uniform image glossiness corresponding to the surface glossiness of a transfer material itself is obtained, and minute line reproducibility and gradation can be made satisfactory, and image quality equal to or higher than an image formed by offset printing can be achieved.

The toner weight of the toner image transferred on the transfer material in the transfer step is preferably to be as low as possible so as to obtain a uniform image glossiness corresponding to the surface glossiness of the transfer material itself. More particularly, the toner weight of the toner image is preferably 0.40 mg/cm$^2$ or less, more preferably 0.35 mg/cm$^2$ or less, most preferably 0.30 mg/cm$^2$ or less.

A transfer material which has a smooth surface state at a point when provided for the transfer step may be suitably used. It is thus also effective to provide a surface-smoothing step by which a transfer material surface is smoothed before it is provided for a transfer step. With the image forming method having the surface-smoothing step in this way, the minute line reproducibility and gradation yielded are satisfactory and image quality equal to or higher than an image formed by offset printing can be attained even if a transfer material having a rough surface state is used.

The surface-smoothing step can attain the surface-smoothing purpose easily by forming a layer comprising a non-color transparent toner or a white toner on at least an image forming region of the transfer material. When the non-color transparent toner is used, a high image quality image can be obtained while making the best use of a color of the transfer material itself. On the other hand, when a white toner is used, a sufficient whiteness degree is given to the transfer material and a high image quality image can be obtained even if the whiteness degree of a transfer material is not sufficient.

Any non-color transparent toner or white toner can be used provided that an intended surface state of a transfer material can be obtained. Such toners preferably have a volume average particle size of 2 to 10 μm.

The method for forming images of the present invention is further detailed below.

Developing step

The developing step of this still further aspect of the present invention is a step in which a toner layer is formed on the surface of a developer support arranged opposed to a latent image support, and an electrostatic latent image is subsequently developed by the toner layer.

In the developing step, the electrostatic latent image formed on the surface of the latent image support by any known method is developed by an electrically charged toner.

In an image forming method using a two-component developer system, a developer support is arranged opposed to a latent image support. A toner layer is formed on the surface of the developer support. The toner layer is preferably formed by the so called magnetic brush which is obtained by forming magnetic carrier on the surface of a developer support like a brush and attaching a toner to it, although other suitable methods may also be used. The toner layer enables toner to be electrostatically provided to the surface of the latent image support.

Toner

The toner used in this still further aspect of the present invention (color toner forming a toner image in the developing step) is the toner of one or more of the aspects of the invention.

Transfer step

The transfer step in this still further aspect of the present invention is a step in which a toner image formed on the surface of a latent image support is transferred onto a transfer material.

The ten point average surface roughness Rz of at least an image forming region of the transfer material provided for the transfer step is 10 μm or less in the present invention. Namely, the color toner of the present invention is extremely small-sized and a decrease of the image thickness on a transfer material can be attained, but a transfer material having a ten point average surface roughness Rz of at least an image forming region of 10 μm or less is required to be used in order to make use of the decreasing effect of the image thickness at maximum and to form an image having a high image quality equal to or more than an image formed by offset printing.

By smoothing the surface state of a transfer material provided for a transfer step to a certain extent, a sufficient image glossiness may be obtained, and by using a small-sized toner, a toner weight on the transfer material is decreased, image glossiness is made uniform, i.e., a uniform image glossiness corresponding to the surface glossiness of the transfer material itself is obtained and the minute line reproducibility and the gradation are improved. Thus, this still further aspect of the present invention achieves an image having a high image quality equal to or higher than an image obtained by offset printing.

The ten point average surface roughness Rz of the transfer material is preferably determined according to the determination method described in JIS B 0601, published Feb. 1, 1994 (1997 edition), incorporated herein by reference. Generally it can be determined easily by using a commercially available feeler type surface smoothness determining device. The reason why the ten point average surface roughness Rz as an index of a surface roughness is used in the present invention, is as follows.

When a small-sized toner as the color toner of any of the aspects of the present invention is used, there may be a problem that if the smoothness of the surface of the transfer material is not sufficient, for example, it is highly uneven, the color toner transferred onto the transfer material may be buried in concave parts of the transfer material. For example, if the transfer material is paper, the color toner may be buried between fibers of the paper. Also, the color toner may not easily be made completely molten in the transfer step, and the color reproduced area is limited. The problem with respect to the burying of the color toner in the concave parts is associated with the actual depth of the concave parts of the surface of the transfer material. Thus, the ten point average surface roughness Rz, which can show a depth of minute concave parts of the surface of the transfer material sufficiently, is considered to be suitable as an index of the surface roughness of the transfer material.

In the present invention, the minute line reproducibility and the gradation of an image obtained can be improved by making the ten point surface roughness Rz of the surface of a transfer material of 10 μm or less with the use of a small-sized toner. The ten point average surface roughness Rz of the surface of a transfer material is preferably 10 μm or less, and is more preferably 5 μm or less.

The preferable lower limit of the ten point average surface roughness Rz is not specified since the surface of a transfer material is required to be more smooth, but the ten point average surface roughness Rz of the surface of a transfer material which is actually obtained from the view point of manufacture, is about 2 μm at a minimum.

The region on the surface of a transfer material which must be a surface state having a ten point average surface roughness Rz of 10 μm or less, is required to be a side on which an image is formed and to be at least an image forming region. The image forming region indicates an area other than an area on which an image is not formed such as the outer periphery of the transfer material. The entire of the side on which an image is formed and the side on which an image is not formed may have the ten point average surface roughness Rz of 15 μm or less.

More particularly, a transfer material may be made to have a ten point average surface roughness Rz of 10 μm or less by coating thereon a resin or a coating agent in which a white pigment is dispersed in a binder resin. For example, a paper for use in electrophotography and the like having a ten point average surface roughness Rz of about 16 to 35 μm may be used once coated with such a coating to reduce the surface roughness Rz.

Additional examples of suitable transfer materials include a so called synthetic paper having a ten point average surface roughness Rz of 10 μm or less such as a paper for printing such as cast coated paper, art paper, machine coated paper obtained by coating to a high-quality paper used in a printing such as offset printing, photogravure, a transfer material which is made as a film by dispersing a white pigment in a thermoplastic resin such as polyester, polypropylene, a transfer material which is made as a film by applying whiteness degree equal to paper by making minute space in a thermoplastic resin, or a transfer material which is coated by a coating agent in which a white pigment is dispersed in a binder resin to the surface of a film.

Surface-smoothing step

It is sufficient for a transfer material to have a smooth surface state when provided for the transfer step. Thus it is possible to include a surface-smoothing step by which a transfer material surface is smoothed before being provided for the transfer step. With the image forming method having the surface-smoothing process in this way, even if a transfer material having a rough surface state is used, minute line reproducibility and gradation are made satisfactory and an image quality equal to or higher than an image formed by offset printing can be achieved.

The surface state of the transfer material after being smoothed as in the surface-smoothing step, the surface preferably has a ten point average surface roughness Rz of 10 μm or less, more preferably 5 μm or less.

The surface-smoothing step can attain the purpose of the surface smoothing easily by making it a step in which a layer comprising a non-color transparent toner or a white toner is formed on at least an image forming region on the surface of the side of a transfer material on which an image is to be formed.

To further explain the method, in addition to three or four developing devices filled with each developer comprising each color toner of cyan, magenta and yellow and further black if necessary, a developing device filled with a developer comprising a non-color transparent toner or a white toner (which is referred as "surface-smoothing developing device" hereinafter) may be provided. A transfer material is surface-smoothed by developing and transferring the non-color transparent toner or the white toner on an image region formed on the transfer material with a color toner or the entire surface of the transfer material in a sufficient amount to smooth the surface. Preferably, the amount is sufficient to have a ten point average surface roughness Rz of 10 μm or less. The transfer material is then provided for the next transfer step of color toner.

On the transfer material which has been surface-smoothed, a toner image with a color toner is transferred and fixed to form an image. As described, the explanation is made by way of the example in which a full-color image is formed on a transfer material, but to include a surface smoothing step is also preferable from the view point of the improvement of the minute line reproducibility and the gradation even when an image of single color such as black is formed.

To form a toner image with a color toner without fixing after forming a non-color transparent toner layer or a white toner layer on a transfer material, is preferable in view of minimization and simplification of a device and further of a decrease of power consumption. The non-color transparent toner layer or a white toner layer is heated and fixed with a fixing roll and the like in a fixing step of a toner image with a color toner, and by embedding the concave parts of the surface of a transfer material having a ten point average surface roughness Rz exceeding 10 μm with such surface smoothing material, the embedding into the concave parts of a color toner can be effectively prevented.

The ten point average surface roughness Rz of the surface of a transfer material on which a non-color transparent toner layer or a white toner layer is formed can be determined by forming only a non-color transparent toner layer or a white toner layer, and determining as to the surface of the transfer material on which it is fixed. If a non-color transparent toner layer or a white toner layer is fixed before providing for a fixing step of a toner image with a color toner, the purpose of smoothing of the surface of a transfer material can be attained sufficiently.

When a non-color transparent toner is applied in the surface-smoothing step, a high image quality can be obtained while making the best use of the color of the transfer material. On the other hand, when a white toner is applied, even if the whiteness degree of the transfer material is not sufficient, a sufficient whiteness degree is provided to the transfer material, and thus a high image quality image can be obtained. Whether a non-color transparent toner or a white toner is used in the surface-smoothing step, one can select appropriately based on the original whiteness degree of the transfer material used and the whiteness degree to be obtained.

The whiteness degree for a transfer material is preferably 70% or higher, more preferably 80% or more from the view point of color reproducibility in the case when the image formed is full-color. Therefore, when the original whiteness degree of the transfer material used is less than 70%, it is desirable to increase it to 70% or higher, more preferably 80% or more, by using a white toner.

The term whiteness degree means a value determined by the Hunter whiteness degree test method for paper and pulp according to JIS P 8123, published Sep. 1, 1994 (1996 edition), incorporated herein by reference.

The non-color transparent toner and the white toner applicable to the surface-smoothing step will now be described.

The non-color transparent toner and the white toner comprise at least a binding resin such as in the color toner, and in the case of the white toner, it further contains a white colorant.

As the binding resin constituting the non-color transparent toner and the white toner, the same materials as explained above for the color toner according to the present invention may suitably be used. In addition, the glass transition point and the softening point, etc., of the binding resin are the same as that explained for the color toner according to the present invention.

As the white colorant used in the white toner, an inorganic pigment such as titanium oxide, zinc oxide, zinc sulfate, antimony oxide, zirconium oxide having a particle size in the range from 0.05 to 0.5 μm may, for example, be used. From the view point of the whiteness degree and hiding power, titanium oxide is preferable.

To the non-color transparent toner and the white toner, a non-color or pale color charge-controlling agent may be added. As the charge-controlling agent, a basic electron donative compound such as a quaternary ammonium salt or benzoguanamine for a positive charging toner, and an electron suction compound such as salicylate metal salt, organic boron compound for a negative charging toner, may be used. If added, the amount of the charging controlling agent to be added is preferably in the range of, for example, 2 to 10% by weight to the binder resin provided that the amount does not affect the color reproducibility and transparency of an image obtained by the image forming method of the present invention (in particular full-color image), the non-color property and transparency in the case of the non-color transparent toner, and the whiteness degree in the case of the white toner.

A releasing agent such as wax may also be added to the non-color transparent toner and the white toner in order to prevent hot offset in a fixing step. As a releasing agent which may be used, for example, a low molecular weight polyethylene, a low molecular weight polypropylene, an aliphatic hydrocarbon wax such as microcrystalline wax, paraffin wax, an aliphatic wax such as camauba wax, montan wax and the like can be exemplified. If added, the amount of the releasing agent to be added is preferably in the range of, for example, 0.1 to 20% by weight, more preferably in the range from 2 to 10% by weight to the binder resin, provided that the amount does not affect the color reproducibility and transparency of an image obtained by the image forming method of the present invention (in particular full-color image), the non-color property and transparency in the case of the non-color transparent toner, and the whiteness degree in the case of the white toner.

The volume average particle size of the non-color transparent toner and the white toner, and the thickness of the layer of the non-color transparent toner or the white toner formed in the surface-smoothing step, may be controlled appropriately respectively so as to preferably yield a ten point average surface roughness Rz of the transfer material of 10 μm. For example, when a transfer material having a relatively high surface-smoothing property (namely, the ten point average surface roughness Rz is near 10 μm), it is sufficient to form a relatively thin layer of a non-color transparent toner or a white toner by laying a relatively small-sized non-color transparent toner or white toner on a transfer material in a relatively small amount. On the other hand, when a transfer material having a relatively low surface-smoothing property (namely, the ten point average surface roughness Rz greatly exceeds 10 μm), the ten point average surface roughness Rz may be made 10 μm or less by forming a relatively thick layer of a non-color transparent toner or a white toner by laying a relatively large-sized non-color transparent toner or white toner on a transfer material in a relatively large amount.

For example, an appropriate volume average particle size of the non-color transparent toner and the white toner is preferably in the range from 2 to 10 vm, more preferably in the range from 3 to 7 μm, most preferably in the range from 2 to 5 μm, which can be determined appropriately in line with the surface state of the transfer material as described above.

In addition, the weight of the non-color transparent toner or the white toner on the surface of the transfer material, can also be determined appropriately in line with the surface state of the transfer material as described above. However, a certain degree of amount is required to the surface-smoothing, and on the other hand, an amount as low as possible is preferable in the view point of the curl of a transfer material. Thus, the amount of the non-color transparent toner or a white toner on the surface of a transfer material is preferably in the range of, for example, 0.10 to 0.50 mg/cm$^2$, more preferably in the range from 0.20 to 0.40 mg/cm$^2$.

The surface smoothing step is preferably carried out by a method using the above non-color transparent toner or a white toner because it is easy, but the step can also be carried out by any other suitable methods. As the other methods, methods for coating a coating material such as resin which can smooth the surface of a transfer material by known coating methods such as roll coating method or blade coating method may be mentioned.

As a resin which can smooth the surface of the transfer material, a thermoplastic resin and the like such as polyester, styrene-(meth)acrylic acid ester copolymer, styrene-butadiene copolymer, etc., may be exemplified.

EXAMPLES

The present invention is further described in the following examples. While all of the toners for developing electrostatic latent images produced in the examples are negatively charged toners, it is a matter of course that positively charged toners are similar to the negatively charged toners except for inverted polarity.

Experiment 1

Examples 1–15 and Comparative Examples 1–12

(1) Preparation of flushing pigment

Magenta flushing pigment 70 parts by weight of polyester resin (bisphenol-A type polyester: bisphenol A ethylene oxide adduct-cyclohexane dimethanol-terephthalic acid, weight average molecular weight: 11,000, number average molecular weight: 3,500, Tg: 65° C.) and 75 parts by weight of a magenta pigment (C.I. Pigment Red 57:1) hydrated paste (pigment: 40% by weight) are placed in a kneader and mixed, and heated gradually. Kneading is continued at 120° C., and, after allowing separation of the aqueous layer and the resin layer, water is removed and the resin layer is further kneaded to remove water, and dehydrated to obtain a magenta flushing pigment.

Cyan flushing pigment

A cyan flushing pigment is obtained in the same manner as the magenta flushing pigment except for using a cyan pigment (C.I. Pigment Blue 15:3) hydrated paste (pigment: 40% by weight) instead of the magenta pigment hydrated paste.

Yellow flushing pigment

A yellow flushing pigment is obtained in the same manner as the magenta flushing pigment except for using a yellow pigment (C.I. Pigment Yellow 17) hydrated paste (pigment: 40% by weight) instead of the magenta pigment hydrated paste.

(2) Coloring particle preparation

Preparation 1 of coloring particle

Polyester resin (bisphenol-A type polyester: bisphenol A ethylene oxide adduct-cyclohexane dimethanol/terephthalic acid, weight average molecular weight: 11,000, number average molecular weight: 3,500, Tg: 65° C.)

66.7 parts by weight

The above magenta flushing pigment (pigment: 30% by weight)

33.3 parts by weight

The above components are melted and kneaded with a Banbury mixer, cooled, finely ground with a jet mill, and classified with an air-classifier to obtain coloring particles A, B, J, T, and U having each particle size distribution shown in Table 1 by varying conditions of grinding and classification.

The particle size and the particle size distribution of particles are determined using a Coulter counter model TA II manufactured by Coulter Co., Ltd. In this determination, a 100 μm aperture tube is used for a toner (coloring particle) having an average particle size exceeding 5 μm, and a toner having an average particle size 5 μm or less is determined at the aperture size of 50 μm, and the frequency distribution of the particle having a size of 1 μm or less is determined at the aperture size of 30 μm. (Particle size is determined similarly in the following Examples and Comparatives Examples.)

Preparation 2 of coloring particle

A coloring particle D shown in Table 1 is obtained in the same manner as Preparation 1 of coloring particle except for using cyan flushing pigment instead of magenta flushing pigment. The conditions of grinding and classification are adjusted to obtain a particle size distribution shown in Table 1.

Preparation 3 of coloring particle

A coloring particle E shown in Table 1 is obtained in the same manner as Preparation 1 of coloring particle except for using 50 parts by weight of polyester resin and 50 parts by weight of yellow flushing pigment. The conditions of grinding and classification are adjusted to obtain a particle size distribution shown in Table 1.

Preparation 4 of coloring particle

A coloring particle C shown in Table 1 is obtained in the same manner as Preparation 1 of coloring particle except for using 90 parts by weight of polyester resin and 10 parts by weight of carbon black (primary particles average diameter 40 nm). The conditions of grinding and classification are adjusted to obtain a particle size distribution shown in Table 1.

Preparation 5 of coloring particle

A coloring particle F shown in Table 1 is obtained in the same manner as Preparation 1 of coloring particle except for using 73.3 parts by weight of polyester resin and 26.7 parts by weight of magenta flushing pigment. The conditions of grinding and classification are adjusted to obtain a particle size distribution shown in Table 1.

Preparation 6 of coloring particle

A coloring particle K shown in Table 1 is obtained in the same manner as described in Preparation 1 of coloring particle except for using 83.4 parts by weight of polyester resin and 16.6 parts by weight of magenta flushing pigment. The conditions of grinding and classification are adjusted to obtain a particle size distribution shown in Table 1.

Preparation 7 of coloring particle

A coloring particle L shown in Table 1 is obtained in the same manner as described in Preparation 1 of coloring particle except for using 80 parts by weight of polyester resin and 20 parts by weight of magenta flushing pigment. The conditions of grinding and classification are adjusted to obtain a particle size distribution shown in Table 1.

Preparation 8 of coloring particle

A coloring particle P shown in Table 1 is obtained in the same manner as described in Preparation 1 of coloring particle except for using 86.7 parts by weight of polyester resin and 13.3 parts by weight of magenta flushing pigment. The conditions of grinding and classification are adjusted to obtain a particle size distribution shown in Table 1.

Preparation 9 of coloring particle

A coloring particle H shown in Table 1 is obtained in the same manner as described in Preparation 2 of coloring particle except for using 73.3 parts by weight of polyester resin and 26.7 parts by weight of cyan flushing pigment. The conditions of grinding and classification are adjusted to obtain a particle size distribution shown in Table 1.

Preparation 10 of coloring particle

A coloring particle N shown in Table 1 is obtained in the same manner as described in Preparation 2 of coloring particle except for using 80 parts by weight of polyester resin and 20 parts by weight of cyan flushing pigment. The conditions of grinding and classification are adjusted to obtain a particle size distribution shown in Table 1.

Preparation 11 of coloring particle

A coloring particle R shown in Table 1 is obtained in the same manner as described in Preparation 2 of coloring particle except for using 86.7 parts by weight of polyester resin and 13.3 parts by weight of cyan flushing pigment. The conditions of grinding and classification are adjusted to obtain a particle size distribution shown in Table 1.

Preparation 12 of coloring particle

A coloring particle I shown in Table 1 is obtained in the same manner as described in Preparation 3 of coloring particle except for using 60 parts by weight of polyester resin and 40 parts by weight of yellow flushing pigment. The conditions of grinding and classification are adjusted to obtain a particle size distribution shown in Table 1.

Preparation 13 of coloring particle

A coloring particle O shown in Table 1 is obtained in the same manner as described in Preparation 3 of coloring particle except for using 73.3 parts by weight of polyester resin and 26.7 parts by weight of yellow flushing pigment. The conditions of grinding and classification are adjusted to obtain a particle size distribution shown in Table 1.

Preparation 14 of coloring particle

A coloring particle S shown in Table 1 is obtained in the same manner as described in Preparation 3 of coloring particle except for using 83.3 parts by weight of polyester resin and 16.7 parts by weight of yellow flushing pigment. The conditions of grinding and classification are adjusted to obtain a particle size distribution shown in Table 1.

Preparation 15 of coloring particle

A coloring particle G shown in Table 1 is obtained in the same manner as described in Preparation 4 of coloring particle except for using 93 parts by weight of polyester resin and 7 parts by weight of carbon black. The conditions of grinding and classification are adjusted to obtain a particle size distribution shown in Table 1.

Preparation 16 of coloring particle

A coloring particle M shown in Table 1 is obtained in the same manner as described in Preparation 4 of coloring particle except for using 96 parts by weight of polyester resin and 4 parts by weight of carbon black. The conditions of grinding and classification are adjusted to obtain a particle size distribution shown in Table 1.

Preparation 17 of coloring particle

A coloring particle Q shown in Table 1 is obtained in the same manner as described in Preparation 4 of coloring particle except for using 97 parts by weight of polyester resin and 3 parts by weight of carbon black. The conditions of grinding and classification are adjusted to obtain a particle size distribution shown in Table 1.

In the following Table 1, pigment concentration C (%) in each coloring particle, true specific weight a of each coloring particle, aDC calculated from these values and volume average particle size D (μm) of the coloring particles, and average particle size of a dispersed particle in binder resin of pigment fine particle (circle diameter: μm) are described as well as the descriptions with regard to the particle size of the coloring particles A to U obtained above.

TABLE 1

| Kinds of Coloring Particle | Volume Average Particle Size D (μm) | Particle Exceeding 5.0 μm (% by Number) | Particle of 4.0 μm or Less (% by Number) | Particle 1.0 μm or Less (% by Number) | Color of Colorant | Pigment Concentration C (%) | True Specific Gravity a | a D C (a × D × C) | Size of Dispersed Pigment (μm)*2 | Particle of 1.0 to 2.5 μm (% by Number) |
|---|---|---|---|---|---|---|---|---|---|---|
| Coloring Particle A | 3.0 | 0.5 | 93.2 | 8.0 | M | 10 | 1.24 | 37.2 | 0.25 | 44.1 |
| Coloring Particle B | 3.6 | 2.2 | 89.6 | 3.0 | M | 10 | 1.24 | 44.6 | 0.20 | 36.5 |
| Coloring Particle C | 3.5 | 2.0 | 88.0 | 3.0 | K | 10 | 1.20 | 42.0 | — | 41.2 |

TABLE 1-continued

| Kinds of Coloring Particle | Volume Average Particle Size D (μm) | Particle Exceeding 5.0 μm (% by Number) | Particle of 4.0 μm or Less (% by Number) | Particle 1.0 μm or Less (% by Number) | Color of Colorant | Pigment Concentration C (%) | True Specific Gravity a | a D C (a × D × C) | Size of Dispersed Pigment (μm)*2 | Particle of 1.0 to 2.5 μm (% by Number) |
|---|---|---|---|---|---|---|---|---|---|---|
| Coloring Particle D | 3.6 | 1.6 | 90.8 | 2.9 | C | 10 | 1.24 | 44.6 | 0.23 | 35.1 |
| Coloring Particle E | 3.6 | 1.7 | 90.6 | 2.9 | Y | 15 | 1.25 | 67.5 | 0.20 | 37.3 |
| Coloring Particle F | 3.5 | 2.4 | 89.5 | 3.1 | M | 8 | 1.23 | 34.4 | 0.18 | 36.4 |
| Coloring Particle G | 3.4 | 2.0 | 90.9 | 3.3 | K | 7 | 1.20 | 28.6 | — | 37.2 |
| Coloring Particle H | 3.3 | 1.8 | 92.0 | 3.6 | C | 8 | 1.23 | 32.5 | 0.19 | 40.5 |
| Coloring Particle I | 3.6 | 2.6 | 88.4 | 3.0 | Y | 12 | 1.25 | 54.0 | 0.18 | 38.2 |
| Coloring Particle J | 4.2 | 8.1 | 77.2 | 2.0 | M | 10 | 1.24 | 52.1 | 0.20 | 32.1 |
| Coloring Particle K | 3.6 | 2.1 | 87.0 | 3.1 | M | 5 | 1.22 | 22.0 | 0.23 | 39.2 |
| Coloring Particle L | 5.7 | 28.4 | 39.2 | 0.0 | M | 6 | 1.22 | 41.7 | 0.25 | 6.2 |
| Coloring Particle M | 6.1 | 35.6 | 37.0 | 1.8 | K | 4 | 1.20 | 29.3 | — | 6.0 |
| Coloring Particle N | 5.8 | 30.6 | 39.0 | 2.1 | C | 6 | 1.22 | 42.5 | 0.21 | 5.8 |
| Coloring Particle O | 5.9 | 33.4 | 38.0 | 1.7 | Y | 8 | 1.22 | 57.6 | 0.20 | 6.1 |
| Coloring Particle P | 7.8 | 84.1 | 6.2 | 1.8 | M | 4 | 1.22 | 38.1 | 0.24 | 4.8 |
| Coloring Particle Q | 8.2 | 89.2 | 4.2 | 2.0 | K | 3 | 1.20 | 29.5 | — | 4.5 |
| Coloring Particle R | 7.5 | 80.1 | 7.8 | 2.3 | C | 4 | 1.22 | 36.6 | 0.21 | 5.6 |
| Coloring Particle S | 7.6 | 81.1 | 7.6 | 2.2 | Y | 5 | 1.21 | 46.0 | 0.24 | 5.2 |
| Coloring Particle T | 2.8 | 1.0 | 95.1 | 25.4 | M | 10 | 1.24 | 34.7 | 0.21 | 51.0 |
| Coloring Particle U | 4.4 | 12.1 | 72.5 | 2.1 | M | 10 | 1.24 | 54.6 | 0.26 | 44.1 |

Legend of colorants: K: black, M: magenta, C: cyan, Y: yellow (3) Preparation of toner for developing an electrostatic latent image To each of the above described coloring particles A to U, silica ($SiO_2$) fine particles whose surface has been imparted with hydrophobicity using hexamethyldisilazane (HMDS) and whose primary particle size is 40 nm, and metatitanic acid compound fine particles which are the reaction product of metatitanic acid and i-butyltrimethoxysilane and whose primary particle size is 20 nm, are added so as to have each coating rate to the surface of each coloring particle of 40%, and mixing with a Henschel mixer to yield toners for developing an electrostatic latent image A to U (each of the symbols A to U appended to the obtained each toner for developing an electrostatic latent image is corresponding to each of the symbol A to U of the used coloring particle).

The coating rate to the surface of the coloring particle used herein is the value F(%) determined by the above described Formula (2).

Carrier Preparation

100 Parts by weight of a Cu—Zn ferrite fine particles having a volume average particle size of 40 μm is admixed with a methanol solution containing 0.1 parts by weight of γ-aminopropyl-triethoxysilane, and coating is effected using a kneader, and then the silane compound is hardened completely by distilling methanol off followed by heating for 2 hours at 120° C. The particle thus obtained is admixed with perfluorooctylethyl methacrylate-methyl methacrylate copolymer (copolymerization ratio, 40:60 by weight) dissolved in toluene and subjected to a vacuum kneader to yield a resin-coated carrier having 0.5% by weight of the perfluorooctylethyl methacrylate-methyl methacrylate copolymer as a coating thereon, to yield a resin-coated type carrier used in the following Examples and Comparative Examples.

Example 1

The resin-coated type carrier; 100 parts by weight is admixed with Toner A; 4 parts by weight using a V type mixer to obtain a two-component developer of Example 1.

Example 2

A two-component developer of Example 2 is obtained in the same manner as described in Example 1 except for using Toner B; 4 parts by weight instead of Toner A; 4 parts by weight.

Example 3

A two-component developer of Example 3 is obtained in the same manner as described in Example 1 except for using Toner C; 4 parts by weight instead of Toner A; 4 parts by weight.

Example 4

A two-component developer of Example 4 is obtained in the same manner as described in Example 1 except for using Toner D; 4 parts by weight instead of Toner A; 4 parts by weight.

Example 5

A two-component developer of Example 5 is obtained in the same manner as described in Example 1 except for using Toner E; 4 parts by weight instead of Toner A; 4 parts by weight.

Example 6

A two-component developer of Example 6 is obtained in the same manner as described in Example 1 except for using Toner F; 5 parts by weight instead of Toner A; 4 parts by weight.

Example 7

A two-component developer of Example 7 is obtained in the same manner as described in Example 1 except for using Toner G; 5 parts by weight instead of Toner A; 4 parts by weight.

Example 8

A two-component developer of Example 8 is obtained in the same manner as described in Example 1 except for using Toner H; 5 parts by weight instead of Toner A; 4 parts by weight.

Example 9

A two-component developer of Example 9 is obtained in the same manner as described in Example 1 except for using Toner I; 5 parts by weight instead of Toner A; 4 parts by weight.

Example 10

A two-component developer of Example 10 is obtained in the same manner as described in Example 1 except for using Toner J; 6 parts by weight instead of Toner A; 4 parts by weight.

Example 11

A two-component developer of Example 11 is obtained in the same manner as described in Example 1 except for using Toner K; 5 parts by weight instead of Toner A; 4 parts by weight.

Comparative Example 1

A two-component developer of Comparative Example 1 is obtained in the same manner as described in Example 1 except for using Toner L; 5 parts by weight instead of Toner A; 4 parts by weight.

Comparative Example 2

A two-component developer of Comparative Example 2 is obtained in the same manner as described in Example 1 except for using Toner M; 5 parts by weight instead of Toner A; 4 parts by weight.

Comparative Example 3

A two-component developer of Comparative Example 3 is obtained in the same manner as described in Example 1 except for using Toner N; 5 parts by weight instead of Toner A; 4 parts by weight.

Comparative Example 4

A two-component developer of Comparative Example 4 is obtained in the same manner as described in Example 1 except for using Toner O; 5 parts by weight instead of Toner A; 4 parts by weight.

Comparative Example 5

A two-component developer of Comparative Example 5 is obtained in the same manner as described in Example 1 except for using Toner P; 6 parts by weight instead of Toner A; 4 parts by weight.

Comparative Example 6

A two-component developer of Comparative Example 6 is obtained in the same manner as described in Example 1 except for using Toner Q; 6 parts by weight instead of Toner A; 4 parts by weight.

Comparative Example 7

A two-component developer of Comparative Example 7 is obtained in the same manner as described in Example 1 except for using Toner R; 6 parts by weight instead of Toner A; 4 parts by weight.

Comparative Example 8

A two-component developer of Comparative Example 8 is obtained in the same manner as described in Example 1 except for using Toner S; 6 parts by weight instead of Toner A; 4 parts by weight.

Comparative Example 9

A two-component developer of Comparative Example 9 is obtained in the same manner as described in Example 1 except for using Toner T; 4 parts by weight instead of Toner A; 4 parts by weight.

Comparative Example 10

A two-component developer of Comparative Example 10 is obtained in the same manner as described in Example 1 except for using Toner U; 4 parts by weight instead of Toner A; 4 parts by weight.

Methods for various evaluations

Each two-component developer obtained in each of Examples 1 to 11 and Comparative Examples 1 to 10 is used to make the various evaluations as shown below.

In the following various evaluations, J coat paper manufactured by Fuji Xerox Co., Ltd. is employed as a transfer material, and a modified model of A color 935 manufactured by Fuji Xerox Co., Ltd. (modified to control the voltage upon development by means of external power source, hereinafter simply referred to as modified A color 935) is employed as an image forming device. The evaluations are all carried out under an environmental condition at a temperature of 22° C. and a humidity of 55%. The image formation is carried out appropriately with controlling image density in the range from 1.6 to 2.0.

TMA

A solid image having an area rate of 100% is formed, and the weight of toner per unit area of the image area (TMA: $mg/cm^2$) is determined. As the method of the determination, an un-fixed solid image having an area rate of 100% is formed on a transfer material. It is weighed. The un-fixed toner on the transfer material is removed by air-blowing, then the weight of only the transfer material is determined. The TMA is calculated from the weight difference between before and after the removal of the un-fixed toner.

Image Density

A solid area having an area rate of 100% is formed, and the image density of the image area is determined using X-Rite404 (manufactured by X-Rite Co., Ltd.).

Minute Line Reproducibility Evaluation

Minute line image is formed so as to have a line width of 50 μm on a photosensitive body, and it is transferred on a transfer material and fixed. The minute line image of the fixed image on the transfer material is observed using a VH-6220 microhighscope (KEYENCE Co., Ltd.) with a 175× magnification. Evaluation is made with the criteria as shown below. The ◎ and ○ are regarded as acceptable.

◎: Minute lines are filled uniformly with toner and no disturbed edges are observed.

○: Minute lines are filled uniformly with toner but slightly jagged edges are observed.

Δ: Minute lines are filled almost uniformly with the toner but jagged edges are observed evidently.

×: Minute lines are not filled uniformly with the toner. Jagged edges are observed very evidently.

Gradation Reproducibility Evaluation

A gradation image having an image area rate of 10%, 20%, 30%, 40%, 50%, 60%, 70%, 80%, 90% or 100% is made and examined for its image density using X-Rite model 404 (manufactured by X-Rite Co., Ltd.) to evaluate the gradation. The concrete criteria for evaluation are as follow. The ◎ and ○ are regarded as acceptable.

◎: From the low image area rate part to the high image area rate part, the gradation for all gradation images are very satisfactory.

○: From the low image area rate part to the high image area rate part, the gradation for all gradation images are satisfactory.

Δ: The gradation reproducible range is somewhat limited in the low image area part, and the gradation is somewhat unstable.

×: The gradation reproducible range is limited in the high/low image area part, and the gradation is unstable.

Graininess On Highlight Area

Gradation images each having an image area rate of 5% and 10% are formed. The obtained image is observed visually and observed using a VH-6220 microhighscope (KEYENCE Co., Ltd.) with a 175× magnification, and the graininess on highlighted areas is evaluated. The criteria for evaluation are as follow. The ◎ and ○ are regarded as acceptable.

◎: The graininess for both 5% and 10% are very satisfactory.

○: The graininess for 5% is somewhat bad, but the graininess is generally satisfactory.

Δ: The graininess for 5% is bad.

×: The graininess for both 5% and 10% are bad.

Cleanability

Cleanability is designated as ○ when no poor cleaning occurred during reproducing 3,000 copies, and as × when poor cleaning occurred.

The results of the evaluations for each toner obtained in Examples 1 to 11 and Comparative Examples 1 to 10 are summarized in Table 2.

TABLE 2

| Example/ Comparative Example | | Developer: Kinds of Toner | Developer: Color | Developer: Particle Size of Carrier (μm) | TMA mg/cm² | Image Density | Minute Line Reproducibility | Gradation | Graininess on Highlight Area | Cleanability |
|---|---|---|---|---|---|---|---|---|---|---|
| Example | 1 | A | M | 40 | 0.25 | 1.8 | ◎ | ◎ | ◎ | ○ |
| | 2 | B | M | 40 | 0.25 | 1.9 | ◎ | ◎ | ◎ | ○ |
| | 3 | C | K | 40 | 0.25 | 1.8 | ◎ | ◎ | ◎ | ○ |
| | 4 | D | C | 40 | 0.25 | 1.8 | ◎ | ◎ | ◎ | ○ |
| | 5 | E | Y | 40 | 0.25 | 1.7 | ◎ | ◎ | ◎ | ○ |
| | 6 | F | M | 40 | 0.35 | 1.8 | ◎ | ◎ | ◎ | ○ |
| | 7 | G | K | 40 | 0.35 | 1.8 | ◎ | ◎ | ◎ | ○ |
| | 8 | H | C | 40 | 0.35 | 1.7 | ◎ | ◎ | ◎ | ○ |
| | 9 | I | Y | 40 | 0.35 | 1.6 | ◎ | ◎ | ◎ | ○ |
| | 10 | J | M | 40 | 0.35 | 2.0 | ○ | ○ | ○ | ○ |
| | 11 | K | M | 40 | 0.45 | 1.8 | ○ | ○ | ◎ | ○ |
| Comparative Example | 1 | L | M | 40 | 0.45 | 1.8 | Δ | Δ | Δ | ○ |
| | 2 | M | K | 40 | 0.45 | 1.8 | Δ | Δ | Δ | ○ |
| | 3 | N | C | 40 | 0.45 | 1.8 | Δ | Δ | Δ | ○ |
| | 4 | O | Y | 40 | 0.45 | 1.6 | Δ | Δ | Δ | ○ |
| | 5 | P | M | 40 | 0.65 | 1.8 | X | X | X | ○ |
| | 6 | Q | K | 40 | 0.65 | 1.8 | X | X | X | ○ |
| | 7 | R | C | 40 | 0.65 | 1.8 | X | X | X | ○ |
| | 8 | S | Y | 40 | 0.65 | 1.6 | X | X | X | ○ |
| | 9 | T | M | 40 | 0.25 | 1.8 | ◎ | ◎ | ◎ | X |
| | 10 | U | M | 40 | 0.25 | 1.8 | Δ | Δ | Δ | ○ |

From the results, it can be seen that, with the toner for developing an electrostatic latent image of the present invention, an image having satisfactory minute line reproducibility, gradation reproducibility, and graininess on highlighted areas can be formed, and that satisfactory cleanability can be obtained. With Example 10, in which the coloring particle has a somewhat large volume average particle size, the minute line reproducibility, gradation reproducibility, and graininess on highlighted areas are somewhat lowered compared with the other Examples, but these are still in the acceptable range. In addition, with Example 11, in which the low pigment concentration has an aDC value of 25 or less, the image quality impression is somewhat inferior due to the high TMA of the toner, but the graininess on highlighted areas is excellent, and thus it is deemed to be satisfactorily favorable compared with the case where the conventional toner is used.

To the contrary, with Comparative Examples 1 to 8, in which the coloring particles have large volume average particle size, and with Comparative Example 10, in which the amount of the coloring particles having a size exceeding 5 μm is high (even though the volume average particle size of the coloring particles is controlled to a some extent), the cleanability is acceptable, but the minute line reproducibility, gradation reproducibility, and graininess on highlighted areas (which are the aims of the present invention) are low. Thus a satisfactory image could not be obtained. Further, with Comparative Example 9, the minute line reproducibility, gradation reproducibility, and graininess on highlighted areas are satisfactory, but cleanability is remarkably deteriorated. The reason for this is that, although the obtained image itself can be satisfactory because the volume average particle size of the coloring particles is small, the rate of the coloring particles having a size of 1.0 μm or less is large, and it thus cannot be actually used.

Example 12

A full color copy test using three colors is carried out using each developer of magenta, cyan, and yellow obtained in Examples 2, 4, and 5. The copy test is made using a modified A color 935 as an image forming device under a condition of at a temperature of 22° C. and humidity of 55%. The evaluations of graininess on highlighted areas and image uniformity are made by generating a photographic image.

The evaluation items are as follows. The results are summarized in Table 3.

TMA

A solid image having an area rate of 100% using a single color for each of magenta, cyan, and yellow, and a black image having an area rate of 100% comprising magenta, cyan, and yellow are each formed, and the toner weight per unit area of the image area (TMA: mg/cm$^2$) is determined. The method for determination is the same as that for Examples 1 to 11.

Image Density

Solid areas each having an area rate of 100% with a single color for each of magenta, cyan, and yellow used, and a black image having an area rate of 100% comprising the three colors of magenta, cyan, and yellow are formed respectively, and the image density of each of the image areas is determined using X-Rite 404 (manufactured by X-Rite Co., Ltd.).

Graininess On Highlight Area

Gradation images having image areas of 5% and 10% standards are formed. The obtained images are observed visually, and the graininess on highlight areas is evaluated. The criteria for evaluation are as follow. The ⊚ and ○ are regarded as acceptable.

⊚: The graininess for both 5% and 10% are very satisfactory.

○: The graininess for 5% is somewhat bad, but the graininess is generally satisfactory.

Δ: The graininess for 5% is bad.

×: The graininess for both 5% and 10% are bad.

Image Uniformity

As for the obtained photographic image, the degrees of the image uniformity due to the difference of irregularities between an imaged area and a non-imaged area and between a high density area and a low density area, are evaluated visually. The concrete evaluation criteria are as follows. The ○ is regarded as to be acceptable.

○: Uniformity is equivalent or higher to offset printing.

Δ: Uniformity is slightly lower than offset printing.

×: Uniformity is markedly lower than offset printing.

Example 13

A full color copy test is made using three colors in the same manner as described in Example 12, using each developer of magenta, cyan, and yellow obtained in Examples 6, 8 and 9. The results are summarized in Table 3.

Example 14

A full color copy test is made using four colors in the same manner as described in Example 12, using each developer of magenta, cyan, yellow, and black obtained in Examples 2, 4, 5 and 3. For the TMA and image density, the test is made for the black single-color toner. The results are summarized in Table 3.

Example 15

A full color copy test is made using four colors in the same manner as described in Example 12, using each developer of magenta, cyan, yellow, and black obtained in Examples 6, 8, 9 and 7. For the TMA and image density, the test is made for the black single-color toner. The results are summarized in Table 3.

Comparative Example 11

A full color copy test is made using four colors in the same manner as described in Example 12, using each developer of magenta, cyan, yellow, and black obtained in Comparative Examples 1, 3, 4 and 2. For the TMA and image density, the test is made for the black single-color toner. The results are summarized in Table 3.

Comparative Example 12

A full color copy test is made using four colors in the same manner as described in Example 12, using each developer of magenta, cyan, yellow, and black obtained in Comparative Examples 5, 7, 8 and 6. For the TMA and image density, the test is made for black single-color toner. The results are summarized in Table 3.

TABLE 3

| Example - Comparative Example | | Developer: Particle Size of Carrier (μm) | Developer: Kinds of Toner | Color | Single Color: TMA mg/cm$^2$ | Single Color: Image Density | Process Black: TMA mg/cm$^2$ | Process Black: Image Density | Graininess on Highlight Area | Image Uniformity |
|---|---|---|---|---|---|---|---|---|---|---|
| Ex. | 12 | 40 | B | M | 0.25 | 1.9 | 0.75 | 1.8 | ⊚ | ⊚ |
| | | | D | C | 0.25 | 1.8 | | | | |
| | | | E | Y | 0.25 | 1.7 | | | | |

TABLE 3-continued

| Example - Comparative Example | Developer: Particle Size of Carrier (μm) | Developer: Kinds of Toner | Color | Single Color: TMA mg/cm² | Single Color: Image Density | Process Black: TMA mg/cm² | Process Black: Image Density | Graininess on Highlight Area | Image Uniformity |
|---|---|---|---|---|---|---|---|---|---|
| | | C | K | 0.25 | 1.8 | | | | |
| 13 | 40 | F | M | 0.35 | 1.8 | 1.04 | 1.8 | ○ | ○ |
| | | H | C | 0.35 | 1.7 | | | | |
| | | I | Y | 0.35 | 1.6 | | | | |
| | | G | K | 0.35 | 1.8 | | | | |
| Comp. 11 | 40 | L | M | 0.45 | 1.8 | 1.34 | 1.8 | Δ | Δ |
| Ex. | | N | C | 0.45 | 1.8 | | | | |
| | | O | Y | 0.45 | 1.6 | | | | |
| | | M | K | 0.45 | 1.8 | | | | |
| 12 | 40 | P | M | 0.65 | 1.8 | 1.95 | 1.8 | X | X |
| | | R | C | 0.65 | 1.8 | | | | |
| | | S | Y | 0.65 | 1.6 | | | | |
| | | Q | K | 0.65 | 1.8 | | | | |

From the above results, in Examples 12 to 15, in which full color images are obtained using the toner for developing an electrostatic latent image of the present invention, the TMA could be lowered even if three or four colors are overlaid. Further, a satisfactory full color image could be obtained which is excellent in graininess on highlight areas and has high image uniformity. In Examples 13 and 15, the pigment concentration is somewhat low and the TMA is somewhat high so as to satisfy the image density. Thus, the image thickness is somewhat large and both of the graininess on highlight parts and image uniformity are lowered compared with Examples 12 and 14. However, both are in the acceptable range and sufficiently satisfactory compared with the case where conventional toners are used.

To the contrary, with Comparative Examples 11 and 12, in which the coloring particles have a large volume average particle size, no problems with stability against the environment, powder flowability, and fogging are seen. However, the minute line reproducibility, gradation reproducibility, and image uniformity are low, and satisfactory image is not obtained.

Experiment 2

Examples 16 to 24 and Comparative Examples 13 to 19

Carrier preparation 1

100 parts by weight of a Cu—Zn ferrite microparticle having the volume average particle size of 40 μm is admixed with a methanol solution of 0.1 parts by weight of γ-aminopropyltriethoxysilane and coating is effected using a kneader, and then the silane compound is hardened completely by distilling methanol off followed by heating for 2 hours at 120° C. The particle thus obtained is admixed with perfluorooctylethyl methacrylate-methyl methacrylate copolymer (copolymerization ratio, 40:60 by weight) dissolved in toluene and subjected to a vacuum kneader to yield a resin-coated carrier having 0.5% by weight of the perfluorooctylethyl methacrylate-methyl methacrylate copolymer as a coating thereon.

Example 16

(1) Coloring particle preparation

Polyester resin A 90 parts by weight

Carbon black (primary average particle size: 40 nm) 10 parts by weight

The components shown above are mixed and kneaded, and the molten material is cooled, milled and classified to obtain black coloring particles having the volume average particle size of 3.5 μm containing 2.0% by number of the particles having a particle size of 5.0 μm or more, 88% by number of the particles having a particle size of 4.0 μm or less, and 3% by number of the particles having a particle size of 1.0 μm or less.

Polyester A described above is a bisphenol-A ethylene oxide adduct/cyclohexane dimethanol/terephthalic acid (molecular weight Mw=11,000, Mn=3,500, glass transition point=65° C., softening point=105° C.).

The particle size and the particle size distribution are determined using a Coulter counter model TA II manufactured by Coulter Co., Ltd. In this determination, a 100 μm aperture tube is used for a toner (coloring particle) having an average particle size exceeding 5 μm and a toner having an average particle size less than 5 μm is determined at the aperture size of 50 μm, and the frequency distribution of the particle having a size of 1 μm or less is determined at the aperture size of 30 μm. Particle size is determined similarly in the following examples and comparative examples.

(2) Preparation of developer for electrostatic latent image 100 parts by weight of the black coloring particles obtained are mixed with 1.9 parts by weight of silica ($SiO_2$) microparticles whose surface has been imparted with hydrophobicity using hexamethyldisilazane (HMDS) and whose primary particle size is 40 nm (true specific gravity: 2.2, coating rate based on the surface of the coloring particles: 25%) and 1.6 parts by weight of metatitanic acid compound microparticles which are the reaction product between metatitanic acid and i-butyltrimethoxysilane and whose primary particle size is 20 nm (true specific gravity: 3.2, coating rate based on the surface of the coloring particle: 30%) in a Henschel mixer to yield a black toner.

Metatitanic acid and i-butyltrimethoxysilane are reacted as described below. Thus, metatitanic acid slurry is admixed with 4 N aqueous solution of sodium hydroxide, adjusted at pH 9.0, stirred and then neutralized with 6 N hydrochloric acid. The mixture is filtered and the filter cake is washed and combined again with water to form a slurry, which is adjusted at pH 1.2 with 6 N hydrochloric acid, stirred for a certain period to effect peptization. The peptized slurry thus obtained is combined with i-butyltrimethoxysilane, stirred for a certain period, and then neutralized with 8 N aqueous solution of sodium hydroxide. The mixture is filtered and the filter cake is washed with water, dried at 150° C., milled using a jet mill, separated from coarse particles, thereby obtaining metatitanic acid compound microparticles which is the reaction product between metatitanic acid and i-butyltrimethoxysilane and whose primary particle size is 20 nm.

When the black toner thus obtained is examined by the CSG method for the frequency distribution of the q/d value at 20° C. and 50% humidity, the peak value is −0.342 and the bottom value is −0.153. When the frequency distribution of the q/d value is determined similarly also at a high temperature and a high humidity (30° C., 85% humidity also in the following description) and at a low temperature and a low humidity (10° C., 15% humidity also in the following description), the peak value and the bottom value at the high temperature and the high humidity are −0.324 and −0.144, respectively, and the peak value and the bottom value at the low temperature and the low humidity are −0.360 and −0.171, respectively (3) Preparation of developer for electrostatic latent image 4 parts by weight of the black toner obtained is mixed with 96 parts by weight of the carrier prepared in Carrier preparation 1 to produce a black two-component developer.

Using this two-component developer, the evaluations summarized below are made.

Example 17

(1) Preparation of magenta flushing pigment 70 parts by weight of polyester resin A and 75 parts by weight of a magenta pigment (C.I. Pigment Red 57:1) hydrated paste (% pigment, 40% by weight) are placed in a kneader and mixed with heating gently. Kneading is continued at 120° C., and, after allowing to separate the aqueous layer from the resin layer, water is removed and the resin layer is further kneaded to remove water, dehydrated to obtain a magenta flushing pigment.

(2) Preparation of coloring particle

Polyester resin A 70 parts by weight

Magenta flushing pigment obtained above 30 parts by weight (% pigment: 30% by weight)

Polyester resin A and the magenta flushing pigment shown above are mixed and kneaded, and the molten material is cooled, milled and classified to obtain magenta coloring particles.

A part of the magenta coloring particles are taken and observed by a transmission electron microscope at the magnification of 15,000 to take a photograph, which is then subject to evaluation by an image analyzer, which reveals that the pigment average disperse size of the coloring particles in the binder resin is 0.18 μm as a circle diameter. Utilizing the Coulter counter model TA II, it is determined that the volume average particle size of the coloring particles are 3.0 μm, the particles having a size of 5.0 μm or more are present in the amount of 0.7% by number, the particles having a size of 4.0 μm or less are present in the amount of 92% by number, and the particles having a size of 1.0 μm or less are present in the amount of 5% by number.

(3) Preparation of toner for developing electric latent image 100 parts by weight of the magenta coloring particles, 3.0 parts by weight of silica ($SiO_2$) microparticles whose surface has been imparted with hydrophobicity using HMDS and whose primary particle size is 40 nm (true specific gravity: 2.2, coating rate based on the surface of the coloring particle: 35%) and 2.5 parts by weight of metatitanic acid compound microparticles obtained as in Example 16 (coating rate based on the surface of the coloring particles: 40%) are mixed in a Henschel mixer to prepare a magenta toner.

When the magenta toner thus obtained is examined by the CSG method for the frequency distribution of the q/d value at 20° C. and 50% humidity, the peak value is −0.351 and the bottom value is −0.144. When the frequency distribution of the q/d value is determined similarly also at a high temperature and a high humidity and at a low temperature and a low humidity, the peak value and the bottom value at the high temperature and the high humidity are −0.324 and −0.135, respectively, and the peak value and the bottom value at the low temperature and the low humidity are −0.378 and −0.153, respectively.

(4) Preparation of developer for electrostatic latent image 4 parts by weight of the magenta toner obtained is mixed with 96 parts by weight of the carrier prepared in Carrier preparation 1 to produce a magenta developer.

Using this two-component developer, the various evaluations summarized below are made.

Example 18

(1) Preparation of toner for developing electric latent image 100 parts by weight of the magenta coloring particles obtained in Example 17, 2.6 parts by weight of silica ($SiO_2$) microparticles whose surface has been imparted with hydrophobicity using HMDS and whose primary particle size is 40 nm (true specific gravity: 2.2, coating rate based on the surface of the coloring particles: 30%) and 2.5 parts by weight of metatitanic acid compound microparticles obtained as in Example 16 (coating rate based on the surface of the coloring particles: 40%) are mixed in a Henschel mixer to prepare a magenta toner.

When the magenta toner thus obtained is examined by the CSG method for the frequency distribution of the q/d value at 20° C. and 50% humidity, the peak value is −0.315 and the bottom value is −0.153. When the frequency distribution of the q/d value is determined similarly also at a high temperature and a high humidity and at a low temperature and a low humidity, the peak value and the bottom value at the high temperature and the high humidity are −0.297 and −0.144, respectively, and the peak value and the bottom value at the low temperature and the low humidity are −0.324 and −0.163, respectively.

(2) Preparation of developer for electrostatic latent image 4 parts by weight of the magenta toner obtained is mixed with 96 parts by weight of the carrier prepared in Carrier preparation 1 to produce a magenta developer.

Using this two-component developer, the various evaluations summarized below are made.

Example 19

(1) Preparation of toner for developing electric latent image 100 parts by weight of the magenta coloring particle obtained in Example 17, 3.9 parts by weight of silica ($SiO_2$) microparticles whose surface has been imparted with hydrophobicity using HMDS and whose primary particle size is 40 nm (true specific gravity: 2.2, coating rate based on the surface of the coloring particles: 45%) and 1.9 parts by weight of metatitanic acid compound microparticles obtained as in Example 16 (coating rate based on the surface of the coloring particles: 30%) are mixed in a Henschel mixer to prepare a magenta toner.

When the magenta toner thus obtained is examined by the CSG method for the frequency distribution of the q/d value at 20° C. and 50% humidity, the peak value is −0.414 and the bottom value is −0.135. When the frequency distribution of the q/d value is determined similarly also at a high temperature and a high humidity and at a low temperature and a low humidity, the peak value and the bottom value at the high temperature and the high humidity are −0.378 and −0.128, respectively, and the peak value and the bottom value at the low temperature and the low humidity are −0.459 and −0.144, respectively.

(2) Preparation of developer for electrostatic latent image 4 parts by weight of the magenta toner obtained is mixed with 96 parts by weight of the carrier prepared in Carrier preparation 1 to produce a magenta developer.

Using this two-component developer, the various evaluations summarized below are made.

Example 20

(1) Preparation of cyan flushing pigment

A cyan flushing pigment is obtained in the manner similar to that in Example 17 except for using a cyan pigment (C.I. Pigment Blue 15:3) hydrated paste (% pigment, 40% by weight) instead of the magenta pigment (C.I. Pigment Red 57:1) hydrated paste employed in the preparation of the magenta flushing pigment in Example 17.

(2) Preparation of coloring particle

Cyan coloring particles are obtained in the manner similar to that in Example 17 except for using the cyan flushing particle obtained above instead of the magenta flushing pigment employed in the preparation of the magenta coloring pigment in Example 17.

A part of the cyan coloring particles are taken and observed by a transmission electron microscope at the magnification of 15,000 to take a photograph, which is then subject to evaluation by an image analyzer, reveals that the pigment average disperse size of the coloring particles in the binder resin is 0.1 μm as a circle diameter. Analysis with the Coulter counter model TA II reveals that the volume average particle size of the coloring particles is 3.2 μm, the particles having a size of 5.0 μm or more are present in the amount of 0.9% by number, the particles having a size of 4.0 μm or less are present in the amount of 90% by number, and the particles having a size of 1.0 μm or less are present in the amount of 6% by number.

(3) Preparation of toner for developing electric latent image 100 parts by weight of the cyan coloring particles, 2.9 parts by weight of silica ($SiO_2$) microparticles whose surface has been imparted with hydrophobicity using HMDS and whose primary particle size is 40 nm (true specific gravity: 2.2, coating rate based on the surface of the coloring particles: 35%) and 2.4 parts by weight of metatitanic acid compound microparticles obtained as in Example 16 (coating rate based on the surface of the coloring particles: 40%) are mixed in a Henschel mixer to prepare a cyan toner.

When the cyan toner thus obtained is examined by the CSG method for the frequency distribution of the q/d value at 20° C. and 50% humidity, the peak value is −0.405 and the bottom value is −0.144. When the frequency distribution of the q/d value is determined similarly also at a high temperature and a high humidity and at a low temperature and a low humidity, the peak value and the bottom value at the high temperature and the high humidity are −0.378 and −0.135, respectively, and the peak value and the bottom value at the low temperature and the low humidity are −0.432 and −0.162, respectively.

(4) Preparation of developer for electrostatic latent image 4 parts by weight of the cyan toner obtained is mixed with 96 parts by weight of the carrier prepared in Carrier preparation 1 to produce a magenta developer.

Using this two-component developer, the various evaluations summarized below are made.

Example 21

(1) Preparation of yellow flushing pigment

A yellow flushing pigment is obtained in the manner similar to that in Example 17 except for using an yellow pigment (C.I. Pigment Yellow 17) hydrated paste (% pigment, 40% by weight) instead of the magenta pigment (C.I. Pigment Red 57:1) hydrated paste employed in the preparation of the magenta flushing pigment in Example 17.

(2) Preparation of coloring particle

Yellow coloring particles are obtained in the manner similar to that in Example 17 except for using the yellow flushing particle obtained above instead of the magenta flushing pigment employed in the preparation of the magenta coloring pigment in Example 17.

A part of the yellow coloring particles are taken and observed by a transmission electron microscope at the magnification of 15,000 to take a photograph, which is then subject to evaluation by an image analyzer, reveals that the pigment average disperse size of the coloring particles in the binder resin is 0.2 μm as a circle diameter. Analysis with the Coulter counter model TA II reveals that the volume average particle size of the coloring particles is 3.5 μm, the particles having a size of 5.0 μm or more are present in the amount of 2.2% by number, the particles having a size of 4.0 μm or less are present in the amount of 88% by number, and the particles having a size of 1.0 μm or less are present in the amount of 8% by number.

(3) Preparation of toner for developing electric latent image 100 parts by weight of the yellow coloring particles, 2.6 parts by weight of silica ($SiO_2$) microparticles whose surface has been imparted with hydrophobicity using HMDS and whose primary particle size is 40 nm (true specific gravity: 2.2, coating rate based on the surface of the coloring particles: 35%) and 2.2 parts by weight of metatitanic acid compound microparticles obtained as in Example 16 (coating rate based on the surface of the coloring particles: 40%) are mixed in a Henschel mixer to prepare an yellow toner.

When the yellow toner thus obtained is examined by the CSG method for the frequency distribution of the q/d value at 20° C. and 50% humidity, the peak value is −0.369 and the bottom value is −0.162. When the frequency distribution of the q/d value is determined similarly also at a high temperature and a high humidity and at a low temperature and a low humidity, the peak value and the bottom value at the high temperature and the high humidity are −0.351 and −0.144, respectively, and the peak value and the bottom value at the low temperature and the low humidity are −0.405 and −0.180, respectively.

(4) Preparation of developer for electrostatic latent image 4 parts by weight of the yellow toner obtained is mixed with 96 parts by weight of the carrier prepared in Carrier preparation 1 to produce a magenta developer.

Using this two-component developer, the various evaluations summarized below are made.

Example 22

(1) Coloring particle preparation

Similarly to Example 17 except for using different conditions of milling and classification, magenta coloring particles whose pigment average disperse size in the binder resin is 0.18 μm as a circle diameter and whose volume average particle size of the coloring particle is 3.2 μm, and in which the particles having a size of 5.0 μm or more are present in the amount of 0.8% by number, the particles having a size of 4.0 μm or less in the amount of 90% by number, and the particles having a size of 1.0 μm or less in the amount of 4% by number are produced.

(2) Preparation of toner for developing electric latent image 100 parts by weight of the magenta coloring particles obtained above, 1.2 parts by weight of silica ($SiO_2$) microparticles whose surface has been imparted with hydrophobicity using HMDS and whose primary particle size is 40 nm (true specific gravity: 2.2, coating rate based on the surface of the coloring particle: 15%) and 0.9 parts by weight of metatitanic acid compound microparticles obtained as in Example 16 (coating rate based on the surface of the coloring particles: 15%) are mixed in a Henschel mixer to prepare a magenta toner.

When the magenta toner thus obtained is examined by the CSG method for the frequency distribution of the q/d value at 20° C. and 50% humidity, the peak value is −0.297 and the bottom value is −0.045. When the frequency distribution of the q/d value is determined similarly also at a high temperature and a high humidity and at a low temperature and a low humidity, the peak value and the bottom value at the high temperature and the high humidity are −0.198 and 0.018, respectively, and the peak value and the bottom value at the low temperature and the low humidity are −0.405 and 0.072, respectively.

(3) Preparation of developer for electrostatic latent image 4 parts by weight of the magenta toner obtained is mixed with 96 parts by weight of the carrier prepared in Carrier preparation 1 to produce a magenta developer.

Using this two-component developer, the various evaluations summarized below are made.

Example 23

(1) Coloring particle preparation

Similarly to Example 17 except for using different conditions of milling and classification, magenta coloring particles whose pigment average disperse size in the binder resin is 0.18 μm as a circle diameter and whose volume average particle size of the coloring particle is 3.2 μm, and in which the particles having a size of 5.0 μm or more are present in the amount of 1% by number, the particles having a size of 4.0 μm or less in the amount of 90% by number, and the particles having a size of 1.0 μm or less in the amount of 6% by number are produced.

(2) Preparation of toner for developing electric latent image 100 parts by weight of the magenta coloring particles obtained above and 2.5 parts by weight of silica ($SiO_2$) microparticles whose surface has been imparted with hydrophobicity using HMDS and whose primary particle size is 40 nm (true specific gravity: 2.2, coating rate based on the surface of the coloring particles: 30%) are mixed in a Henschel mixer to prepare a magenta toner.

When the magenta toner thus obtained is examined by the CSG method for the frequency distribution of the q/d value at 20° C. and 50% humidity, the peak value is −0.423 and the bottom value is 0.108. When the frequency distribution of the q/d value is determined similarly also at a high temperature and a high humidity and at a low temperature and a low humidity, the peak value and the bottom value at the high temperature and the high humidity are −0.360 and 0.090, respectively, and the peak value and the bottom value at the low temperature and the low humidity are −0.495 and 0.126, respectively.

(3) Preparation of developer for electrostatic latent image 4 parts by weight of the magenta toner obtained is mixed with 96 parts by weight of the carrier prepared in Carrier preparation 1 to produce a magenta developer.

Using this two-component developer, the various evaluations summarized below are made.

Comparative Example 13

(1) Coloring particle preparation

Similarly to Example 16 except for using different conditions of milling and classification, black coloring particles whose volume average particle size of the coloring particles is 8.2 μm, in which the particles having a size of 5.0 μm or more are present in the amount of 90.1% by number, the particles having a size of 4.0 μm or less in the amount of 4.2% by number, and the particles having a size of 1.0 μm or less in the amount of 0% by number is produced.

(2) Preparation of toner for developing electric latent image 100 parts by weight of the black coloring particles obtained above, 0.8 parts by weight of silica ($SiO_2$) microparticles whose surface has been imparted with hydrophobicity using HMDS and whose primary particle size is 40 nm (true specific gravity: 2.2, coating rate based on the surface of the coloring particles: 25%) and 0.7 parts by weight of metatitanic acid compound microparticles obtained as in Example 16 (coating rate based on the surface of the coloring particles: 30%) are mixed in a Henschel mixer to prepare a black toner.

When the black toner thus obtained is examined by the CSG method for the frequency distribution of the q/d value at 20° C. and 50% humidity, the peak value is −0.585 and the bottom value is −0.369. When the frequency distribution of the q/d value is determined similarly also at a high temperature and a high humidity and at a low temperature and a low humidity, the peak value and the bottom value at the high temperature and the high humidity are −0.549 and −0.342, respectively, and the peak value and the bottom value at the low temperature and the low humidity are −0.648 and −0.395, respectively.

(3) Preparation of developer for electrostatic latent image 8 parts by weight of the black toner obtained is mixed with 92 parts by weight of the carrier prepared in Carrier preparation 1 to produce a black two-component developer.

Using this two-component developer, the various evaluations summarized below are made.

Comparative Example 14

(1) Coloring particle preparation

Similarly to Example 16 except for using different conditions of milling and classification, black coloring particles whose volume average particle size of the coloring particle is 5.1 μm, in which the particles having a size of 5.0 μm or more are present in the amount of 23.1% by number, the particles having a size of 4.0 nm or less in the amount of 54% by number, and the particles having a size of 1.0 μm or less in the amount of 0% by number is produced.

(2) Preparation of toner for developing electric latent image 100 parts by weight of the black coloring particles obtained above, 1.8 parts by weight of silica ($SiO_2$) microparticles whose surface has been imparted with hydrophobicity using HMDS and whose primary particle size is 40 nm (true specific gravity: 2.2, coating rate based on the surface of the coloring particles: 35%) and 1.1 parts by weight of metatitanic acid compound microparticles obtained as in Example 16 (coating rate based on the surface of the coloring particles: 30%) are mixed in a Henschel mixer to prepare a black toner.

When the black toner thus obtained is examined by the CSG method for the frequency distribution of the q/d value at 20° C. and 50% humidity, the peak value is −0.450 and the bottom value is −0.198. When the frequency distribution of the q/d value is determined similarly also at a high temperature and a high humidity and at a low temperature and a low humidity, the peak value and the bottom value at the high temperature and the high humidity are −0.423 and −0.180, respectively, and the peak value and the bottom value at the low temperature and the low humidity are −0.486 and −0.225, respectively.

(3) Preparation of developer for electrostatic latent image 5 parts by weight of the black toner obtained is mixed with 95 parts by weight of the carrier prepared in Carrier preparation 1 to produce a black two-component developer.

Using this two-component developer, the various evaluations summarized below are made.

Comparative Example 15

(1) Coloring particle preparation

Similarly to Example 17 except for using different conditions of milling and classification, magenta coloring particles whose pigment average disperse size in the binder resin is 0.3 μm or less as a circle diameter and whose volume average particle size of the coloring particle is 7.5 μm, and in which the particles having a size of 5.0 μm or more are present in the amount of 84.6% by number, the particles having a size of 4.0 μm or less in the amount of 5% by number, and the particles having a size of 1.0 μm or less in the amount of 0% by number are produced.

(2) Preparation of toner for developing electric latent image 100 parts by weight of the magenta coloring particles obtained above, 1.1 parts by weight of silica ($SiO_2$) microparticles whose surface has been imparted with hydrophobicity using HMDS and whose primary particle size is 40 nm (true specific gravity: 2.2, coating rate based on the surface of the coloring particles: 30%) and 0.8 parts by weight of metatitanic acid compound microparticles obtained as in Example 16 (coating rate based on the surface of the coloring particles: 30%) are mixed in a Henschel mixer to prepare a magenta toner.

When the magenta toner thus obtained is examined by the CSG method for the frequency distribution of the q/d value at 20° C. and 50% humidity, the peak value is −0.558 and the bottom value is −0.369. When the frequency distribution of the q/d value is determined similarly also at a high temperature and a high humidity and at a low temperature and a low humidity, the peak value and the bottom value at the high temperature and the high humidity are −0.549 and −0.360, respectively, and the peak value and the bottom value at the low temperature and the low humidity are −0.585 and −0.378, respectively.

(3) Preparation of developer for electrostatic latent image 8 parts by weight of the magenta toner obtained is mixed with 92 parts by weight of the carrier prepared in Carrier preparation 1 to produce a magenta developer.

Using this two-component developer, the various evaluations summarized below are made.

Comparative Example 16

(1) Coloring particle preparation

Similarly to Example 20 except for using different conditions of milling and classification, cyan coloring particles whose pigment average disperse size in the binder resin is 0.3 μm or less as a circle diameter and whose volume average particle size of the coloring particles is 7.3 μm, and in which the particles having a size of 5.0 μm or more are present in the amount of 80.5% by number, the particles having a size of 4.0 μm or less in the amount of 9% by number, and the particles having a size of 1.0 μm or less in the amount of 0% by number are produced.

(2) Preparation of toner for developing electric latent image 100 parts by weight of the cyan coloring particles obtained above, 1.1 parts by weight of silica ($SiO_2$) microparticles whose surface has been imparted with hydrophobicity using HMDS and whose primary particle size is 40 nm (true specific gravity: 2.2, coating rate based on the surface of the coloring particles: 30%) and 0.8 parts by weight of metatitanic acid compound microparticles obtained as in Example 16 (coating rate based on the surface of the coloring particles: 30%) are mixed in a Henschel mixer to prepare a cyan toner.

When the cyan toner thus obtained is examined by the CSG method for the frequency distribution of the q/d value at 20° C. and 50% humidity, the peak value is −0.540 and the bottom value is −0.268. When the frequency distribution of the q/d value is determined similarly also at a high temperature and a high humidity and at a low temperature and a low humidity, the peak value and the bottom value at the high temperature and the high humidity are −0.513 and −0.270, respectively, and the peak value and the bottom value at the low temperature and the low humidity are −0.567 and −0.306, respectively.

(3) Preparation of developer for electrostatic latent image 8 parts by weight of the cyan toner obtained is mixed with 92 parts by weight of the carrier prepared in Carrier preparation 1 to produce a cyan developer.

Using this two-component developer, the various evaluations summarized below are made.

Comparative Example 17

(1) Coloring particle preparation

Similarly to Example 21 except for using different conditions of milling and classification, yellow coloring particles whose pigment average disperse size in the binder resin is 0.2 μm as a circle diameter and whose volume average particle size of the coloring particle is 7.7 μm, and in which the particles having a size of 5.0 μm or more are present in the amount of 86.2% by number, the particles having a size of 4.0 μm or less in the amount of 5% by number, and the particles having a size of 1.0 μm or less in the amount of 0% by number are produced.

(2) Preparation of toner for developing electric latent image 100 parts by weight of the yellow coloring particles obtained above, 1.1 parts by weight of silica ($SiO_2$) microparticles whose surface has been imparted with hydrophobicity using HMDS and whose primary particle size is 40 nm (true specific gravity: 2.2, coating rate based on the surface of the coloring particle: 30%) and 0.7 parts by weight of metatitanic acid compound microparticles obtained as in Example 16 (coating rate based on the surface of the coloring particles: 30%) are mixed in a Henschel mixer to prepare a yellow toner.

When the yellow toner thus obtained is examined by the CSG method for the frequency distribution of the q/d value at 20° C. and 50% humidity, the peak value is −0.594 and the bottom value is −0.342. When the frequency distribution of the q/d value is determined similarly also at a high temperature and a high humidity and at a low temperature and a low humidity, the peak value and the bottom value at the high temperature and the high humidity are −0.576 and −0.324, respectively, and the peak value and the bottom value at the low temperature and the low humidity are −0.621 and −0.360, respectively.

(3) Preparation of developer for electrostatic latent image 8 parts by weight of the yellow toner obtained is mixed with 92 parts by weight of the carrier prepared in Carrier preparation 1 to produce a yellow developer.

Using this two-component developer, the various evaluations summarized below are made.

Comparative Example 18

(1) Coloring particle preparation

Similarly to Example 17 except for using different conditions of milling and classification, magenta coloring particles whose pigment average disperse size in the binder resin is 0.18 μm as a circle diameter and whose volume average particle size of the coloring particle is 3.2 μm, and in which the particles having a size of 5.0 μm or more are present in the amount of 0.5% by number, the particles having a size of 4.0 μm or less in the amount of 95% by number, and the particles having a size of 1.0 μm or less in the amount of 25% by number are produced.

(2) Preparation of toner for developing electric latent image 100 parts by weight of the magenta coloring particles obtained above, 2.5 parts by weight of silica ($SiO_2$) microparticles whose surface has been imparted with hydrophobicity using HMDS and whose primary particle size is 40 nm (true specific gravity: 2.2, coating rate based on the surface of the coloring particles: 30%) and 2.4 parts by weight of metatitanic acid compound microparticles obtained as in Example 16 (coating rate based on the surface of the coloring particles: 40%) are mixed in a Henschel mixer to prepare a magenta toner.

When the magenta toner thus obtained is examined by the CSG method for the frequency distribution of the q/d value at 20° C. and 50% humidity, the peak value is −0.315 and the bottom value is 0.018. When the frequency distribution of the q/d value is determined similarly also at a high temperature and a high humidity and at a low temperature and a low humidity, the peak value and the bottom value at the high temperature and the high humidity are −0.297 and 0.000, respectively, and the peak value and the bottom value at the low temperature and the low humidity are −0.324 and 0.045, respectively.

(3) Preparation of developer for electrostatic latent image

4 Parts by weight of the magenta toner obtained is mixed with 96 parts by weight of the carrier prepared in Carrier preparation 1 to produce a magenta developer.

Using this two-component developer, the various evaluations summarized below are made.

The characteristics of the toners obtained in Examples 16 to 23 and Comparative Examples 13 to 18 are summarized in Table 4 and Table 5 shown below.

TABLE 4

| | | Characteristics of Coloring Particle | | | | | |
|---|---|---|---|---|---|---|---|
| | | Volume average | Particles larger | Particles of | Particles of | Colorant (Pigment particle) | |
| Example/ Comparative No. | | particle size (μm) | than 5.0 μm (% by no.) | 4.0 μm or less (% by no.) | 1.0 μm or less (% by no.) | Color | Average disperse size |
| Example | 16 | 3.5 | 2.0 | 88 | 3 | K | — |
| | 17 | 3.0 | 0.7 | 92 | 5 | M | 0.18 μm |
| | 18 | 3.0 | 0.7 | 92 | 5 | M | 0.18 μm |
| | 19 | 3.0 | 0.6 | 92 | 5 | M | 0.18 μm |
| | 20 | 3.2 | 0.9 | 90 | 6 | C | 0.1 μm |
| | 21 | 3.5 | 2.2 | 88 | 8 | Y | 0.2 μm |
| | 22 | 3.2 | 0.8 | 90 | 4 | M | 0.18 μm |
| | 23 | 3.2 | 1.0 | 90 | 6 | M | 0.18 μm |
| Comp. | 13 | 8.2 | 90.1 | 4.2 | 0 | K | — |
| Example | 14 | 5.1 | 23.1 | 54 | 0 | K | — |
| | 15 | 7.5 | 84.6 | 5 | 0 | M | 0.18 μm |
| | 16 | 7.3 | 80.5 | 8 | 0 | C | 0.1 μm |
| | 17 | 7.7 | 86.2 | 5 | 0 | Y | 0.2 μm |
| | 18 | 3.2 | 0.5 | 95 | 25 | M | 0.18 μm |

Legend for colors: K: Black, M: Magenta, C: Cyan, Y: Yellow

TABLE 5

| | | Characteristics of Vehicle | | | | | | Frequency Distribution of Toner q/d | | | | | |
|---|---|---|---|---|---|---|---|---|---|---|---|---|---|
| | | | | | | | | 20° C. and 50% RH | | High Temp. and High RH Environment, 30° C. and 85% RH | | Low Temp. and Low RH Environment, 10° C. and 15% RH | |
| | | Ultra Microparticle | | | Super-Ultra Microparticle | | | Peak | Btm. | Peak | Btm. | Peak | Btm. |
| Ex./Comp. | No. | ① | ② | ③ | ① | ② | ③ | Value | Value | Value | Value | Value | Value |
| Ex. | 16 | A | 40 nm | 25% | B | 20 nm | 30% | −0.342 | −0.513 | −0.324 | −0.144 | −0.360 | −0.171 |
| | 17 | A | 40 nm | 35% | B | 20 nm | 40% | −0.351 | −0.144 | −0.324 | −0.135 | −0.376 | −0.153 |
| | 18 | A | 40 nm | 30% | B | 20 nm | 40% | −0.315 | −0.153 | −0.297 | −0.144 | −0.324 | −0.162 |
| | 19 | A | 40 nm | 45% | B | 20 nm | 30% | −0.414 | −0.135 | −0.378 | −0.126 | −0.459 | −0.144 |
| | 20 | A | 40 nm | 35% | B | 20 nm | 40% | −0.405 | −0.144 | −0.378 | −0.135 | −0.432 | −0.162 |
| | 21 | A | 40 nm | 35% | B | 20 nm | 40% | −0.369 | −0.162 | −0.351 | −0.144 | −0.405 | −0.180 |
| | 22 | A | 40 nm | 15% | B | 20 nm | 15% | −0.297 | 0.045 | −0.198 | 0.018 | −0.405 | 0.072 |
| | 23 | A | 40 nm | 30% | — | — | — | −0.423 | 0.108 | −0.360 | 0.090 | −0.495 | 0.126 |
| Comp. | 13 | A | 40 nm | 25% | B | 20 nm | 30% | −0.585 | −0.369 | −0.549 | −0.342 | −0.648 | −0.396 |
| Ex. | 14 | A | 40 nm | 35% | B | 20 nm | 30% | −0.450 | −0.198 | −0.423 | −0.180 | −0.486 | −0.225 |
| | 15 | A | 40 nm | 30% | B | 20 nm | 30% | −0.558 | −0.369 | −0.549 | −0.360 | −0.585 | −0.378 |
| | 16 | A | 40 nm | 30% | B | 20 nm | 30% | −0.540 | −0.288 | −0.513 | −0.270 | −0.567 | −0.306 |
| | 17 | A | 40 nm | 30% | B | 20 nm | 30% | −0.594 | 0.342 | −0.576 | −0.324 | −0.621 | −0.360 |
| | 18 | A | 40 nm | 30% | B | 20 nm | 40% | −0.315 | 0.018 | −0.297 | 0.000 | −0.324 | 0.045 |

① Type
② Primary Particle Size
③ Coating Rate
A: HMDS-treated silica microparticle
B: Metatitanic acid compound is a reaction product of metatitanic acid with i-butyltrimethoxysilane Methods for various evaluations in Experiment 2

Each two-component developer obtained in each of Examples 16 to 23 and Comparative Examples 13 to 18 is used to evaluate the characteristics of the toner as shown below.

In the following evaluations, an ordinary non-coat full color paper is employed as a transfer material, together with a modified model of A color 935 manufactured by FUJI XEROX (modified to control the voltage upon development by means of external power source, hereinafter simply referred to as modified A color 935) as an image forming device.

Powder flowability evaluation

At a high temperature and a high humidity (30° C. and 85% RH) and at a low temperature and a low humidity (10° C. and 15% RH), 2 g of a toner is placed on a sieve of 75 μm mesh size, and subjected to 1 mm oscillation for 90 seconds to observe the behavior of falling powder, based on which the evaluation is made. The criteria for evaluation is as follows.

○: No toner remains on the sieve.

Δ: A slight amount of the toner remains on the sieve.

×: A substantial amount of the toner remains on the sieve.

Gradation reproducibility evaluation

A gradation image whose % image area is 10%, 20%, 30%, 40%, 50%, 60%, 70%, 80%, 90% or 100% is made and examined for its image density using X-Rite model 404 (manufactured by X-Rite Co., Ltd.) to evaluate the gradation. The images having 5% and 10% image area are observed also using VH-6200 microscope (*KEYENCE* Co., Ltd) at the magnification of 175 to evaluate the image reproducibility in a low % image area. Based on the results obtained in these tests, the gradation reproducibility is judged with the criteria for evaluation as shown below.

○: Both of the gradation and the image reproducibility in a low % image area are satisfactory.

Δ: The gradation reproducible range is somewhat limited and the image reproducibility in a low % image area is somewhat unstable.

×: The gradation reproducible range is limited and the image reproducibility in a low % image area is unstable.

Initial fogging evaluation

An image sample obtained at an initial stage of image forming is examined for fogging in a non-image area by evaluating the sample visually at a distance of 30 cm from the sample. Evaluation is made with the criteria shown below.

○: No fogging.

Δ: A slight fogging.

×: A substantial fogging.

Minute line reproducibility evaluation

Line interruption and edge sharpness when a 60 μm minute line image is formed are observed using a digital microscope model VH-6220 (*KEYENCE* Co., Ltd), Evaluation is made with the criteria as shown below.

◎: Minute lines are filled uniformly with the toner and no disturbed edges are observed.

○: Minute lines are filled uniformly with the toner but slightly jagged edges are observed.

Δ: Minute lines are filled almost uniformly with the toner but jagged edges are observed evidently.

×: Minute lines are not filled with the toner. Jagged edges are observed very evidently.

Image uniformity evaluation

The degree of the irregularity of the surface due to the difference in height between an imaged area and a non-imaged area is evaluated visually. The evaluation is made with the criteria shown below.

○: Uniformity is equivalent to that of offset printing.

Δ: Uniformity is slightly lower than that of offset printing.

×: Uniformity is markedly lower than that of offset printing.

Cleanability

Cleanability is designated as ○ when no poor cleaning occurs during reproducing 3,000 copies, and as × when it occurs.

Overall evaluation

Based on the results of various evaluations as described above, the toners are subjected to overall evaluation. The evaluation is made with the criteria shown below.

○: Satisfactory for all evaluation items.

×: The results are designated as "Δ" for at least one evaluation item.

The results of the evaluation of the toners obtained in Examples 16 to 23 and Comparative Examples 13 to 18 are summarized in Table 6 shown below.

invention exhibits a high environmental stability and a satisfactory powder flowability, and serves to form an image exhibiting excellence in minute line reproducibility, gradation reproducibility and image uniformity without fogging.

Thus the toner of any of Examples 16 to 23 of the present invention allows an extremely satisfactory image quality to be obtained constantly, and in Example 24 utilizing such toners to form a full color image, a satisfactory full color image exhibiting excellent minute line reproducibility without unusual impression due to the image thickness is obtained even when three colors are overlaid.

It should be noted here that Examples 22 and 23 correspond to toners in accordance with the first aspect of the present invention, although these toners do not satisfy the more preferred values of q/d in its frequency distribution. The toners of Examples 22 and 23 still exhibit excellent minute line reproducibilty and gradation reproducibility, although fogging is observed.

To the contrary, the coloring particles having a large volume average particle size of each of Comparative Examples 13 to 17 fail to provide a satisfactory image quality due to reduction in minute line reproducibility, gradation reproducibility and image uniformity, although it has almost no problems with regard to environmental stability, powder flowability or fogging. Also in Comparative Example 18, minute line reproducibility and gradation reproducibility are satisfactory but fogging is observed. This may be because of the positive bottom value of the q/d in its frequency distribution. Comparative Example 19, in which a toner having no aspect of the present invention as described above is used to form a full color image, underwent further reduction in minute line reproducibility due to overlaying three colors, accompanied with unusual impression due to the image thickness, thus failing to provide a satisfactory full color image.

TABLE 6

| Ex./Comp. No. | | Powder Flowability: High Temp. & High Humidity | Powder Flowability: Low Temp. & Low Humidity | Initial Fogging | Gradation Reproducibility | Minute Line Reproducibility | Image Uniformity | Cleanability | Overall Evaluation |
|---|---|---|---|---|---|---|---|---|---|
| Ex. | 16 | ○ | ○ | ○ | ○ | ◎ | ○ | ○ | ○ |
| | 17 | ○ | ○ | ○ | ○ | ◎ | ○ | ○ | ○ |
| | 18 | ○ | ○ | ○ | ○ | ◎ | ○ | ○ | ○ |
| | 19 | ○ | ○ | ○ | ○ | ◎ | ○ | ○ | ○ |
| | 20 | ○ | ○ | ○ | ○ | ◎ | ○ | ○ | ○ |
| | 21 | ○ | ○ | ○ | ○ | ◎ | ○ | ○ | ○ |
| | 22 | X | Δ | Δ | ○ | ◎ | Δ | ○ | X |
| | 23 | Δ | Δ | Δ | ○ | ◎ | Δ | ○ | X |
| Comp. | 13 | ○ | ○ | ○ | X | X | X | ○ | X |
| Ex. | 14 | ○ | ○ | ○ | Δ | Δ | Δ | ○ | X |
| | 15 | ○ | ○ | ○ | X | X | X | ○ | X |
| | 16 | ○ | ○ | ○ | X | X | X | ○ | X |
| | 17 | ○ | ○ | ○ | X | X | X | ○ | X |
| | 18 | Δ | Δ | Δ | ○ | ◎ | Δ | X | X |

Example 24

Each of black, magenta, cyan and yellow developers prepared in Examples 16, 17, 20 and 21, respectively, is subjected to copy test. The copy test is performed using modified A color 935 as an image forming device.

The developers are subjected to evaluation for full color image characteristics (minute line reproducibility, image uniformity) and also to overall evaluation. The methods and the criteria for evaluation are similar to those for Examples 16 to 23 and Comparative Examples 13 to 18. The results are indicated in Table 7 shown below.

Comparative Example 19

Each of black, magenta, cyan and yellow developers prepared in Comparative Examples 13, 15, 16 and 17, respectively, is subjected to the copy test and the evaluation similar to those in Example 24. The results are indicated in Table 7 shown below.

TABLE 7

| Ex./Comp. No. | Full Color Image Characteristics: Minute Line Reproducibility | Image Uniformity | Overall Evaluation |
|---|---|---|---|
| Example 24 | ◎ | ○ | ○ |
| Comparative Ex. 19 | X | X | X |

Discussion on results of Experiment 2

Based on the results described above, a toner for developing an electrostatic latent image according to the present Experiment 3

Examples 25 to 35 and Comparative Examples 20 to 25

(1) Preparation of flushing pigment

Magenta flushing pigment 70 parts by weight of polyester resin A (bisphenol-A polyester, weight average molecular weight: 11,000, number average molecular weight: 3,500, Tg: 65° C.) and 75 parts by weight of a magenta pigment (C.I. Pigment Red 57: 1)

hydrated paste (% pigment, 62% by weight) are placed in a kneader and mixed with heating gently. Kneading is continued at 120° C., and, after allowing to separate the aqueous layer from the resin layer, water is removed and the resin layer is further kneaded to remove water, and dehydrated to obtain a magenta flushing pigment.

Cyan flushing pigment

A cyan flushing pigment is obtained in the manner similar to that employed for the magenta flushing pigment except for using a cyan pigment (C.I. Pigment Blue 15:3) hydrated paste (% pigment, 62% by weight) instead of the magenta pigment hydrated paste.

Yellow flushing pigment

A yellow flushing pigment is obtained in the manner similar to that employed for the magenta flushing pigment except for using an yellow pigment (C.I. Pigment Yellow 17) hydrated paste (% pigment, 62% by weight) instead of the magenta pigment hydrated paste.

(2) Preparation of coloring particle

Coloring particle preparation 1

Polyester resin (bisphenol-A polyester, weight average molecular weight: 11,000, number average molecular weight: 3,500, Tg: 65° C.) 75 parts by weight Magenta pigment described above 25 parts by weight The components shown above are kneaded by a Banbury mixer, cooled, milled by a jet mill and then classified by a blower to produce the coloring particles in different conditions of milling and classification, namely, coloring particle A, B, F and L which have respective particle size distributions shown in Table 8.

Coloring particle preparation 2

Coloring particle D indicated in Table 8 is obtained in the manner similar to that in Coloring particle preparation 1 except for using the cyan flushing pigment instead of the magenta flushing pigment. The conditions of milling and classification are adjusted to obtain the particle size distribution shown in Table 8.

Coloring particle preparation 3

Coloring particle E indicated in Table 8 is obtained in the manner similar to that in Coloring particle preparation 1 except for using 70 parts by weight of the polyester resin and using 30 parts by weight of the yellow flushing pigment instead of 25 parts by weight of the magenta flushing pigment. The conditions of milling and classification are adjusted to obtain the particle size distribution shown in Table 8.

Coloring particle preparation 4

Coloring particle C indicated in Table 8 is obtained in the manner similar to that in Coloring particle preparation 1 except for using 91 parts by weight of the polyester resin and using 9 parts by weight of a carbon black (average primary particle size: 40 nm) instead of 25 parts by weight of the magenta flushing pigment. The conditions of milling and classification are adjusted to obtain the particle size distribution shown in Table 8.

Coloring particle preparation 5

Coloring particle G indicated in Table 8 is obtained in the manner similar to that in Coloring particle preparation 1 except for using 80 parts by weight of the polyester resin and 20 parts by weight of the magenta flushing pigment. The conditions of milling and classification are adjusted to obtain the particle size distribution shown in Table 8.

Coloring particle preparation 6

Coloring particle H indicated in Table 8 is obtained in the manner similar to that in Coloring particle preparation 1 except for using 90 parts by weight of the polyester resin and 10 parts by weight of the magenta flushing pigment. The conditions of milling and classification are adjusted to obtain the particle size distribution shown in Table 8.

Coloring particle preparation 7

Coloring particle J indicated in Table 8 is obtained in the manner similar to that in Coloring particle preparation 2 except for using 90 parts by weight of the polyester resin and 10 parts by weight of the cyan flushing pigment. The conditions of milling and classification are adjusted to obtain the particle size distribution shown in Table 8.

Coloring particle preparation 8

Coloring particle K indicated in Table 8 is obtained in the manner similar to that in Coloring particle preparation 3 except for using 88.5 parts by weight of the polyester resin and 12.5 parts by weight of the yellow flushing pigment. The conditions of milling and classification are adjusted to obtain the particle size distribution shown in Table 8.

Coloring particle preparation 9

Coloring particle I indicated in Table 8 is obtained in the manner similar to that in Coloring particle preparation 4 except for using 97 parts by weight of the polyester resin and 3 parts by weight of the carbon black. The conditions of milling and classification are adjusted to obtain the particle size distribution shown in Table 8.

TABLE 8

| Type of Coloring Particle | Volume Average Particle Size (μm) | Particles Larger Than 5.0 μm (% by number) | Particles of 4.0 μm or less (% by number) | Particles of 1.0 μm orless (% by number) | Color or Colorant |
|---|---|---|---|---|---|
| Coloring Particle A | 3.2 | 0.8 | 96.4 | 3.8 | M |
| Coloring Particle B | 3.6 | 2.2 | 89.6 | 3.0 | M |
| Coloring Particle C | 3.5 | 1.8 | 91.5 | 3.2 | K |
| Coloring Particle D | 3.6 | 1.6 | 90.8 | 2.9 | C |
| Coloring Particle E | 3.6 | 1.7 | 90.6 | 2.9 | Y |
| Coloring Particle F | 4.4 | 8.9 | 76.2 | 2.1 | M |
| Coloring Particle G | 5.7 | 28.4 | 44.3 | 1.8 | M |
| Coloring Particle H | 7.8 | 84.1 | 8.2 | 0.4 | M |
| Coloring Particle I | 8.2 | 89.2 | 4.7 | 0.3 | K |
| Coloring Particle J | 7.5 | 80.1 | 9.6 | 0.4 | C |
| Coloring Particle K | 7.6 | 81.1 | 9.1 | 0.5 | Y |
| Coloring Particle L | 2.8 | 1.0 | 99.1 | 25.4 | M |

Legend for colors: K: Black, M: Magenta, C: Cyan, Y: Yellow

Preparation of toner for developing electrostatic latent image (1) Additives

In Experiment 3, ultra microparticles A and super-ultra microparticles B to E shown below are employed as external additive components.

A: Silica microparticles whose surface is imparted with hydrophobicity using HMDS ($SiO_2$, primary average particle size: 40 nm, true specific gravity: 2.2)

B: Silica microparticles whose surface is imparted with hydrophobicity using HMDS ($SiO_2$, primary average particle size: 20 nm, true specific gravity: 2.2)

C: Metatitanic acid microparticles whose surface is imparted with hydrophobicity using i-butyltrimethoxysilane (primary average particle size: 25 nm, true specific gravity: 3.2)

D: Metatitanic acid microparticles whose surface is imparted with hydrophobicity using i-butyltrimethoxysilane and fluorosilane (primary average particle size: 25 nm, true specific gravity: 3.2)

E: Rutile type titanium oxide microparticle whose surface is imparted with hydrophobicity using decylsilane (primary average particle size: 25 nm, true specific gravity: 3.9)

(2) Toner preparation

Coloring particles A to G are mixed in a Henschel mixer with Additive components A to E in the combinations and in the condition indicated in Table 9 shown below to produce Toners 1 to 17.

Each of Toners 1 to 17 is examined by the CSG method for the frequency distribution of the q/d value at 20° C. and 50% humidity. Each of Toners 1 to 17 are also examined for the aggregation degree. The results are summarized in Table 9 shown below.

average particle size of 40 μm employed in Carrier preparation 1 in Experiment 1 described above.

Carrier b

Carrier b is obtained in the manner similar to that in Carrier preparation 1 except for using γ-aminopropyltriethoxysilane in the amount of 0.5 parts by weight instead of 0.1 parts by weight employed in Carrier preparation 1 in Experiment 1 described above.

Example 25

A two-component developer (2-1) is produced by mixing 100 parts by weight of Carrier a and 4 parts by weight of Toner 1 using a V-mixer.

Example 26

A two-component developer (2-2) is produced in the manner similar to that in Example 25 except for using 4 parts by weight of Toner 2 instead of 4 parts by weight of Toner 1.

Example 27

A two-component developer (2-3) is produced in the manner similar to that in Example 25 except for using 4 parts by weight of Toner 3 instead of 4 parts by weight of Toner 1.

Example 28

A two-component developer (2-4) is produced in the manner similar to that in Example 25 except for using 4 parts by weight of Toner 4 instead of 4 parts by weight of Toner 1.

TABLE 9

| | | Vehicle Components | | | | | | Frequency Distribution of toner q/d (20° C. and 50% RH) | | |
|---|---|---|---|---|---|---|---|---|---|---|
| | | Ultra Microparticles | | | Super-Ultra Microparticles | | | | | |
| Toner | Coloring Particle | ① | ② | ③ | ① | ② | ③ | Peak Value | Bottom Value | Aggregation Degree |
| Toner 1 | Coloring Particle A | A | 40 nm | 40% | D | 25 nm | 40% | −0.315 | −0.144 | 15.4 |
| Toner 2 | Coloring Particle B | A | 40 nm | 40% | D | 25 nm | 40% | −0.360 | −0.180 | 12.8 |
| Toner 3 | Coloring Particle C | A | 40 nm | 40% | D | 25 nm | 40% | −0.351 | −0.171 | 11.9 |
| Toner 4 | Coloring Particle D | A | 40 nm | 40% | D | 25 nm | 40% | −0.342 | −0.162 | 12.2 |
| Toner 5 | Coloring Particle E | A | 40 nm | 40% | C | 25 nm | 40% | −0.450 | −0.216 | 12.9 |
| Toner 6 | Coloring Particle F | A | 40 nm | 40% | D | 25 nm | 40% | −0.450 | −0.243 | 10.7 |
| Toner 7 | Coloring Particle B | A | 40 nm | 15% | D | 25 nm | 30% | −0.342 | −0.216 | 10.6 |
| Toner 8 | Coloring Particle B | A | 40 nm | 40% | E | 25 nm | 40% | −0.261 | −0.108 | 28.9 |
| Toner 9 | Coloring Particle G | A | 40 nm | 20% | C | 25 nm | 35% | −0.486 | −0.270 | 10.2 |
| Toner 10 | Coloring Particle H | A | 40 nm | 20% | E | 25 nm | 35% | −0.558 | −0.315 | 8.1 |
| Toner 11 | Coloring Particle I | A | 40 nm | 20% | D | 25 nm | 35% | −0.648 | −0.360 | 7.2 |
| Toner 12 | Coloring Particle J | A | 40 nm | 20% | D | 25 nm | 35% | −0.576 | −0.297 | 8.5 |
| Toner 13 | Coloring Particle K | A | 40 nm | 20% | D | 25 nm | 35% | −0.684 | −0.432 | 8.3 |
| Toner 14 | Coloring Particle B | A | 40 nm | 40% | — | — | — | −0.342 | 0.072 | 42.1 |
| Toner 15 | Coloring Particle L | A | 40 nm | 40% | D | 25 nm | 40% | −0.288 | 0.000 | 25.4 |
| Toner 16 | Coloring Particle F | — | — | — | B | 20 nm | 100% | −1.008 | −0.045 | 6.9 |
| Toner 17 | Coloring Particle B | A | 40 nm | 10% | C | 25 nm | 10% | −0.189 | 0.036 | 31.2 |

① Type
② Primary Particle Size
③ Coating Rate

Carrier preparation

Carrier a

Carrier a is obtained in the manner similar to that in Carrier preparation 1 except for using Cu—Zn ferrite microparticle having the volume average particle size of 35 μm instead of Cu—Zn ferrite microparticle having the volume Example 29

A two-component developer (2-5) is produced in the manner similar to that in Example 25 except for using 4 parts by weight of Toner 5 instead of 4 parts by weight of Toner 1.

Example 30

A two-component developer (2-6) is produced in the manner similar to that in Example 25 except for using 4 parts by weight of Toner 6 instead of 4 parts by weight of Toner 1.

Example 31

A two-component developer (2-7) is produced in the manner similar to that in Example 25 except for using 4 parts by weight of Toner 7 instead of 4 parts by weight of Toner 1.

Example 32

A two-component developer (2-8) is produced in the manner similar to that in Example 25 except for using 4 parts by weight of Toner 8 instead of 4 parts by weight of Toner 1.

Example 33

A two-component developer (2-14) is produced in the manner similar to that in Example 25 except for using 4 parts by weight of Toner 14 instead of 8 parts by weight of Toner 1.

Example 34

A two-component developer (2-16) is produced in the manner similar to that in Example 25 except for using Carrier b instead of Carrier a and using 5 parts by weight of Toner 16 instead of 8 parts by weight of Toner 1.

Example 35

A two-component developer (2-17) is produced in the manner similar to that in Example 25 except for using 4 parts by weight of Toner 17 instead of 8 parts by weight of Toner 1.

Comparative Example 20

A two-component developer (2-9) is produced in the manner similar to that in Example 25 except for using 6 parts by weight of Toner 9 instead of 4 parts by weight of Toner 1.

Comparative Example 21

A two-component developer (2-10) is produced in the manner similar to that in Example 25 except for using 8 parts by weight of Toner 10 instead of 4 parts by weight of Toner 1.

Comparative Example 22

A two-component developer (2-11) is produced in the manner similar to that in Example 25 except for using 8 parts by weight of Toner 11 instead of 4 parts by weight of Toner 1.

Comparative Example 23

A two-component developer (2-12) is produced in the manner similar to that in Example 25 except for using 8 parts by weight of Toner 12 instead of 8 parts by weight of Toner 1.

Comparative Example 24

A two-component developer (2-13) is produced in the manner similar to that in Example 25 except for using 8 parts by weight of Toner 13 instead of 8 parts by weight of Toner 1.

Comparative Example 25

A two-component developer (2-15) is produced in the manner similar to that in Example 25 except for using 4 parts by weight of Toner 15 instead of 8 parts by weight of Toner 1.

Methods for various evaluations in Experiment 3

Each of two-component developers (2-1) to (2-17) obtained in Examples 25 to 35 and Comparative Examples 20 to 25 is evaluated using modified A-color 935 at 22° C/55% RH. J Coat paper (FUJI XEROX) is used and the condition of the device is adjusted so that the image density of an image having the image area of 100% is 1.5 or more after fixing.

Initial fogging evaluation

An image sample obtained at an initial stage of image forming is examined for fogging in a non-image area by evaluating the sample visually at a distance of 30 cm from the sample. Evaluation is made with the criteria shown below. The results indicated by ⊚ and ○ are considered to be acceptable.

⊚: No fogging.

○: A slight fogging is noted when observed closely.

Δ: A fogging is somewhat evident.

×: A fogging is evident.

××: A fogging is very evident.

Minute line reproducibility evaluation

A line image is formed at the line interval of 50 μm on a photoconductor, and transferred to a transfer material and then fixed. The line image formed on the transfer material is observed using model VH-6220 Microhighscope (*KEYENCE* Co., Ltd) at the magnification of 175. Evaluation is made with the criteria as shown below. The results indicated by G1 and G2 are considered to be acceptable.

G1: Minute lines are filled uniformly with the toner and no disturbed edges are observed.

G2: Minute lines are filled uniformly with the toner but slightly jagged edges are observed.

G3: Minute lines are filled uniformly with the toner but jagged edges are observed evidently.

G4: Minute lines are not filled uniformly with the toner and jagged edges are observed evidently.

G5: Minute lines are not filled uniformly with the toner and jagged edges are observed very evidently.

Transfer efficiency evaluation

A 2 cm×5 cm solid patch is developed and transferred, and then the toner remaining on the photoconductor is transferred onto a tape and weighed to obtain the residual toner amount, α(g), and the transferred toner amount, β(g), is also obtained by weighing the toner on the paper, and then the transfer efficiency (%) is calculated according to the equation shown below.

$$\text{Transfer efficiency } (\%) = \beta/(\alpha+\beta)\times 100$$

Solid image uniformity evaluation

An image is evaluated visually and judged as any one of degrees G1 (Good) to G5 (Poor) with reference to a limit sample. The results indicated by G1 and G2 are considered to be acceptable.

Gradation reproducibility evaluation

A gradation image whose % image area is 10%, 20%, 30%, 40%, 50%, 60%, 70%, 80%, 90% or 100% is made and examined for its image density using X-Rite model 404 (manufactured by X-Rite Co., Ltd.) to evaluate the gradation. The images having 5% and 10% image area are observed also using VH-6200 microscope (*KEYENCE* Co., Ltd) at the magnification of 175 to evaluate the image reproducibility in a low % image area. Based on the results obtained in these tests, the gradation reproducibility is judged with the criteria for evaluation as shown below.

G1: Both of the gradation and the image reproducibility in a low % image area are satisfactory.

G2: Satisfactory gradation is obtained but the image in a low % image area are somewhat unstable.

G3: The gradation reproducible range is somewhat limited in a low % image area and the image in a low % image area is somewhat unstable.

G4: The gradation reproducible range is somewhat limited in high and low % image areas and the image in a low % image area is somewhat unstable.

G5: The gradation reproducible range is limited in high and low % image areas and the image in a low % image area is unstable.

Cleanability

Cleanability is designated as ○ when no poor cleaning occurs during reproducing 3,000 copies, and as × when it occurs.

The results of the evaluations described above are summarized in Table 10 and Table 11 shown below.

TABLE 10

| | | Developer for Electrostatic Latent Image | | | | Results | | |
|---|---|---|---|---|---|---|---|---|
| | | Toner | | Carrier | | Initial | Minute Line | Transfer |
| Ex./Comp. | No. | No. | Parts by Weight | Type | Parts by Weight | Fogging | Reproducibility | Efficiency (%) |
| Ex. | 25 | 1 | 4 | a | 100 | ◎ | G1 | 91.8 |
| | 26 | 2 | 4 | a | 100 | ◎ | G1 | 92.5 |
| | 27 | 3 | 4 | a | 100 | ◎ | G1 | 93.0 |
| | 28 | 4 | 4 | a | 100 | ◎ | G1 | 92.7 |
| | 29 | 5 | 4 | a | 100 | ◎ | G1 | 91.8 |
| | 30 | 6 | 5 | a | 100 | ◎ | G2 | 93.6 |
| | 31 | 7 | 4 | a | 100 | ◎ | G1 | 85.6 |
| | 32 | 8 | 4 | a | 100 | ○ | G1 | 90.7 |
| | 33 | 14 | 4 | a | 100 | XX | G1 | 88.7 |
| | 34 | 16 | 5 | b | 100 | ○ | G3 | 71.2 |
| | 35 | 17 | 4 | a | 100 | X | G1 | 79.4 |
| Comp. | 20 | 9 | 6 | a | 100 | ◎ | G3 | 91.2 |
| Ex. | 21 | 10 | 8 | a | 100 | ◎ | G4 | 93.2 |
| | 22 | 11 | 8 | a | 100 | ◎ | G4.5 | 94.4 |
| | 23 | 12 | 8 | a | 100 | ○ | G4 | 92.6 |
| | 24 | 13 | 8 | a | 100 | ◎ | G4 | 91.8 |
| | 25 | 15 | 4 | a | 100 | Δ | G1 | 88.9 |

TABLE 11

| | | Developer for Electrostatic Latent Image | | | | Results | | |
|---|---|---|---|---|---|---|---|---|
| | | Toner | | Carrier | | Solid Image | Gradation | |
| Ex./Comp. | No. | No. | Parts by Weight | Type | Parts by Weight | Uniformity | Reproducibility | Cleanability |
| Ex. | 25 | 1 | 4 | a | 100 | G1 | G1 | ○ |
| | 26 | 2 | 4 | a | 100 | G1 | G1 | ○ |
| | 27 | 3 | 4 | a | 100 | G1 | G1 | ○ |
| | 28 | 4 | 4 | a | 100 | G1 | G1 | ○ |
| | 29 | 5 | 4 | a | 100 | G1 | G1 | ○ |
| | 30 | 6 | 5 | a | 100 | G2 | G2 | ○ |
| | 31 | 7 | 4 | a | 100 | G1 | G1 | ○ |
| | 32 | 8 | 4 | a | 100 | G1 | G1 | ○ |
| | 33 | 14 | 4 | a | 100 | G2 | G2 | ○ |
| | 34 | 16 | 5 | b | 100 | G4 | G3 | ○ |
| | 35 | 17 | 4 | a | 100 | G1 | G2 | ○ |
| Comp. | 20 | 9 | 6 | a | 100 | G3 | G3 | ○ |
| Ex. | 21 | 10 | 8 | a | 100 | G4 | G5 | ○ |
| | 22 | 11 | 8 | a | 100 | G4 | G5 | ○ |
| | 23 | 12 | 8 | a | 100 | G4 | G5 | ○ |
| | 24 | 13 | 8 | a | 100 | G4 | G5 | ○ |
| | 25 | 15 | 4 | a | 100 | G1 | G1 | X |

Based on the results described above, a toner for developing an electric latent image according the present invention can provide an image which is free from initial fogging, exhibits excellent minute line reproducibility and gradation reproducibility, achieves a higher efficiency and provides a uniform solid image.

Accordingly, by using a toner obtained in any of Examples 25 to 30 and 32, a very satisfactory image quality can be achieved. The toner obtained in Example 30 exhibits the minute line reproducibility which is somewhat lower than those in other examples, because of a slightly larger volume average particle size of the coloring particles. The toner obtained in Example 32 exhibits poorer results with regard to the initial fogging when compared with other Examples, because of the bottom value of the q/d frequency distribution which is slightly more near zero value than in other Examples, as well as a slightly higher aggregation degree of the toner. Nevertheless, both Examples 30 and 32 are well within the acceptable range.

Also when using the toner obtained in Example 31, an image of a satisfactory quality is obtained, but the transfer efficiency is slightly poorer when compared with other Examples due to a smaller amount of the ultra microparticle being added as an external additive than in other Examples. Nevertheless, the toner is well within the acceptable range.

As to Examples 33–35, these Examples have the preferred particle size and particle size distribution for the coloring particles according to the first aspect, but do not have the more preferred aspect with respect to the external additive. Example 33 contains no super-ultra microparticles while Example 34 contains no ultra microparticles. Example 35 does not satisfy the external additive coating rates. Example 34 also lacks the more preferred q/d frequency distribution since it has a larger absolute value of the peak value of the q/d frequency distribution. However, these Examples still exhibit excellent minute line reproducibility and cleanability, although the transfer efficiency is lower.

To the contrary, any of the coloring particles in Comparative Examples 20 to 24 which have larger particle sizes result in an image which is not satisfactory due to its poor minute line reproducibility and poor solid image uniformity, although it has no problems with regard to the initial fogging or the transfer efficiency.

Comparative Example 25 exhibits improved minute line reproducibility and solid image uniformity due to a sufficiently reduced volume average particle sizes, it is not satisfactory with regard to the initial fogging and/or the transfer efficiency since it lacks the preferred q/d frequency distribution and external additive properties. In this Comparative Example, as well as Examples 33 and 35 above, the bottom values of the frequency distributions of the q/d values are positive values. Comparative Example 28 in which coloring particles of a size exceeding 1.0 μm are present in an amount exceeding 20% by number also does not have the preferred particle size distribution. Accordingly, it exhibits initial fogging.

A toner for developing an electric latent image according to the present invention exhibits excellent minute line reproducibility and gradation, provides an image without fogging, and has an excellent durability. Also according to the present invention, a toner for developing an electrostatic latent image whose charging characteristics are not subjected to the effects of temperature and humidity, which is readily charged and which maintains a sharp charge distribution even when a toner is newly added into the developing unit can be provided, and thus is suitable especially in the development of a digital latent image.

By employing a toner for developing an electrostatic latent image and a method for forming an image using the same according to the present invention, an image quality as high as that by achieved offset printing or even higher can be achieved.

Experiment 4

Examples 36–40 and Comparative Examples 26–28

Carrier Preparation 100 parts by weight of a Cu—Zn ferrite microparticle having a volume average particle size of 40 μm is admixed with a methanol solution of 0.1 parts by weight of (α-aminopropyltriethoxysilane and coating is effected using a kneader, methanol is distilled off, and then the above silane compound is hardened completely by heating for 2 hours at 120° C. The particles are admixed with perfluorooctylethyl methacrylate-methyl methacrylate copolymer (copolymerization ratio, 40:60 by weight) dissolved in toluene and subjected to a vacuum kneader to yield a resin-coated carrier having 0.5% by weight of the perfluorooctylethyl methacrylate-methyl methacrylate copolymer as a coating thereon.

Non-color transparent toner preparation

Polyester resin A is pulverized and classified to yield non-color transparent particles having a volume average size of 5 μm. 100 parts by weight of the non-color transparent particles obtained are mixed with 0.98 parts by weight of a silica ($SiO_2$) microparticle whose surface has been imparted with hydrophobicity using hexamethyldisilazane and whose average primary particle size is 40 nm (true specific gravity: 2.2) and 1.26 parts by weight of metatitanic acid compound microparticle which is the reaction product between metatitanic acid and i-butyltrimethoxysilane (20 parts by weight i-butyltrimethoxysilane to 10 parts by weight of metatitanic acid) and whose average primary particle size is 20 nm (true specific gravity: 3.2) in a Henschel mixer to yield a non-color transparent toner.

The Polyester A described above is a bisphenol-A ethylene oxide adduct/cyclohexane dimethanol/terephthalic acid having a molecular weight Mw=l 1,000, Mn=3,500, glass transition point=65° C. and softening point=105° C.

Metatitanic acid and i-butyltrimethoxysilane are reacted as described below. Thus, metatitanic acid slurry is admixed with 4 N aqueous solution of sodium hydroxide, adjusted to a pH 9.0, stirred and then neutralized with 6 N hydrochloric acid. The mixture is filtered and the materials obtained on the filter are washed with water and combined again with water to form a slurry, which is adjusted to a pH 1.2 with 6 N hydrochloric acid, and stirred for a certain period to effect peptization. The peptized slurry thus obtained is combined with i-butyltrimethoxysilane, stirred for a certain period, and then neutralized with 8 N aqueous solution of sodium hydroxide. The mixture is filtered and the materials obtained on the filter are washed with water, dried at 150° C., milled using a jet mill, separated from coarse particles, thereby obtaining a metatitanic acid compound microparticle which is the reaction product between metatitanic acid and i-butyltrimethoxysilane and whose average primary particle size is 20 nm.

White Toner Preparation

Polyester resin A 80 parts by weight

Rutile type titanium oxide (average primary particle size: 0.25 μm) 20 parts by weight The mixture comprising the above components is made molten and kneaded. The kneaded mixture is cooled, pulverized and classified to yield white particles having an volume average particle size of 5 μm. 100 parts by weight of the white particles are mixed with 0.98 parts by weight of a silica microparticles whose surface has been imparted with hydrophobicity using hexamethyldisilazane and whose average primary particle is 40 nm and 1.26 parts by weight of the above metatitanic acid compound microparticles in a Henschel mixer to yield a white toner.

Preparation of developer for surface-smoothing step 100 parts by weight of resin-coated type carrier prepared in the above described carrier preparation is mixed with each of 3 parts by weight of the both toners obtained in the above described non-color toner preparation and white toner preparation, respectively, to yield non-color transparent and white developers for use in the surface-smoothing step.

Preparation of developers for electrostatic latent image

A. Color toner Preparation (1) Preparation of flushing pigment

Magenta flushing pigment 70 parts by weight of polyester resin (bisphenol-A type polyester: bisphenol A ethylene oxide adduct-cyclohexane dimethanol-terephthalic acid, molecular weight Mw=1 1,000, Mn=3,500, glass transition point=65° C. and 75 parts by weight of a magenta pigment (C.I. Pigment Red 57:1) hydrated paste (% pigment, 40% by weight) are placed in a kneader and mixed with heating gently. Kneading is continued at 120° C., and, after allowing to separate the aqueous layer from the resin layer, water is removed and the resin phase is further kneaded to remove water, and dehydrated to obtain a magenta flushing pigment.

Cyan flushing pigment

Cyan flushing pigment is prepared in the same manner as the magenta flushing pigment except that cyan pigment (C.I. pigment blue 15:3) hydrated paste (% pigment, 40% by weight) is used in place of the magenta pigment hydrated paste.

Yellow flushing pigment

Yellow flushing pigment is prepared in the same manner as the magenta flushing pigment except that yellow pigment (C.I. pigment yellow 17) hydrated paste (% pigment, 40% by weight) is used in place of the magenta pigment hydrated paste.

(2) Preparation of coloring particle

Preparation 1 of coloring particle

Polyester resin (bisphenol-A type polyester: bisphenol A ethylene oxide adduct-cyclohexane dimethanol-terephthalic acid, molecular weight Mw=1 1,000, Mn=3,500, glass transition point =65° C.) 66.7 parts by weight The above cyan flushing pigment (% pigment, 40% by weight)

33.3 parts by weight

The above components are made molten and kneaded with Banbury mixer, cooled, pulverized with a jet mill and classified with an air classifier to yield a coloring particle C1. The conditions of pulverization and classification are controlled so as to have the particle size distribution shown in the following Table 12.

The particle size and the particle size distribution are determined using a Coulter counter model TA-II manufactured by Coulter Co., Ltd. In this determination, a 100 μm aperture tube is used for a toner (coloring particle) having an average particle size exceeding 5 μm and a toner having an average particle size less than 5 μm is determined at the aperture size of 50 μm, and the frequency distribution of the particle having a size of 1 μm or less is determined at the aperture size of 30 μm. The particle size is determined similarly in the following Examples and Comparative Examples.

Preparation 2 of coloring particle

Coloring particle M1 shown in the following Table 12 is prepared in the same manner as described in the Preparation 1 of coloring particle except that magenta flushing pigment is used in place of cyan flushing pigment. The conditions of pulverization and classification are controlled so as to have the particle size distribution shown in the following Table 12.

Preparation 3 of coloring particle

Coloring particle Y1 shown in the following Table 12 is prepared in the same manner as described in the Preparation 1 of coloring particle except that 50 parts by weight of the polyester resin is used and that 50 parts by weight of yellow flushing pigment is used in place of 25 parts by weight of the cyan flushing pigment. The conditions of pulverization and classification are controlled so as to have the particle size distribution shown in the following Table 12.

Preparation 4 of coloring particle

Coloring particle K1 shown in the following Table 12 is prepared in the same manner as described in the Preparation 1 of coloring particle except that 90 parts by weight of the polyester resin is used and that 10 parts by weight of carbon black (primary particle average size: 40 nm) is used in place of 25 parts by weight of cyan flushing pigment. The conditions of pulverization and classification are controlled so as to have the particle size distribution shown in the following Table 12.

Preparation 5 of coloring particle

Coloring particle C2 shown in the following Table 12 is prepared in the same manner as described in the Preparation 1 of coloring particle except that 86.7 parts by weight of the polyester resin is used and that 13.3 parts by weight of the cyan flushing pigment is used. The conditions of pulverization and classification are controlled so as to have the particle size distribution shown in the following Table 12.

Preparation 6 of coloring particle

Coloring particle M2 shown in the following Table 12 is prepared in the same manner as described in the Preparation 2 of coloring particle except that 86.7 parts by weight of the polyester resin is used and that 13.3 parts by weight of the magenta flushing pigment is used. The conditions of pulverization and classification are controlled so as to have the particle size distribution shown in the following Table 12.

Preparation 7 of coloring particle

Coloring particle Y2 shown in the following Table 12 is prepared in the same manner as described in the Preparation 3 of coloring particle except that 83.3 parts by weight of the polyester resin is used and that 16.7 parts by weight of the yellow flushing pigment is used. The conditions of pulverization and classification are controlled so as to have the particle size distribution shown in the following Table 12.

Preparation 8 of coloring particle

Coloring particle K2 shown in the following Table 12 is prepared in the same manner as described in the Preparation 4 of coloring particle except that 97 parts by weight of the polyester resin is used and that 3 parts by weight of the carbon black is used. The conditions of pulverization and classification are controlled so as to have the particle size distribution shown in the following Table 12.

In the following Table 12, pigment concentration C (%) in each coloring particle, true specific gravity a of each coloring particle, aDC calculated from these values and the volume average particle size D (μm) of the coloring particles, and average particle size (circle diameter: μm) of dispersed particles in binder resin of pigment microparticles, as well as the description as regard to particle size of each coloring particle obtained above, are summarized.

TABLE 12

| Coloring Particle | Volume Average Particle Size | Particle Exceeding 5.0 μm (% by number) | Particle of 1.0 to 2.5 μm (% by number) | Particle less than 1.0 μm (% by number) | Color of colorant* | Pigment concentration C (%) | True specific gravity a | aDC | Pigment dispersion size (μm)** |
|---|---|---|---|---|---|---|---|---|---|
| C1 | 3.6 | 1.6 | 38.0 | 2.9 | C | 10 | 1.24 | 44.5 | 0.23 |
| M1 | 3.6 | 2.2 | 36.5 | 3.0 | M | 10 | 1.24 | 44.6 | 0.20 |
| Y1 | 3.6 | 1.7 | 37.3 | 2.9 | Y | 15 | 1.25 | 67.5 | 0.20 |
| K1 | 3.5 | 2.0 | 41.2 | 3.0 | K | 10 | 1.20 | 42.0 | — |
| C2 | 7.5 | 78.0 | 0.0 | 0.0 | C | 4 | 1.22 | 36.0 | 0.21 |
| M2 | 7.8 | 80.1 | 0.0 | 0.0 | M | 4 | 1.22 | 38.1 | 0.24 |
| Y2 | 7.6 | 81.1 | 0.0 | 0.0 | Y | 5 | 1.21 | 46.0 | 0.24 |
| K2 | 8.2 | 89.2 | 0.0 | 0.0 | K | 3 | 1.20 | 29.5 | — |

*color K: black, M: magenta, C: cyan, Y: yellow
**pigment dispersion size is an average particle size of dispersion particle in a binder resin of pigment microparticles (circle diameter: μm)

(3) Preparation of Color toner

Each of the above described coloring particles is admixed with a silica ($SiO_2$) microparticle whose surface has been imparted with hydrophobicity using hexamethyldisilazane (HMDS) and whose average primary particle size is 40 nm and metatitanic acid compound microparticle which is the reaction product between metatitanic acid and i-butyltrimethoxysilane and whose average primary particle size is 20 nm so as to have a coating rate to the surface of each of the coloring particles of 40%, and mixed in a Henschel mixer to yield color toners C1 and 2, M1 and 2, Y1 and 2, and K1 and 2, respectively. The symbols of C1 and 2, M1 and 2, Y1 and 2, and K1 and 2 attached to each color toner obtained correspond to each of the symbols of C1 and 2, M1 and 2, Y1 and 2, and K1 and 2 of the coloring particles used, respectively.

The term coating rate to the surface of coloring particle means herein a value F (%) calculated by the above-mentioned Formula (1).

With respect to each of the color toners obtained, the frequency distribution of the q/d value is determined in an atmosphere of at a temperature of 20° C. and a humidity of 50 %. The each peak value and bottom value obtained are shown in the following Table 13.

TABLE 13

| Toner | Frequency Distribution of q/d Value (20° C./50% RH) Peak Value | Bottom Value |
|---|---|---|
| C1 | −0.342 | −0.162 |
| M1 | −0.360 | −0.180 |
| Y1 | −0.450 | −0.216 |
| K1 | −0.351 | −0.171 |
| C2 | −0.576 | −0.297 |
| M2 | −0.558 | −0.315 |
| Y2 | −0.684 | −0.432 |
| K2 | −0.648 | −0.360 |

B. Preparation of a developer for electrostatic latent image 100 parts by weight of the resin-coated carrier prepared in the above described Carrier Preparation is mixed with 4 parts by weight of each of the toners C1, M1, Y1 and K1 obtained in the above described Preparation of color toner to yield a developer for electrostatic latent image C1, M1, Y1 and K1, respectively. Further, 100 parts by weight of the resin-coated carrier prepared in the above described Carrier Preparation is mixed with 8 parts by weight of each of the toners C2, M2, Y2 and K2 obtained in the above described Preparation of color toner to yield a developer for electrostatic latent image C2, M2, Y2 and K2, respectively. The symbols of C1 and 2, M1 and 2, Y1 and 2, and K1 and 2 attached to each developer for electrostatic latent image obtained correspond to each of the symbols of C1 and 2, M1 and 2, Y1 and 2, and K1 and 2 of the color toners used, respectively.

Example 36

Copy test is made by using each of the above developers for electrostatic latent image C1, M1, Y1 and K1 for cyan, magenta, yellow and black as a developer and a coat paper for full-color printing (ten point average surface roughness Rz=9 μm, whiteness degree: 80%) as a transfer material, respectively. The copy test is carried out using a Modified A color 935 (manufactured by Fuji Xerox Co., Ltd.) as an image forming machine (which is modified so as to control electric voltage at the time of developing with an external power source), controlling parameters for developing and transferring properly, and forming each image described below. The content and results of evaluation tests are described below.

(Image 1)

4 kinds of single-color images (containing minute line having a line width of 50 μm in an image) which are primary color (single color) images of each color toner of cyan, magenta, yellow and black, are formed by developing, transferring and fixing so that the TMA on a transfer material on a region having an image area rate of 100% has the values for each color shown in the following Table 14.

(Image 2)

4 kinds of solid images having an image area rate of 100% and a minute line having a line width of 50 μm comprising each secondary color (3 kinds) of red, blue and green and tertiary color of process black (1 kind) are formed under the same conditions of developing of the each color toner as described above (Image 1).

(Image 3)

Gradation images are formed as to each single color (3 kinds) of cyan, magenta and yellow; each secondary color (3 kinds) of red, blue and green; tertiary color (1 kind) of process black under the same conditions of the each color toner as described above (Image 1). The gradation images formed are to have standards of image area rates of 5%, 15%, 30%, 50%, 75%, 80% and 90%.

(Image 4)

Picture images in which different image area rates images are intermixed, are formed under the same conditions of the each color toner as described above (Image 1).

The method for determining TMA on an area having an image area rate of 100% of a transfer material is as follows. Method for determining TMA on an area having an image area rate of 100% on a transfer material Forming each image of primary, secondary and tertiary color having an image area rate of 100%, the parameters for developing and transferring are controlled so as to have an image density after fixing of 1.8, and a sample in an un-fixed state is extracted. The obtained un-fixed sample is weighed (A; mg), an un-fixed toner on a transfer material is removed off with air-blow, a weight of only the transfer material is determined (B; mg), the TMA (mg/cm$^2$) is calculated from the weight difference of before and after of the removal of the un-fixed toner (A-B: mg).

Example 37

A copy test is made as in the same manner as Example 36 except that a coat paper for full-color printing (whiteness degree: 85%) having a ten point average surface roughness of Rz=5 $\mu$m as a transfer material is used, the TMA values on an area having an image area rate of 100% on a transfer material of each single toner are controlled to have the values as shown in the following Table 14, and the developing conditions for each color toner for (Image 2) to (Image 4) are controlled to correspond to them.

Example 38

A modified A color 935 manufactured by Fuji Xerox Co., Ltd. is used as an image forming machine for copy test in which a surface-smoothing developing device which can form a non-color transparent toner or white color toner on a paper surface is incorporated. In the surface-smoothing developing device, a developer for surface-smoothing step is incorporated.

The image forming device has a structure which can form previously a layer comprising a non-color transparent toner or a white toner on the entirety of one side of a transfer material on which an image is to be formed before forming a full-color image. As a concrete structure, a solid image of a non-color transparent toner or a white toner is formed on an entirety of the surface of a latent image support with a surface-smoothing developing machine, and it is transferred to a transfer material to form a layer of a non-color transparent toner or a white toner.

On the transfer material on which a non-color transparent toner layer or a white toner layer is formed in this way, a toner image comprising color toner is transferred to be fixed in the fixing step. The non-color transparent toner layer or a white toner layer is heated to be fixed with a fixing roll in the step fixing toner image with color toners to cover the concave parts of the surface of the transfer material having a ten point average surface roughness Rz exceeding 10 $\mu$m, so that the embedding of the color toners in the concave parts can be prevented effectively. The ten point average surface roughness Rz of the surface of the transfer material on which a non-color transparent toner layer or a white toner layer is formed, can be obtained by forming only a non-color transparent toner layer or a white toner layer is formed and determining it as to the surface of the transfer material on which it is fixed.

A copy test is made as in the same manner as described in Example 36, except that a developer for the surface-smoothing step (non-color and transparent) described in the Preparation of developer for the surface-smoothing step is used as a developer for surface-smoothing step, each of the developers of the above described developers for electrostatic latent image of C1, M1, Y1 and K1 of cyan, magenta, yellow and black is used as a developer for image forming, a coat paper for full-color printing (ten point average surface roughness Rz=9 $\mu$m, whiteness degree: 80%) is used as a transfer material, the TMA value of a region having an image area rate of 100% of each single toner of (Image 1) in Example 36 on the transfer material is controlled to be a value shown in the following Table 14, and the developing conditions for each color toner of (Image 2) to (Image 4) are matched to it. The toner weight of the non-color transparent toner is 0.3 mg/cm$^2$, and the ten point average surface roughness Rz after forming the layer is 6 $\mu$m, and the whiteness degree is 80%.

Example 39

A copy test is made as in the same manner as described in Example 36, except that the same image forming device similar as Example 38 is used, a developer for surface-smoothing step (white) described in the Preparation of developer for surface-smoothing step is used as a developer for surface-smoothing step, each of the developers of the above described electrostatic latent image developer C1, M1, Y1 and K1 of cyan, magenta, yellow and black is used as a developer for image forming, a coat paper for monochrome printing (ten point average surface roughness Rz=16 $\mu$m, whiteness degree: 75%) is used as a transfer material, the TMA value of a region having an image area rate of 100% of each single toner of (Image 1) of Example 36 on the transfer material is controlled to be a value shown in the following Table 14, and the developing conditions for each color toner of (Image 2) to (Image 4) are matched to it. The toner weight of the non-color transparent toner is 0.4 mg/cm$^2$, and the ten point average surface roughness Rz after forming the layer is 9 $\mu$m, and the whiteness degree is 89%.

Example 40

A copy test is made as in the same manner as described in Example 36, except that a non-coat paper for monochrome printing having ten point average surface roughness Rz=16 $\mu$m (whiteness degree: 75%) is used as a transfer material, the TMA value of a region having an image area rate of 100% of each single toner of (Image 1) of Example 36 on the transfer material is controlled to be a value shown in the following Table 14, and the developing conditions for each color toner of (Image 2) to (Image 4) are matched to it.

Comparative Example 26

A copy test is made as in the same manner as described in Example 36, except that each of the developers of the above described developers for electrostatic latent image of C2, M2, Y2, and K2 of cyan, magenta, yellow and black is used as a developer, a non-coat paper for full-color printing having ten point average surface roughness Rz=13 $\mu$m (whiteness degree: 84%) is used as a transfer material, the TMA value of a region having an image area rate of 100% of each single toner of (Image 1) of Example 36 on the transfer material is controlled to be a value shown in the following Table 14, and the developing conditions for each color toner of (Image 2) to (Image 4) are matched to it.

Comparative Example 27

A copy test is made as in the same manner as described in Example 36, except that each of the developers of the above described developers for electrostatic latent image of C2, M2, Y2, and K2 of cyan, magenta, yellow and black is used as a developer, a coat paper for full-color printing having ten point average surface roughness Rz=5 μm (whiteness degree: 80%) is used as a transfer material, the TMA value of a region having an image area rate of 100% of each single toner of (Image 1) of Example 36 on the transfer material is controlled to be a value shown in the following Table 14, and the developing conditions for each color toner of (Image 2) to (Image 4) are matched to it.

Comparative Example 28

A copy test is made as in the same manner as described in Example 36, except that an image forming device similar to Example 38 is used, a developer for surface-smoothing step (non-color and transparent) described in the Preparation of developer for surface-smoothing step is used as a developer for surface-smoothing step, each of the developers of the above described developers for electrostatic latent image of C2, M2, Y2 and K2 of cyan, magenta, yellow and black is used as a developer for image forming, a coat paper for full-color printing (ten point average surface roughness Rz=9 μm, whiteness degree: 80%) is used as a transfer material, the TMA value of a region having an image area rate of 100% of each single toner of (Image 1) of Example 36 on the transfer material is controlled to be a value shown in the following Table 14, and the developing conditions for each color toner of (Image 2) to (Image 4) are matched to it. The toner weight of the non-color transparent toner is 0.3 mg/cm $^2$, and the ten point average surface roughness Rz after forming the layer is 6 μm, and the whiteness degree is 80%.

TABLE 14

| | | TMA on a Region Having An Image Area Rate of 100% (mg/cm$^2$) | | | |
|---|---|---|---|---|---|
| | | Cyan | Magenta | Yellow | Black |
| Example | 36 | 0.25 | 0.26 | 0.30 | 0.25 |
| | 37 | 0.26 | 0.25 | 0.31 | 0.26 |
| | 38 | 0.23 | 0.27 | 0.32 | 0.26 |
| | 39 | 0.24 | 0.25 | 0.31 | 0.25 |
| | 40 | 0.31 | 0.31 | 0.40 | 0.33 |
| Comparative Example | 26 | 0.65 | 0.66 | 0.68 | 0.72 |
| | 27 | 0.60 | 0.63 | 0.62 | 0.71 |
| | 28 | 0.59 | 0.61 | 0.65 | 0.70 |

Methods and results of evaluation tests

The methods of evaluation tests in the copy tests in Examples 36 to 40 and Comparative Examples 26 to 28, are as follows:

Image Density

As to the solid image area having an image area rate of 100% obtained in (Image 1), the image density of the image area is determined with an X-Rite 404 (manufactured by X-Rite Co., Ltd.).

Minute line reproducibility evaluation test

At the time of image forming in (Image 1) and (Image 2), line images for cyan, magenta, yellow, black (single color), red, green, blue and process black are formed so as to have a line width of 50 μm on a photoconductor, and transferred to a transfer material and then fixed. The line image of the fixed image formed on the transfer material is observed using a VH-6220 Microhighscope (*KEYENCE* Co., Ltd.) at the magnification of 500. Evaluation is made with the criteria as shown below.

○: Center of minute lines is satisfactorily filled with toner and no disturbed edges are observed.

Δ: Center of minute lines is satisfactorily filled with toner but jagged edges are observed.

×: Center of minute lines is not satisfactorily filled and jagged edges are observed to be very evident.

Gradation reproducibility evaluation test

At the time of image forming of (Image 3), the density of gradation image at in-put time and that of gradation image formed (out-put) on a transfer material are determined, and the variations of the gradation are evaluated. The image density is determined with a X-Rite 404 (manufactured by X-Rite Co., Ltd.). Evaluation is made with the criteria as shown below.

○: Both the gradation of the reproduced area and the gradation curve are satisfactory in the evaluation area.

Δ: The gradation in the reproduced area is somewhat limited on a low-image area rate region and a high-image area rate region in the evaluation area.

×: The gradation in the reproduced range is limited on a low-image area rate region and a high-image area rate region in the evaluation area.

Graininess on highlight region

The gradation images having standards of 5% and 10% of image area rate of the gradation image obtained in (Image 3) are formed, the obtained images are observed visually, and the graininess on highlight region is evaluated. Evaluation is made with the criteria as shown below.

○: Graininess for 5% and 10% are very satisfactory.

Δ: Graininess for 5% is somewhat unsatisfactory.

×: Graininess for 5% and 10% are unsatisfactory.

Color reproducibility evaluation test

As to each of the regions having image area rate of 100% of cyan, magenta, yellow and black (single color) and red, green, blue and process black for (Image 1) and (Image 2), the color reproducibility is determined with a 968 Spectrophotometer manufactured by X-rite Co., Ltd. Evaluation is made with the criteria as shown below.

○: Color reproducibility is satisfactory (having a color reproducibility equal to or higher than the color reproduced region by 175 line offset printing).

Δ: Color reproducible range is somewhat limited (having a color reproducibility equal to the color reproduced region by 175 line offset printing).

×: Color reproducibility is unsatisfactory (the color reproduced region by 175 line offset printing can not be reproduced).

Image glossiness uniformity evaluation test

As to each of the images of (Image 1), (Image 2) and (Image 3), the difference between the image glossiness of a transfer material and the image region of tertiary color having image density of 1, 2 or more, and the difference between the image glossiness of the image region of the primary color having an image density of 1, 2 or more and the image glossiness of the image region of the tertiary color having an image density of 1, 2 or more, are evaluated organoleptically, respectively. Evaluation is made with the criteria as shown below.

◎: Image glossiness difference is low and satisfactory (which is almost equal to that of an image obtained by offset printing).

○: Image glossiness is slightly high but non-uniform impression is low.

Δ: Image glossiness of the image region of tertiary color is too high and non-uniform image impression is felt, compared with an image obtained by offset printing.

×: Different image quality impression from an image obtained by offset printing is shown since the image glossiness difference in an image region is large.

Image quality evaluation test for picture image

As to the picture image obtained in (Image 4), a comparison of image quality with an image obtained by 175 line offset printing is made by an organoleptic evaluation. Evaluation is made with the criteria as shown below.

◎: Image quality impression is equal to or higher than that of an image obtained by 175 line offset printing.

○: Image quality impression is slightly inferior to that of an image obtained by 175 line offset printing.

Δ: Image quality impression is inferior to that of an image obtained by 175 line offset printing.

×: Image quality impression is different from that of an image obtained by 175 line offset printing.

Image offset evaluation test

Image offset evaluation test is made using an apparatus so modified that a temperature setting of heating roll and pressure roll of A color 935 can be controlled optionally and the fixing temperature can be monitored. Concretely, at the time of image forming of (Image 3), an un-fixed image of a gradation image is formed, the temperature of the heating roll and the pressure roll is set at 160° C., the fixing speed is controlled to be the same as A color 935, and the evaluation of image offset is made. Evaluation is made with the criteria as shown below.

○: Offset does not occur.

Δ: Offset slightly occurs, but is cleaned sufficiently with a roll cleaning mechanism and is not transferred to the transfer material.

×: Offset occurs.

The results of the above evaluation tests are shown in the following Tables 15A and 15B.

With the method for forming an image according to the present invention, an image having no fogging can be formed, and minute line reproducibility and gradation are rendering satisfactory, a uniform image glossiness corresponding to the surface glossiness of a transfer material itself can be obtained, and image quality equal to or higher than an image formed by offset printing can be achieved, with a small-sized toner for developing an electrostatic latent image having a high transfer efficiency and an excellent durability.

In addition, with the method for forming an image according to the present invention, even with a transfer material having a rough surface state, the minute line reproducibility and gradation can be satisfactory and image quality equal to or higher than an image formed by offset printing can be achieved.

What is claimed is:

1. A toner for developing an electrostatic latent image comprising coloring particles containing a colorant and a binder resin, wherein a volume average particle size of the coloring particles is 1.0 to 5.0 μm, wherein coloring particles having a particle size of 1.0 μm or less are present in an amount of 20% by number or less of a total number of coloring particles and coloring particles having a particle size exceeding 5.0 μm are present in an amount of 10% by number or less of the total number of coloring particles, and wherein the colorant is a pigment.

2. A toner for developing an electrostatic latent image according to claim 1, wherein coloring particles having a particle size of 1.0 μm to 2.5 μm are present in an amount of 5% to 50% by number.

TABLE 15A

| Example/ Comp. Ex. | | Developer | Transfer material Surface Rz (μm) | Transfer material Whiteness (%) | Surface-smoothing process | Rz after treatment (μm) | Whiteness (%) | Image Density C | Image Density M | Image Density Y | Image Density K |
|---|---|---|---|---|---|---|---|---|---|---|---|
| Ex. | 36 | | 9 | 80 | None | — | — | 1.6 | 1.6 | 1.4 | 1.5 |
| | 37 | C1 | 5 | 85 | None | — | — | 1.8 | 1.8 | 1.6 | 1.7 |
| | 38 | M1 Y1 | 9 | 80 | Non-color transparent | 5 | 80 | 1.7 | 1.8 | 1.6 | 1.7 |
| | 39 | K1 | 16 | 75 | White | 9 | 89 | 1.6 | 1.6 | 1.4 | 1.5 |
| | 40 | | 16 | 75 | None | — | — | 1.4 | 1.4 | 1.3 | 1.4 |
| Comp. Ex. | 26 | C2 | 9 | 80 | None | — | — | 1.7 | 1.8 | 1.7 | 1.7 |
| | 27 | M2 Y2 | 5 | 85 | None | — | — | 1.8 | 1.9 | 1.6 | 1.8 |
| | 28 | K2 | 9 | 80 | Non-color transparent | 5 | 80 | 1.8 | 1.8 | 1.6 | 1.8 |

TABLE 15B

| Example/ Comp. Ex. | | Minute Line Reproducibility | Gradation Reproducibility | Highlight Region Graininess | Color Reproducibility | Image Glossiness Uniformity | Image Quality of Picture | Image Offset |
|---|---|---|---|---|---|---|---|---|
| Ex. | 36 | ○ | ○ | ○ | ○ | ○ | ○ | ○ |
| Ex. | 37 | ○ | ○ | ○ | ○ | ◎ | ◎ | ○ |
| Ex. | 38 | ○ | ○ | ○ | ○ | ◎ | ◎ | ○ |
| Ex. | 39 | ○ | ○ | ○ | ○ | ○ | ○ | ○ |
| Ex. | 40 | ○ | ○ | ○ | Δ | ○ | Δ | Δ |
| Comp. Ex. | 26 | X | X | X | ○ | X | X | ○ |
| Comp. Ex. | 27 | X | X | X | ○ | X | X | ○ |
| Comp. Ex. | 28 | X | X | X | ○ | X | X | ○ |

3. A toner for developing an electrostatic latent image according to claim 1, wherein coloring particles having a particle size of 4.0 μm or less are present in an amount of 75% by number or more.

4. A toner for developing an electrostatic latent image according to claim 1, wherein an average particle diameter of the pigment in the coloring particles is 0.3 μm or less.

5. A toner for developing an electrostatic latent image according to claim 1, wherein a q/d in a frequency distribution, at a temperature of 20° C. and a humidity of 50%, has a peak value of 1.0 or less and a bottom value of 0.005 or more, wherein q represents the electric charge quantity of said toner for developing electrostatic latent image in fC and d represents the volume average particle size of the coloring particles for developing electrostatic latent image in μm.

6. A toner for developing an electrostatic latent image according to claim 1, wherein a concentration of the pigment in the coloring particles, C (% by weight), a true specific gravity of the coloring particles, a (g/cm$^3$), and the volume average particle size of the coloring particles, D (μm), fulfill the relationship represented by the formula $$25 \leqq a \cdot D \cdot C \leqq 90.$$

7. A toner for developing an electrostatic latent image comprising coloring particles containing a colorant and binder resin, wherein (a) a volume average particle size of the coloring particles is 1.0 to 5.0 μm, and (b) a q/d in a frequency distribution, at a temperature of 20° C. and a humidity of 50%, has a peak value of 1.0 or less and a bottom value of 0.005 or more, wherein q represents the electric charge quantity of said toner for developing electrostatic latent image in fC and d represents the volume average particle size of the coloring particles for developing electrostatic latent image in μm.

8. A toner for developing an electrostatic latent image according to claim 7, wherein the peak value of q/d in a frequency distribution is 0.80 or less.

9. A toner for developing an electrostatic latent image according to claim 7, wherein the bottom value of q/d in a frequency distribution is 0.01 or more.

10. A toner for developing an electrostatic latent image according to claim 7, wherein coloring particles having a particle size of 1.0 μm or less are present in an amount of 20% by number or less of a total number of coloring particles, and coloring particles having a particle size exceeding 5.0 μm are present in an amount of 10% by number or less of the total number of coloring particles.

11. A toner for developing an electrostatic latent image according to claim 7, wherein an aggregation degree of the toner for developing an electrostatic latent image is 30 or less.

12. A toner for developing an electrostatic latent image according to claim 7, wherein the toner further comprises an external additive, and wherein (a) the external additive comprises at least one type of ultra microparticles having an average primary particle size of 30 nm to 200 nm and at least one type of super-ultra microparticles having an average primary particle size of 5 nm or more and less than 30 nm, and (b) coating rates, Fa and Fb, of the external additive based on a surface of the coloring particles obtained according to Formula (1)

$$F=\sqrt{3}\cdot D\cdot \rho_\tau\cdot(2\pi\cdot z\cdot \rho_\sigma)^{-1}\cdot C\times 100 \quad (1)$$

wherein F denotes a coating rate (%), D denotes the volume average particle size of the coloring particles (μm), $\rho_\tau$ denotes a true specific gravity of the coloring particles, z denotes an average primary particle size of the additive, $\rho_{94}$ denotes the true specific gravity of an additive, and C denotes the ratio (x/y) of the weight of the additive, x (g), to the weight of the coloring particles, y (g), for the ultra microparticles and the super-ultra microparticles, respectively, are both 20% or more, and the total of the coating rate of the entire additive is 100% or less.

13. A toner for developing an electrostatic latent image comprising coloring particles containing a colorant and binder resin, and an external additive, wherein (a) a volume average particle size of the coloring particles is 1.0 to 5.0 μm, and wherein coloring particles having a particle size of 1.0 μm or less are present in an amount of 20% by number or less of a total number of coloring particles, and coloring particles having a particle size exceeding 5.0 μm are present in an amount of 10% by number or less of the total number of coloring particles, (b) the external additive comprises at least one type of ultra microparticles having an average primary particle size of 30 nm to 200 nm and at least one type of super-ultra microparticles having an average primary particle size of 5 nm or more and less than 30 nm, and (c) coating rates, Fa and Fb, of the external additive based on a surface of the coloring particles obtained according to Formula (1)

$$F=\sqrt{3}\cdot D\cdot \rho_\tau\cdot(2\pi\cdot z\cdot \rho_\sigma)^{-1}\cdot C\times 100 \quad (1)$$

wherein F denotes a coating rate (%), D denotes the volume average particle size of the coloring particles (μm), $\rho_\tau$ denotes a true specific gravity of the coloring particles, z denotes an average primary particle size of the additive, $\rho_\sigma$ denotes the true specific gravity of an additive, and C denotes the ratio (x/y) of the weight of the additive, x (g), to the weight of the coloring particles, y (g), for the ultra microparticles and the super-ultra microparticles, respectively, are both 20% or more, and the total of the coating rate of the entire additive is 100% or less.

14. A toner for developing an electrostatic latent image according to claim 13, wherein the coating rate of the ultra microparticles, Fa (%), and the coating rate of the super-ultra microparticles, Fb (%), are satisfy $0.5 \leqq Fb/Fa \leqq 4.0$.

15. A toner for developing an electrostatic latent image according to claim 13, wherein 75% by number of the total number of coloring particles have a particle size of 4.0 μm or less.

16. A toner for developing an electrostatic latent image according to claim 13, wherein the at least one type of ultra microparticles are silicon oxide microparticles imparted with hydrophobicity.

17. A toner for developing an electrostatic latent image according to claim 13, wherein the at least one type of super-ultra microparticles are titanium compound microparticles.

18. A toner for developing an electrostatic latent image according to claim 13, wherein a q/d in a frequency distribution, at a temperature of 20° C. and a humidity of 50%, has a peak value of 1.0 or less and a bottom value of 0.005 or more, wherein q represents the electric charge quantity of said toner for developing electrostatic latent image in fC and d represents the volume average particle size of the coloring particles for developing electrostatic latent image in $\mu$m.

19. A developer for an electrostatic latent image comprising at least a carrier and the toner of claim 1.

20. A developer for an electrostatic latent image comprising at least a carrier and the toner of claim 7.

21. A developer for an electrostatic latent image comprising at least a carrier and the toner of claim 13.

22. A method for forming an image comprising forming an electrostatic latent image on a latent image support, forming a toner layer comprised of toner on a surface of a developer that is arranged opposed to the latent image support, developing the electrostatic latent image on the latent image support with said toner layer to form a toner image, and transferring the toner image developed onto a transfer material, wherein said toner comprises the toner of claim 1.

23. A method for forming an image according to claim 22, wherein a ten-point average surface roughness Rz of at least an image-receiving region of the transfer material is 10 $\mu$m or less.

24. A method for forming an image according to claim 22, wherein the method further comprises smoothing at least the image-receiving region of a surface of the transfer material before transferring the toner image to the surface of the transfer material.

25. A method for forming an image according to claim 24, wherein a ten point average smooth roughness Rz of at least the image-receiving region of the surface of the transfer material is 10 $\mu$m or less following the smoothing.

26. A method for forming an image according to claim 24, wherein the smoothing comprises forming a layer comprising a non-color transparent toner on at least the image-receiving region of the transfer material.

27. A method for forming an image according to claim 24, wherein the smoothing comprises forming a layer comprising a white toner on at least the image-receiving region of the transfer material.

28. A method for forming an image according to claim 22, wherein coloring particles having a size of 1.0 to 2.5 $\mu$m comprise from 5 to 50% by number of the total number of coloring particles in the toner.

29. A method for forming an image according to claim 22, wherein the toner is a color toner.

30. A method for forming an image according to claim 22, wherein a toner weight per one color of the toner image transferred onto a transfer material is 0.40 mg/cm$^2$ or less.

31. A method for forming an image according to claim 22, wherein the method further comprises forming a full color image by overlaying sequentially in any order toner images of at least three colors including cyan, magenta and yellow onto the transfer material.

32. A method for forming an image comprising forming an electrostatic latent image on a latent image support, forming a toner layer on a surface of a developer support which faces the latent image support, developing the electrostatic latent image on the latent image support with said toner layer to form a toner image, and transferring the toner image developed onto a transfer material, wherein said toner comprises the toner of claim 7.

33. A method for forming an image according to claim 32, wherein the method further comprises forming a full color image by overlaying sequentially in any order toner images of at least three colors including cyan, magenta and yellow onto the transfer material.

34. A method for forming an image according to claim 32, wherein a ten-point average surface roughness Rz of at least an image-receiving region of the transfer material is 10 $\mu$m or less.

35. A method for forming an image comprising forming an electrostatic latent image on a latent image support, forming a toner layer on a surface of a developer support which faces the latent image support, developing the electrostatic latent image on the latent image support with said toner layer to form a toner image, and transferring the toner image developed onto a transfer material, wherein said toner comprises the toner of claim 13.

36. A method for forming an image according to claim 35, wherein the method further comprises forming a full color image by overlaying sequentially in any order toner images of at least three colors including cyan, magenta and yellow onto the transfer material.

37. A method for forming an image according to claim 35, wherein a ten-point average surface roughness Rz of at least an image-receiving region of the transfer material is 10 $\mu$m or less.

* * * * *